US005670732A

United States Patent [19]

Utsumi et al.

[11] Patent Number: 5,670,732

[45] Date of Patent: Sep. 23, 1997

[54] MIDI DATA TRANSMITTER, RECEIVER, TRANSMITTER/RECEIVER, AND MIDI DATA PROCESSOR, INCLUDING CONTROL BLOCKS FOR VARIOUS OPERATING CONDITIONS

[75] Inventors: Naoto Utsumi; Kuninori Ohuchi; Kikuro Yamauchi; Haruhiko Matsui, all of Shizuoka-ken, Japan

[73] Assignee: Kabushiki Kaisha Kawai Gakki Seisakusho, Shizuoka-ken, Japan

[21] Appl. No.: 452,173

[22] Filed: May 26, 1995

[30] Foreign Application Priority Data

| | | | |
|---|---|---|---|
| May 26, 1994 | [JP] | Japan | 6-138278 |
| May 26, 1994 | [JP] | Japan | 6-138279 |
| May 26, 1994 | [JP] | Japan | 6-138280 |
| Jun. 14, 1994 | [JP] | Japan | 6-155267 |
| Jun. 16, 1994 | [JP] | Japan | 6-158108 |
| Jan. 13, 1995 | [JP] | Japan | 7-021233 |
| Jan. 13, 1995 | [JP] | Japan | 7-021234 |

[51] Int. Cl.[6] ..... G10H 1/00

[52] U.S. Cl. ..... 84/645

[58] Field of Search ..... 84/618, 645, 662, 84/735, DIG. 7

[56] References Cited

U.S. PATENT DOCUMENTS

| | | | |
|---|---|---|---|
| 4,753,146 | 6/1988 | Seiler | 84/DIG. 7 |
| 4,945,806 | 8/1990 | Merrill | 84/645 |
| 4,980,519 | 12/1990 | Mathews | 84/735 X |
| 5,121,667 | 6/1992 | Emery et al. | 84/645 X |
| 5,296,641 | 3/1994 | Stelzel | 84/645 X |
| 5,357,048 | 10/1994 | Sgroi | 84/645 |
| 5,361,673 | 11/1994 | Kira et al. | 84/645 X |
| 5,398,278 | 3/1995 | Brotz | 84/645 X |
| 5,410,099 | 4/1995 | Kosugi | 84/618 |
| 5,416,526 | 5/1995 | Yamamoto | 84/645 X |
| 5,455,380 | 10/1995 | Matsuda et al. | 84/662 |

*Primary Examiner*—Stanley J. Witkowski

*Attorney, Agent, or Firm*—Evenson, McKeown, Edwards & Lenahan, P.L.L.C.

[57] ABSTRACT

A MIDI data transmitter/receiver for a MIDI instrument device which delivers MIDI data for transmitting performance information received/transmits a radio signal modulated by the MIDI data by a transmitter/receiver block connected to the MIDI instrument. The MIDI data transmitter/receiver includes a lock-type setting switch for setting initial operating conditions of the transmitter/receiver block. The control block controls the transmitter/receiver block based on the initial operating conditions set by the lock-type setting switch, when the power is turned on. In another form of the invention, data indicative of operating conditions set by the control block is stored in an electrically rewritable memory, and the control block controls the transmitter/receiver block based on the initial operating conditions set based on data of newest operating conditions stored in the memory, when the power is turned on. Other forms of the invention are also provided.

19 Claims, 58 Drawing Sheets

STARTING ADDRESS OF RECEPTION DATA PREPARATION BUFFER (RDRBS)
DATA STARTING ADDRESS OF RECEPTION DATA PREPARATION BUFFER (RDRBK)
READING POINTER OF RECEPTION DATA PREPARATION BUFFER (RDRBP)
ENDING ADDRESS OF RECEPTION DATA PREPARATION BUFFER (RDRBE)
STARTING ADDRESS OF RECEPTION DATA BUFFER (RDBS)
WRITING POINTER OF RECEPTION DATA BUFFER (RDBP)

MIDI DATA TRANSMITTER, RECEIVER, TRANSMITTER/RECEIVER, AND MIDI DATA PROCESSOR, INCLUDING CONTROL BLOCKS FOR VARIOUS OPERATING CONDITIONS

BACKGROUND OF THE INVENTION

1. Field of the Invention

This invention relates to a MIDI (Musical Instrument Digital Interface) data transmitter, a MIDI data receiver, and a MIDI data transmitter/receiver, for transmitting and/or receiving a MIDI signal (i.e. MIDI data) representative of performance information, between MIDI instrument devices including performance devices, such as keyboards and MIDI guitars, tone generators, and sequencers, as well as a MIDI data processor for receiving MIDI data from a MIDI data output device, such as a key-board, a MIDI guitar, and a sequencer, processing the received MIDI data, and then delivering the resulting MIDI data to a MIDI instrument, such as a tone generator and a sequencer.

2. Prior Art

A MIDI data transmitter/receiver of this kind has been proposed by the present assignee in Japanese Patent Application No. 6-72463 corresponding to U.S. Ser. No. 08/405373), which transmits MIDI data (the term "MIDI data" is used throughout the specification to mean data conforming to MIDI standards as well as a signal carrying data defined as such) by a radio signal between a keyboard, as an electronic muscial instrument, and a tone generator remote from the keyboard. The MIDI data transmitter/receiver is connected to a MIDI instrument, and comprised of a transmitter/receiver block (radio means), an unlock-type switch for setting operating conditions, such as a transmitting/receiving channel used by the transmitter/receiver block and a transmission control mode, a control block responsive to a switch signal delivered from the unlock-type switch for controlling the transmitter/receiver block, and a ROM for storing data of initial operating conditions of the transmitter/receiver block to be used when the power is turned on.

According to the proposed MIDI data transmitter/receiver, when the power is turned on, the control block reads out the initial operating conditions of the transmitter/receiver from the ROM, and sets the operating conditions based on the read data of the initial operating conditions, to thereby control the transmitter/receiver block according to the operating conditions set in this manner. In short, the proposed MIDI data transmitter/receiver is initialized to the operating conditions set by a maker before shipment. Therefore, a user of the proposed transmitter/receiver operates the unlock-type switch to modify the initialized operating conditions, such as the setting of a transmitting/receiving channel, to make the transmitter/receiver suitable for use.

In the proposed transmitter/receiver, data of the initial operating conditions is stored in the ROM for the following reason: With recent reduction in size of the electronic musical instrument, the MIDI data transmitter/receiver is also required to be reduced in size. Accordingly, a large switch, such as a rotary switch, cannot be used, but an unlock-type switch, such as a small-sized push switch or a thin ten-key switch, is required to be used instead. The rotary switch or the like has a memory function in itself through contacts established between fixed contact points and movable contact points. The unlock-type switch, however, does not have a memory function in itself. Therefore, the CPU counts the number of times of the unlock-type switch being depressed, and changes the initial operating conditions according to the count. As a result, when the power is turned off, the count stored in the CPU, i.e. data of operating conditions, such as a changed setting of the channel, is deleted. Therefore, to initially set operating conditions of the transmitter/receiver block when the power is turned on, it is required to store the initial operating conditions in the ROM in advance.

Thus, in the case of proposed MIDI data transmitter/receiver, once the power has been turned off, the operating conditions of the transmitter/receiver which the user took the trouble of setting to adapt the transmitter/receiver to the use are uniformly reset to the original operating conditions based on the data of default operating conditions stored in the ROM, i.e. the default operating conditions set by the maker, when the power is turned on later. Therefore, the proposed MIDI data transmitter/receiver has room for improvement in that the operating conditions of the transmitter/receiver block are required to be changed by the unlock-type switch for adaptation of the transmitter/receiver to various uses.

On the other hand, a MIDI data processor is conventionally known, which is incorporated in a tone generator for converting MIDI data received in a serial form via a MIDI cable from a keyboard connected thereto or received by radio from a remote keyboard, into MIDI data in a parallel form, and controls tone generating operation of a VCO (Voltage Controlled Oscillator) within the tone generator based on the resulting MIDI data.

The conventional MIDI data processor performs control based on note-on data (MIDI data) delivered from the keyboard such that the VCO generates a tone corresponding to a note number indicated by the note-on data, and the VCO stops tone generation when note-off data is received from the keyboard, which corresponds to the note number of the tone being generated.

However, when the keyboard is connected via the MIDI cable to a tone generator remote therefrom, there arises a case in which the note-off data corresponding to the note number of the tone being generated cannot be received properly due to a signal delay caused by the MIDI cable, or a difference in time between rise and fall of an electric signal in photoelectric conversion carried out by a photocoupler which is used at an input block of a receiver circuit for receiving the MIDI data. Further, when data transmission by radio is utilized, there also arise a case in which the note-off data cannot be received properly due to phasing, etc. In such cases, the tone generator cannot stop tone generation of the VCO based on the note-off data. As a result, the tone continues to be generated on and on, which requires resetting of the tone generator by a manual operation. However, the resetting operation is practically impossible, especially when the keyboard and the tone generator are remote from each other, which results in an serious inconvenience to performance of a player or operator.

To solve this problem, it is known to send back the received MIDI data to the keyboard to confirm that the MIDI instrument has received the data properly. However, this requires a MIDI cable or a radio circuit of a duplex communication type, which results in an increased cost, and also takes more time in sending back the data. Further, a method of transmission by parity check may be proposed. In this case, a simplex transmission type may be used for a communication circuit. However, although a data transmission error is notified, if any, it is still impossible for the tone generator to know data to be received. Therefore, the above problem cannot be solved.

Further, a MIDI data transmitter is conventionally known, which is comprised of a transmitter block for modulating a high-frequency signal by MIDI data delivered from a keyboard as performance means and transmitting the resulting radio signal, and a transmission control block for controlling data transmission of the transmitter block. Further, a MIDI data receiver is also conventionally known, which is comprised of a receiver block for receiving a radio signal from a MIDI data transmitter and demodulating the received radio signal, and a received data output block for delivering MIDI data based on the demodulated radio signal to a MIDI instrument.

According to the conventional MIDI data transmitter, when the keyboard delivers MIDI data, the transmission control block controls the transmitter block such that the radio signal obtained by modulating the high-frequency signal by the MIDI data is immediately transmitted. On the other hand, according to the conventional MIDI data receiver, the receiver block receives a radio signal transmitted from the transmitter and the received data output block immediately delivers the received MIDI data to the MIDI instrument, e.g. a tone generator. The tone generator generates a tone based on the MIDI data input thereto.

However, these conventional transmitter and receiver suffer from the following problems: When the MIDI data is transmitted by the radio signal from the transmitter to the receiver, it is sometimes necessary to send reception control data, such as call name data for a receiver and changeover control data for changing over a receiving frequency, prior to transmission of the MIDI data. In such an event, if the receiver immediately delivers the received data as MIDI data to the tone generator, the tone generator undergoes failure.

Further, a transmitter proposed by the present assignee in the aforementioned Japanese Patent Application includes a transfer data temporary storage block for storing MIDI data, and a transmitter block for transmitting the MIDI data stored in the transfer data temporary storage block. According to the proposed transmitter, when the MIDI data is delivered from performance means, it is temporary stored into the transfer data temporary storage block, and then sent out to the transmitter block by a so-called FIFO (First-In First-Out) method, and the transmitter block transmits the data by a radio signal. On the other hand, a receiver proposed by the present assignee in the same application includes a receiver for receiving MIDI data transmitted by a radio signal, and delivers the received MIDI data to a tone generator. As a result, the MIDI data is transmitted from the performance means to the tone generator. When note-on data is delivered from the performance means, for example, the tone generator generate a tone having a tone number indicated by the note-on data, and when note-off data corresponding to the note-on data is delivered from the performance means, the tone having the note number is inhibited from being generated.

In this case, the MIDI data is input to the transmitter at a transfer rate of 31.25 KHz resultated by the MIDI standards. The transmitter is only permitted to carry out transmission at a much lower transfer rate (e.g. 4.8 KHz) in a particular transmission frequency range, under restrictions of legal regulations. Therefore, when the MIDI data continues to be input, it is impossible to transmit all the input MIDI data. However, the MIDI data is not continuously delivered from the performance means, but is intermittently delivered when note-on or note-off data has occurred. Therefore, the MIDI data received is temporarily stored in the transfer data temporary storage block having a sufficient capacity, and then transmitted therefrom even while the MIDI data is not supplied, thereby making it possible to transmit all the MIDI data received.

However, a conventional MIDI instrument system including the transmitter and the receiver described above has room for improvement in respect of the following points: While it is possible to transmit all the MIDI data with some time difference in input and output of the MIDI data during an ordinary kind of performance, it is sometimes impossible to transmit all the MIDI data when note-on and note-off operations are repeatedly carried out in a short time period e.g. when a piece with a beat of a high tempo is played. This is because a data transfer rate at which the data is input to the transmitter is higher than a data transfer rate at which the transmitter sends out the data, and hence an amount of MIDI data remaining in the transfer data temporary storage block gradually increases, until it finally exceeds the capacity of the transfer data temporary storage block. In this case, it is impossible, for example, to effect note-off of a note number of a tone being generated, resulting in an endless generation of the tone by the tone generator.

The MIDI data (signal) transmitter/receiver proposed by the present assignee includes a transmitter block and a receiver block which each is capable of selectively using one of a plurality of channels, and a channel switch for selecting one of the plurality of channels. A one unit of the MIDI data transmitter/receiver is connected to a MIDI instrument which delivers the MIDI data and the other unit of the MIDI data transmitter/receiver to a MIDI instrument which receives the same. The one unit transmits a radio signal to the other unit, whereby the MIDI data is transmitted from the former MIDI instrument to the latter MIDI instrument.

According to the proposed MIDI data transmitter/receiver, a user sets a transmitting channel of the transmitter block of the MIDI data transmitter/receiver on the transmitting side and a receiving channel of the receiver block of the MIDI data transmitter/receiver on the receiving side to the same channel by respective channel switches, and then MIDI data is transmitted from the MIDI data transmitter/receiver on transmitting side.

However, there is a case in which the channel to which both the transmitter/receivers are set are already being used by some other MIDI data transmitter/receiver for transmission to another MIDI instrument. In such a case, the user has to search for a free or unoccupied channel by repeatedly testing transmission of the MIDI data from the one transmitter/receiver to the other. This is a point which leaves room for improvement.

The present assignee has already proposed in the aforementioned Japanese Patent Application a transmitter which is connected to performance means (e.g. a keyboard) and transmits a radio signal modulated by MIDI data, and a receiver connected to sound-producing means for modulating the received radio signal into MIDI data.

According to these transmitter and receiver, when MIDI data corresponding to a depressed key is delivered from the performance means to the transmitter, the transmitter modulates a high-frequency signal by the MIDI data, and sends out the resulting radio signal to the receiver. On the other hand, the receiver receives the radio signal and demodulates the same into MIDI data and delivers the resulting MIDI data to the sound-producing means (e.g. a tone generator). The sound-producing means generates a tone corresponding to the depressed key designated by the MIDI data received.

However, these transmitter and receiver have room for improvement in the following points: First, in the above example, the transmitter and the receiver are used in pair to transmit the MIDI data from the performance means to the sound-producing means. Therefore, to transmit MIDI data from a plurality of performance means, it is required to provide the same number of pairs of the transmitter and the receiver as the number of the plurality of performance means, which increases cost of a MIDI instrument system formed by these component units.

Further, when the plurality of transmitters are used, it is necessary to employ transmitting frequencies different from each other. In practice, the number of bands for transmitting frequencies is restricted by law or regulations, and hence the number of performance means which can be employed is limited. Further, even if a limited number of performance means are used, the transmitters and receivers are usually installed rather densely in limited space, which causes radio interference, interfering with performance.

SUMMARY OF THE INVENTION

It is a first object of the invention to provide a MIDI data transmitter/receiver which enables a user to set initial operating conditions of radio means to which it is initialized when the power is turned on, as desired.

It is a second object of the invention to provide a MIDI data transmitter/receiver which makes it possible to set initial operating conditions of radio means to which it is initialized when the power is turned on, according to operating conditions used before the power was turned off.

It is a third object of the invention to provide a MIDI data processor which is capable of accurately stopping a continued tone generation caused by malfunction of a MIDI instrument connected thereto.

It is a fourth object of the invention to provide a MIDI data transmitter which is capable of distinguishing MIDI data from data other than MIDI data, and preventing the data other than MIDI data from being delivered to a MIDI instrument connected to a counterpart (i.e. receiver).

It is a fifth object of the invention to provide a MIDI data receiver which is capable of distinguishing one MIDI data from data other than MIDI data, and preventing the data other than MIDI data from being delivered to a MIDI instrument connected thereto.

It is a sixth object of the invention to provide a MIDI data transmitter which is capable of positively preventing transmission of note-on data without any following note-off data corresponding thereto, when MIDI data is transmitted and received at a transmission rate lower than a data transfer rate of the MIDI data.

It is a seventh object of the invention to provide a MIDI data receiver which is capable of positively preventing reception of note-on data without any following note-off data corresponding thereto, when MIDI data is transmitted and received at a transmission rate lower than a data transfer rate of the MIDI data.

It is an eighth object of the invention to provide a MIDI data transmitter/receiver which is capable of transmitting MIDI data at a high rate.

It is a ninth object of the invention to provide a MIDI data transmitter which is capable of reducing cost of a MIDI instrument system within which MIDI data is transmitted by radio, and at the same time reliably transmitting the MIDI data.

It is a tenth object of the invention to provide a MIDI data receiver which is capable of reducing cost of a MIDI instrument system within which MIDI data is transmitted by radio, and at the same time reliably transmitting the MIDI data.

To attain the first object, according to a first aspect of the invention, there is provided a MIDI data transmitter/receiver for a MIDI instrument which delivers MIDI data for transmitting performance information, including:

radio means connected to the MIDI instrument for transmitting and/or receiving a radio signal modulated by the MIDI data, an unlock-type switch for setting operating conditions of the radio means, operating conditions-setting means for setting the operating conditions based on a switch signal of the unlock-type switch, and a control block for controlling the radio means according to the set operating conditions.

The MIDI data transmitter/receiver according to the first aspect of the invention is characterized in that the MIDI data transmitter/receiver comprises a lock-type setting switch for setting initial operating conditions of the radio means, and the control block controls the radio means based on the initial operating conditions set by the lock-type setting switch, when the power is turned on.

According to the MIDI data transmitter/receiver of the first aspect of the invention, a user can set initial operating conditions of the radio means, such as a channel and a transfer control mode, in advance by the setting switch, thereby causing the control block to control the radio means based on the initial operating conditions set by the setting switch when the power is turned on. Therefore, the user can initialize the radio means when the power is turned on, to desired settings. This makes it possible for the user to start transmission of MIDI data by the radio means immediately after the power is turned on.

Preferably, the lock-type setting switch is a dip switch.

To attain the second object, according to a second aspect of the invention, there is provided a MIDI data transmitter/receiver for a MIDI instrument which delivers MIDI data for transmitting performance information, including:

radio means connected to the MIDI instrument for transmitting and/or receiving a radio signal modulated by the MIDI data, an unlock-type switch for setting operating conditions of the radio means, operating conditions-setting means for setting the operating conditions based on a switch signal of the unlock-type switch, and a control block for controlling the radio means according to the set operating conditions.

The MIDI data transmitter/receiver according to the second aspect of the invention is characterized in that the MIDI data transmitter/receiver comprises memory means which is electrically rewritable and stores data of operating conditions set by the control block, and the control block controls the radio means based on newest ones of the operating conditions stored in the memory means, when the power is turned on.

According to the MIDI data transmitter/receiver of the second aspect of the invention, after the power is turned on, operating conditions of the radio means, such as a channel and a transfer control mode, set by a user by the unlock-type switch are stored and held in the memory means even after the power is turned off. Therefore, when the power is turned on again, the control block controls the radio means based on the newest operating conditions stored in the memory means. Therefore, the operating conditions set when the power is turned on can be set the same settings as set before the power is turned off, which enables the user to transmit MIDI data by the radio means immediately after the power is turned on.

Preferably, the memory means is equipped with back-up means for holding contents of storage when the power of the MIDI data transmitter/receiver is turned off.

Alternatively, the memory means is formed by non-volatile memory means.

More preferably, the MIDI data transmitter/receiver includes other non-volatile memory means storing data of initial operating conditions of the radio means, and a lock-type switch, wherein the control block controls the radio means based on one of the data of initial operating conditions stored in the other non-volatile memory means and settings set by the lock-type switch, when the memory means stores no data of the operating conditions, when the power is turned on.

According to the preferred embodiment, when the power is initially turned on after shipment, the memory means has no operating conditions stored therein, and hence the control block initializes the radio means based on initial operating conditions stored in the ROM (the other non-volatile memory means) or set by the lock-type switch. That is, the radio means is initially set to the operating conditions set by a maker of the transmitter/receiver.

On the other hand, once the user set the operating conditions by the unlock-type setting switch, data of changed operating conditions is stored into the memory means. Therefore, when the power is turned once it is turned off, the memory means controls the radio means based on the newest operating conditions stored in the memory means. Therefore, when the power is turned on, the radio means can be initialized to the operating conditions set before the power was turned off. Further, if the memory means is in failure, the control means initializes the radio means based on initial operating conditions stored in the ROM (the other non-volatile memory means) or settings by the lock-type switch, since the operating conditions stored in the memory means are not available.

To attain the third object, according to a third aspect of the invention, there is provided a MIDI data processor for processing MIDI data delivered from a MIDI data output device and delivering processed MIDI data to a MIDI instrument.

The MIDI data processor according to third aspect of the invention is characterized by comprising:

- a determination block for determining whether or not sad MIDI data delivered from the MIDI data output device is note-on data
- a counter starting to operate when the determination block has determined that the MIDI data is the note-on data; and
- a control block for generating note-off data having a note number identical to a note number of the note-on data when the count of the counter has reached a predetermined value.

According to the MIDI data processor according to the third aspect of the invention, when MIDI data is delivered from the MIDI data output device connected thereto, the determination block determines whether or not the MIDI data is note-on data. When the MIDI data is determined to be note-on data, the counter starts. When the count of the counter has reached a predetermined value, the control block generates and delivers note-off data corresponding to the note-on data. Therefore, even if note-off data is not received due to abnormality in a communication line, generation of a tone can be necessarily stopped when a predetermined time period has elapsed after the electronic musical instrument starts to generate the tone.

Preferably, the counter is formed of a plurality of counters corresponding to all note numbers, respectively.

According to this preferred embodiment, since a plurality of counters are provided correspondingly to all note numbers, even when note-on data of a lot of note numbers is delivered at a time from the MIDI data output block, endless tone generation can be reliably inhibited for all the note numbers. Further, as a result of immediate start of each counter upon discrimination of each note number. It is possible to reduce time before the counters are started.

Further, preferably, the counter is formed of a plurality of counters, and the determination block including memory means for storing a counter number of one of the counters having started to operate when the determination block has determined that the MIDI data is the note-on data, and a note number of the note-on data, the control block generating note-off data having a note number identical to the note number corresponding to the counter number of the one of the counters stored in the memory means when the count of the one of the counters has reached the predetermined value, and delivering the note-off data to the MIDI instrument.

According to this preferred embodiment, when the determination block determines that the MIDI data is note-on data, one of the counters starts, while the memory means stores a counter number of the counter having started, and a note number of the note-on data. On the control block generates note-off data corresponding to the note-number stored in the memory means when the count of the counter reaches a predetermined value, and delivers the same to the MIDI instrument. Therefore, even if note-off data is not received due to abnormality in a communication line, generation of a tone can be necessarily stopped when a predetermined time period has elapsed after the electronic musical instrument starts to generate the tone. Further, the number of counters can be less than the number of tone numbers, which makes it possible to reduce manufacturing cost.

To attain the fourth object, according to a fourth aspect of the invention, there is provided a MIDI data transmitter for a MIDI instrument which delivers MIDI data for transmission of performance information, the MIDI data transmitter being connected to the MIDI instrument and including modulation means for modulating a high-frequency signal by the MIDI data delivered from the MIDI instrument, and data other than the MIDI data, a transmitter block for transmitting a radio signal prepared by modulation of the high-frequency signal to a receiver, and a transmission control block for controlling start of transmission by the transmitter block.

The MIDI data transmitter according to the fourth aspect of the invention is characterized by comprising:

- a transmission data output block for transmitting the MIDI data and the other data to the transmitter block;
- transmission time-measuring block for measuring a transmission time having elapsed from a start of transmission by the transmitter block; and
- control means for performing control such that the transmission data output block delivers the other data to the transmitter block until the transmission time reaches a predetermined time period, and delivers the MIDI data to the transmitter block after the transmission time period has reached the predetermined time period.

According to the MIDI data transmitter of the fourth aspect of the invention, the transmission control block controls the transmitter block, and when the transmitter block starts transmission, the transmission time-measuring block measures the transmission time after the start of transmission. In this case, the transmission data output block transmits the data other than MIDI data to the transmitter block until the transmission time reaches a predetermined time period, and after the transmission time has reached the predetermined time period, it transmits the MIDI data to the transmitter block. That is, the radio signal modulated by the MIDI data is delivered to the receiver only after the predetermined time period has elapsed after the start of transmission of data. Therefore, it is possible to prevent the receiver from delivering the data other than MIDI data to the tone generator or the like by establishing a setting that a portion of data received within a predetermined time period after the start of reception of the data is not used as the MIDI data. This makes it possible to prevent an erroneous operation of the tone generator or the like on the receiver side.

Preferably, the other data is formed of reception control data for controlling the receiver and/or dummy data.

According to the preferred embodiment, the transmission data output block transmits reception control data for controlling the receiver and/or dummy data, before the predetermined time period is reached. Therefore, the predetermined time period after the start of transmission may be utilized for transmitting the control data of the transmitter, and on the transmitter side, the reception control data and the dummy data may be used for measuring the predetermined time period, which makes it possible to measure the predetermined time period accurately. As a result, it is positively possible to prevent an erroneous operation of the tone generator or the like on the receiver side.

To attain the fifth object, according to a fifth aspect of the invention, there is provided a MIDI data receiver for a MIDI instrument which delivers MIDI data for transmission of performance information, the MIDI data receiver being connected to the MIDI instrument and including a receiver block for receiving a radio signal modulated by the MIDI data and other data, demodulation means for demodulating the received radio signal, and a received data output block for delivering received data based on the demodulated radio signal to the MIDI instrument.

The MIDI data receiver according to the fifth aspect of the invention is characterized by comprising:

reception-detecting block for detecting reception of data, based on the received radio signal and/or the demodulated radio signal;

reception time-measuring means for measuring a reception time having elapsed after the reception-detecting block has detected the reception of the data; and output control means for performing control such that the received data output block delivers the received data to the MIDI instrument after the reception time has reached a predetermined time period.

According to the MIDI data receiver of the fifth aspect of the invention, the receiver block receives a radio signal, and demodulates the radio signal. The received data output block delivers MIDI data based on the demodulated radio signal to the MIDI instrument. In this case, when the reception-detecting block detects reception of data based on the received radio signal and/or the demodulated radio signal, the reception time-measuring means measures a reception time having elapsed after the reception-detecting block has detected the reception of the data. On the other hand, the received data output block delivers received data after the predetermined time period is reached to the MIDI instrument as MIDI data. Therefore, it is possible to prevent the data other than MIDI data from being delivered to the tone generator or the like by establishing a setting that a portion of data received within a predetermined time period after the start of reception of the data is not used as the MIDI data. This makes it possible to prevent an erroneous operation of the tone generator or the like on the receiver side.

To attain the sixth object, according to a sixth aspect of the invention, there is provided a MIDI data transmitter including a MIDI data storage block for storing MIDI data delivered from a MIDI data output device for transmitting performance information, and a transmitter block for transmitting the MIDI data stored in the MIDI data storage block by a radio signal.

The MIDI data transmitter according to the seventh aspect of the invention is characterized by comprising:

a free area-checking block for checking an amount of free area of the MIDI data storage block and all note-off data output block for transmitting all note-off data for turning all notes off via sad transmittter block, when the amount of the free area of the MIDI data storage block checked by the free area-checking block becomes smaller than a predetermined value.

According to the MIDI data transmitter of the seventh aspect of the invention, when the MIDI data is delivered from the MIDI data output block, the MIDI data is stored into the MIDI data storage block; and the transmitter block transmits MIDI data stored in the MIDI data storage block by the radio signal. In this case, when the amount of the free area of the MIDI data storage block checked by the free area-checking block becomes smaller than a predetermined value, all note-off data output block causes the transmitter block to transmit all note-off data for turning off all notes. As a result, even if the free area of the MIDI data storage block is reduced to zero, so that it becomes impossible to transmit note-off data by way of the MIDI data storage block, endless generation of tones on the receiver side can be prevented.

To attain the seventh object, according to a seventh aspect of the invention, there is provided a MIDI data receiver for receiving MIDI data transmitted by a radio signal for transmitting performance information, and delivering the received MIDI data to a MIDI data processor which carries out signal processing based on MIDI data.

The MIDI data receiver according to the seventh aspect of the invention is characterized by comprising:

a note number storage block for storing note numbers of notes which are turned on out of the received MIDI data; and a note-off control block for delivering note-off data corresponding to all note numbers stored in the note number storage block to the MIDI data processor, when all note-off data is received by way of the radio signal.

According to the MIDI data receiver of the seventh aspect of the invention, the note number storage block stores note numbers of notes which are turned on out of the received MIDI data, and when all note-off data is received by way of the radio signal, the note-off control block delivers note-off data corresponding to all note numbers stored in the note number storage block to the MIDI data processor. As a result, even when note-off data is not received, note-off data can be delivered to the MIDI processor, such as a tone generator, which makes it possible to prevents endless generation of musical tones, To attain the eighth object, according to an eighth aspect of the invention, there is provided a MIDI data transmitter/receiver connected to a MIDI instrument for transmitting MIDI data delivered from the MIDI instrument by a radio signal to another MIDI instrument.

The MIDI data transmitter/receiver according to the eighth aspect of the invention is characterized by comprising:

a transmitter block having a plurality of transmitting channels which can be changed over, including a control channel for transmitting data of a free channel;

a receiver block having a plurality of receiving channels which can be changed over;

a free channel-detecting block for changing over one receiving channel of the receiver block to another, and for detecting a free channel out of the plurality of receiving channels, based on reception output from the receiver block at a channel to which the receiver block is charged; and a transmission control for transmitting data of the free channel detected by the free channel-detecting block and the MIDI data delivered from the MIDI instrument to the transmitter block;

wherein the transmission control block changes over the transmitting channel of the transmitter block to the control channel, and after delivering the data of the free channel detected by the free channel-detecting block to the transmitter block, changes over the transmitting channel of the transmitter block to a transmitting channel corresponding to the data of the free channel.

According to the MIDI data receiver of the eighth aspect of the invention, prior to transmission of the MIDI data, the free channel-detecting block searches changes over one receiving channel of the receiver block to another, and searches for a free channel out of the plurality of receiving channels, based on reception output from the receiver block at a channel to which the receiver block is changed. Thereafter, the transmission control block changes the transmitting channel of the transmitter block to the control channel and transmits data of the free channel detected by the free channel-detecting block. This enables the receiver to change its own receiving channel to the free channel based on the data of the free channel. After this, the transmission control block changes the transmitting channel of the transmitter to a transmitting channel corresponding to the data of the free channel, and sends the MIDI data to the transmitter. Therefore, it possible to automatically change over the transmitting channel of the transmitter and the receiving channel of the receiver to a channel which can he used, without carrying out testing transmission by changing the transmitting/receiving channel by a channel changeover switch. This enables prompt transmission of MIDI data.

To attain the eighth object, according to a ninth aspect of the invention, there is provided a MIDI data transmitter/receiver connected to a MIDI instrument for receiving a radio signal transmitted and delivering MIDI data based on the received radio signal to the MIDI instrument connected thereto.

The MIDI data transmitter/receiver according to the ninth aspect of the invention is characterized by comprising:

a receiver block having a plurality of receiving channels which can be changed over, including a control channel for receiving data of a free channel;

a free channel data-detecting block for detecting the data of the free channel from a signal received by the receiver block; and a reception control block for changing over the receiving channel of the receiver block;

wherein the reception control block changes over the receiving channel of the receiver block to the control channel, while the reception-control block is on standby, and changes over the receiving channel of the receiver block to a receiving channel corresponding to the data of the free channel when the free channel data-detecting block has detected the data of the free channel.

According to the MIDI data transmitter/receiver of the ninth aspect of the invention, the reception control block changes over the receiving channel of the receiver block to the control channel when on standby, and changes over the receiving channel of the receiver block to a receiving channel corresponding to the data of the free channel when the free channel data-detecting block has detected the data of the free channel. Therefore, the transmitter side can automatically change over the receiving channel to a channel corresponding to the transmitting channel of the transmitter side.

To attain the eighth object, according to a tenth aspect of the invention, there is provided a MIDI data transmitter/receiver connected to a MIDI instrument for transmitting MIDI data to and receiving MIDI data from another MIDI instrument.

The MIDI data transmitter/receiver according to the tenth aspect of the invention is characterized by comprising:

a transmitter block having a plurality of transmitting channels which can be changed over, including a control channel for transmitting data of a free channel;

a receiver block having a plurality of receiving channels which can be changed over, including a control channel for transmitting data of the free channel;

a transmission/reception changeover block for making operative one of the transmitter block and the receiver block;

a reception control block for controlling changeover of one of the receiving channels of the receiver block to another of the receiving channels when the receiver block is made operative by the transmission/reception changcover block;

a free channel-detecting block for changing over the one receiving channel of the receiver block to the another and detecting a free channel out of the plurality of receiving channels, based on reception output from the receiver block at the another channel to which the receiver block is changed;

a free channel data-detecting block for detecting the data of the free channel from a signal received by the receiver block; and a transmission control block for transmitting the data of the free channel detected by the free channel-detecting block and the MIDI data delivered from the MIDI instrument to the transmitter block;

wherein when the transmission/reception changeover block has made the transmitter block operative, the transmission control block changes over the transmitting channel of the transmitter block to the control channel, and after delivering the data of the free channel detected by the free channel-detecting block to the transmitter block, changes over the transmitting channel of the transmitter to a transmitting channel corresponding to the data of the free channel, as well as delivers the MIDI data to the transmitter block; and wherein when the transmission/reception changeover block has made the receiver block operative, the reception control block changes over the receiving channel of the receiver block to the control channel, and when the free channel data-detecting block has detected the data of the free channel changes over the receiving channel of the receiver to a receiving channel corresponding to the data of the free channel.

According to the MIDI data transmitter/receiver of the tenth aspect of the invention, similarly to the MIDI data transmitter/receiver according to the eighth and ninth aspects of the invention, the transmitting/receiving channel on the transmitter side and the receiver side can be automatically set, and by changeover by the transmission/reception changeover block, the MIDI data transmitter/receiver can be selectively used both as the transmitter and as the receiver.

To attain the ninth object, according to an eleventh aspect of the invention, there is provided a MIDI data transmitter for transmitting MIDI data, which is capable of being connected to a plurality of MIDI data output devices for delivering MIDI data for transmission of performance information.

The MIDI data transmitter according to the eleventh aspect of the invention is characterized by comprising:

a MIDI data input block for inputting MIDI data received from two or more of the plurality of MIDI data devices;

memory means for storing the MIDI data input by the MIDI data input block together with data of each unit number indicative of each of the MIDI data output block having delivered the MIDI data; and a transmitter block for transmitting a radio signal modulated by the data of each unit number indicative of each of the MIDI data output block, and the MIDI data stored together with the data of the each unit number.

According to the MIDI data transmitter of the eleventh aspect of the invention, when a plurality of MIDI data output devices connected to the transmitter deliver MIDI data, the MIDI data input block inputs the MIDI data, and the memory means stores the delivered MIDI data to together with data of a unit number of the MIDI data output block which has delivered the MIDI data. Then, the transmitter block transmits a radio signal modulated by the the data of the unit number and the MIDI data stored in the memory means. As a result, after the transmitter receives the radio signal, it demodulates the radio signal into data of the unit number and the MIDI data, and delivers the MIDI data to a tone generator corresponding to the unit number, whereby MIDI data delivered from the plurality of MIDI data output devices are transmitted to corresponding tone generators, respectively. As a result, one MIDI data transmitter and one MIDI data receiver are enough to perform the above performance, which results in marked reduction cost of the MIDI instrument system, compared with a case in which transmitters and receivers are provided for each of the MIDI data output devices and the tone generators. Moreover, since one transmitting frequency is enough, there is no interference, which makes it possible to transmit the MIDI data reliably.

To attain the tenth object, according to a twelfth aspect of the invention, there is provided a MIDI data receiver for receiving MIDI data, which is capable of being connected to a plurality of MIDI data processors each provided for carrying out signal processing based on MIDI data for transmission of performance information.

The MIDI data receiver according to the twelfth aspect of the invention is characterized by comprising:

a receiver block for receiving a radio signal modulated by data of unit numbers indicative of two or more of the plurality of MIDI data processors, respectively, and MIDI data to be transmitted to the two or more of the plurality of MIDI data processors having the unit numbers, respectively, and demodulating the received radio signal into the data of the unit numbers, and the MIDI data; and a MIDI data output block for delivering the demodulated MIDI data to the MIDI data processors correspending to the demodulated data of the unit numbers, respectively.

According to the MIDI data transmitter of the twelfth aspect of the invention, when the receiver block receives a radio signal modulated by data of a unit number and MIDI data corresponding thereto, and demodulates the radio signal into the data of the unit number and the MIDI data. Then, the MIDI data output block delivers the MIDI data to a tone generator corresponding to the unit number, whereby MIDI data is transmitted to the MIDI data processor. Thus, one receiver can deliver MIDI data to a plurality of MIDI data processors, which makes it possible to markedly reduce the manufacturing coat of the MIDI instrument system. Further, since one transmitting frequency is used, there is no interference occurring within the transmitter, which prevents erroneous MIDI data from being transmitted, to thereby makes it possible to transmit the MIDI data reliably.

The above and other objects, features, and advantages of the invention will become more apparent from the following detailed description taken in conjunction of the accompanying drawings.

DETAILED DESCRIPTION

Next, the invention will be described in detail with reference to the drawings showing preferred embodiments thereof.

Figure 1:
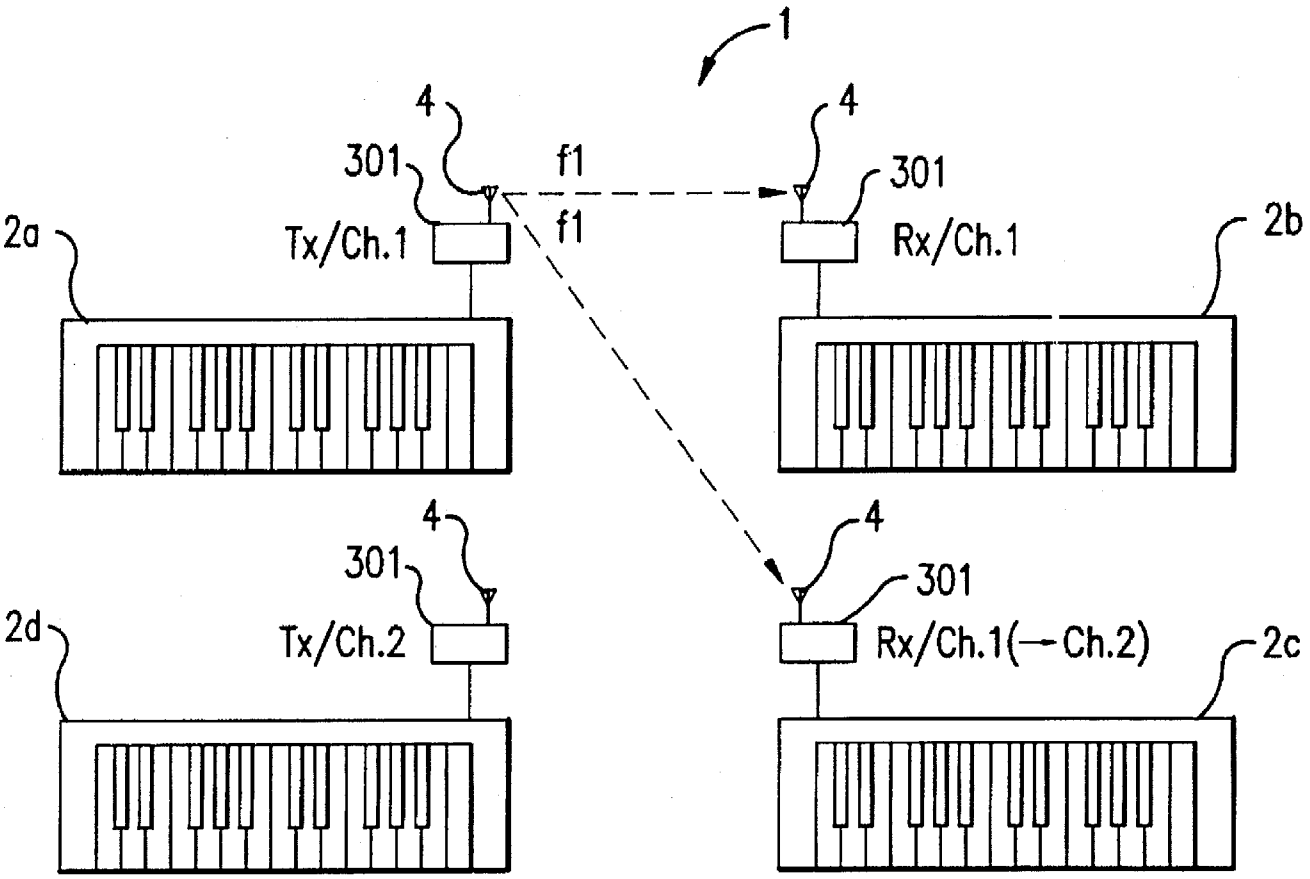
FIG. 1 is a diagram schematically showing a MIDI instrument system comprised of a plurality of keyboards each incorporating a MIDI signal transmitter/receiver according to a first embodiment of the invention.

FIG. 1 schematically shows a MIDI instrument system 1 to which is applied the present invention. As shown therein, the MIDI instrument system 1 is composed of four separate keyboards (MIDI instrument devices) 2*a*, 2*b*, 2*c*, 2*d* (hereinafter, each of the keyboards will be referred to as "the keyboard 2" unless one is specifically discriminated from the others"). Each keyboard 2 has a tone generator (MIDI instrument device, not shown), and a MIDI data transmitter/receiver (hereinafter referred to as "the transmitter/receiver") 301 incorporated therein. Each transmitter/receiver 301 has an antenna 4 mounted thereon for transmitting and receiving a radio signal.

The MIDI instrument system 1 is constructed such that each keyboard 2 can transmit the radio signal based on MIDI data to other keyboards 2 to thereby control the tone generation of the keyboards. As a result, a performance can be imparted with ensemble effects, or alternatively, the keyboards 2 can be set to different tone colors and tone qualities in advance, respectively, to thereby cause each selected one of the keyboards to give a desired performance. More specifically, as illustrated in the figure, let it be assumed that the transmitting frequency of a radio signal transmitted by the keyboard 2*a* is set to f1 (e.g. allotted to Ch. 1 (channel 1)), and the receiving frequency of the radio signal received by the keyboards 2*b*, 2*c* is set to f1 (e.g. allotted to Ch. 1). If a performer plays the keyboard 2 to generate MIDI data, the radio signal formed by modulation with the MIDI data is transmitted to the keyboards 2*b*, 2*c*, which each receive and demodulate the radio signal into the MIDI data, and generate musical tones based on the MIDI data thus obtained. When the transmitting frequency of the keyboard 2*d* and that of the keyboard 2*c* are each changed from the above settings to f2 (e.g. allotted to Ch. 2), the keyboard 2*a* and the keyboard 2*d* can separately control the keyboard 2*b* and the keyboard 2*c*, respectively, for tone generation.

The aforementioned tone generator generates a musical tone corresponding to a depressed key of the keyboard 2 in which the tone generator is incorporated, or a musical tone corresponding to MIDI data transmitted from another keyboard 2 apart therefrom. The transmitter/receiver 3 is capable of operating in a transmitter mode or in a receiver mode, in a switchable manner. In the transmitter mode, a radio signal prepared by modulation with MIDI data corresponding to a performance signal, such as a note-on signal and a note-off signal, is transmitted to other keyboards 2, while in the receiver mode, a radio signal transmitted from a remote keyboard 2 is received, and is demodulated into MIDI data. The MIDI data thus recovered is delivered to the keyboard (main part) 2, specifically to the tone generator. It should be noted that the term "MIDI data" is used throughout the specification in such a meaning that the meaning of "the MIDI signal" is included therein.

Next, the arrangement of the transmitter/receiver 301 will be described with reference to FIG. 2. The transmitter/receiver 301 is comprised of a CPU 11, a control data storage block 12, a switch block 13, a MIDI data input block 14, a transfer data temporary storage block 15, a control signal output block 16, a transmission data output block 17, a transmitter/receiver block 18, a received data input block 19, a MIDI data output block 20, and an assigner 21.

The CPU 11 controls the overall operation of the transmitter/receiver 301. More specifically, it performs control concerning detection of an on/off status of each switch, not shown, of the switch block 13, control for setting initial operating conditions carried out, when the power is turned on, based on data or settings of initial operating conditions of the transmitter/receiver block 18 set by the switch block 13, input/output control of MIDI data delivered to or received from the keyboard (i.e. main part thereof other than the transmitter/receiver 301 and the antenna 4) 2, writing of MIDI data into the transfer data temporary storage block 15 and reading the same therefrom, writing of the MIDI data into the assigner 21 and deleting the MIDI data written therein, as well as transmission/reception changeover control, control of transmitting/receiving channel changeover, transfer control of transmission and reception data, for the transmitter/receiver block 18, and so forth.

The control data storage block 12 stores operation programs of the CPU 11, control data for controlling a transmitting or receiving frequency in each channel number of the transmitter/receiver block 18 having a plurality of channels.

The switch block 13 includes a transfer control mode-selecting switch, referred to hereinafter, a channel switch formed of an unlock-type push switch for selectively setting a transmitting/receiving channel (Ch.) of the transmitter/receiver 18 out of a plurality of channels, an initial setting switch (lock-type switch), and a free channel automatic detection switch for automatically detecting a free or unoccupied channel out of the plurality of channels, none of which are shown.

The transfer control mode-selecting switch is comprised of a transmission mode switch, a receiver mode switch, an automatic changeover mode switch, and a performance mode switch, all of these switches being each formed of an unlock-type push switch. The transmitter mode switch sets the transmitter/receiver 301 to the transmitter mode when it is turned on or depressed, while the, receiver mode switch sets the transmitter/receiver 301 to the receiver mode when it is turned on, or depressed. When one of these switches is on, the transmitter/receiver 301 is in a manual mode in which the operating mode of the transmitter/receiver 301 has been manually fixed. The automatic changeover mode switch sets the transmitter/receiver 301 to the automatic changeover mode in which the transmitter/receiver 301 is automatically switched between the transmitter mode and the receiver mode. It should be noted that the transmitter mode switch and the receiver mode switch are applied in preference to the automatic changeover mode switch, and hence if the transmitter mode switch or the receiver mode switch is turned on, the transmitter/receiver 301 is preferentially set to the manual mode, i.e. to the transmitter mode or the receiver mode, irrespective of the ON/OFF state of the automatic changeover mode switch. The performance mode switch is turned on when the transmitter/receiver block 18 is separated in function from the reset of the keyboard 2 to cause the keyboard 2 to operate as a single or isolate MIDI instrument unit. The setting via the performance mode switch is applied in preference to the first three mode switches described above.

The initial setting switch sets initial settings of operation of the transmitter/receiver block, in respect of the transmitting/receiving channel, the transfer control mode, the transmission/transfer rate, and execution of the automatic free channel-detecting processing. It is comprised of the same number of dip switches as the sum of the numbers of settings (e.g. the number of channels) which can be established for each item of operating conditions. The user or operator is capable of setting the initial operating conditions of the transmitter/receiver as desired by operating the initial setting switch.

The MIDI data input block 14 is an interface circuit which converts MIDI data received from the keyboard 2 (as the main part thereof other than the transmitter/receiver 3 and the antenna 4) in a serial form into MIDI data in a parallel form.

The transfer data temporary storage block 15 is formed by a so-called FIFO (First-in First-out) memory, and when the transmitter/receiver 301 is in the transmitter mode, the MIDI data received via the MIDI data input block 14 from the main part of the keyboard 2 is sequentially written into the transfer data temporary storage block 15. The MIDI data written therein is read by the CPU 11 in the written order, and transmitted via the transmitter/receiver block 18 as a radio signal to a remote keyboard 2. On the other hand, when the transmitter/receiver 301 is in the receiver mode, the MIDI data received via the transmitter/receiver block 18 and the received data input block 19 from the remote keyboard 2 is also sequentially written into the transfer data temporary storage block 15. The MIDI data written therein is sequentially read by the CPU 11 and delivered via the MIDI data output block 20 to the keyboard (main part) 2.

The control signal output block 16 delivers a transmission/reception control signal, a transmitting channel control signal, and a receiving channel control signal to the transmitter/receiver block 18.

The transmission data output block 17 converts a MIDI data in a parallel form read from the transfer data temporary storage block 15 into MIDI data in a serial form.

The transmitter/receiver block 18 is a FM transmitter/receiver, though not particularly limited thereto, which is comprised of a transmitter block for transmitting a radio signal and a receiver block for receiving a radio signal, with a transmitting/receiving frequency band of 430 MHz, a transmission output power of 10 mW, and 40 transmitting/receiving channels. The transmitter block generates the radio signal by modulating a high-frequency signal (carrier signal) with the MIDI data input to the transmitter/receiver 301, which is transmitted via the antenna 4. The receiver block receives the radio signal via the antenna 4 from the remote keyboard 2, and demodulates the radio signal into the MIDI data to deliver the same to the received data input block 19.

The received data input block 19 converts the MIDI data in a serial form delivered from the receiver block of the transmitter/receiver block 18 into a MIDI data in a parallel form.

The MIDI data output block 20 converts the MIDI data in the parallel form based on the MIDI data read from the transfer data temporary storage block 15 into a MIDI data in a serial form, and delivers the same to the keyboard (main part) 2.

The assigner 21 is a memory for storing data indicative of an on/off status of every note number in every MIDI channel, which is input to the MIDI data input block 14 and the received data input block 19.

Next, the operation of the transmitter/receiver 301 will be described separately for the automatic changeover mode and the manual mode.

In the automatic changeover mode, the transmitter/receiver 301 including the transmitter/receiver block 18 is normally set to the receiver mode, whereby it is in a standby state for receiving MIDI data via the MIDI data input block 14 from the keyboard (main park) 2, and MIDI data via the transmitter/receiver block 18 from the remote keyboard 2. In the standby state, when the MIDI data is received via the MIDI data input block 14 from the keyboard (main part) 2, the transmitter/receiver block 18 is automatically set to the transmitter mode, to thereby transmit the received MIDI data via the transmission data output block 17 and the transmitter/receiver block 18 to the remote keyboard 2. On the other hand, when the MIDI data is received via the transmitter/receiver block 18 and the received data input block 19 from the remote keyboard 2, the transmitter/receiver block 16 is automatically set to the receiver mode, to thereby deliver the MIDI data received from the remote keyboard 2 via the MIDI data output block 20 to the keyboard (main part) 2.

In the manual mode, one of the transmitter mode and the receiver mode is selected in an alternative manner. More specifically, in the manual mode, the keyboard 2 can be fixedly used as either the performance device or the tone generator. When the transmitter mode switch is turned on, the transmitter/receiver block 18 is set to the transmitter mode, and when a MIDI data is received via the MIDI data input block 14 from the keyboard (main part) 2, the MIDI data is transmitted via the transmission data output block 17 and the transmitter/receiver block 18 to the remote keyboard 2. On the other hand, when the receiver mode switch is turned on, the transmitter/receiver block 18 is set to the receiver mode, and when MIDI data is received via the transmitter/receiver block 18 and the received data input block 19 from the remote keyboard 2, the MIDI data is delivered via the MIDI data output block 20 to the keyboard (main part) 2.

Next, the operation of the transmitter/receiver 301 will be described in detail with reference to FIG. 3 to FIG. 6. It should be noted that the processings described hereinafter are all executed by the CPU 11, unless, otherwise specified. Further, in these processings, there are used flags enumerated below. When each of the flags the names of which are listed on the lefthand column is set, the transmitter/receiver 301 is in a state corresponding thereto described on the righthand column.

Transmission/reception flag: transmitter mode Automatic changeover mode flag: automatic changeover mode Changeover-permitting flag: state immediately after switched to the automatic changeover mode, or standby state in the automatic changeover mode, after transmission or reception of data is once terminated, and before subsequent transmission or reception starts.

Next, an initialization routine for setting initial operating conditions of the transmitter/receiver block 18 when the power is turned on will be described with reference to FIG. 3. When the power is turned on, the CPU 11 detects settings of the initial setting switch at a step S1. Then, it is determined at a step S2 whether or not the transfer control mode is set to the automatic changeover mode by the initial setting switch. If the automatic changeover mode is set or designated by the initial setting switch, automatic changeover mode-setting processing is carried out at a step S3, followed by the program returning to a main routine. If the answer to the question of the step S2 is negative (NO), it is determined at a step S4 whether or not the transfer control mode is set to the transmitter mode by the initial setting switch. If the transmitter mode is set or designated by the initial setting switch, transmitter mode-setting processing is carried out at a step S5, followed by the program proceeding to the main routine, whereas if the answer to the question of the step S4 is negative (No), receiver mode-setting processing is carried out at a step S6, followed by the program returning to the main routine. In this connection, at the step S1, all settings set by the initial setting switch are detected. In the present embodiment, however, description is made on the mode settings and channel settings as representative of all the settings.

Next, the automatic changeover mode-setting processing will be described with reference to FIG. 4. According to these routines shown in FIG. 4, when the automatic changeover mode switch has been set or designated by the initial setting switch, the transmitter/receiver block 18 is set to the automatic changeover mode.

First, a channel number designated by the initial setting switch is read at a step S11, and the receiving channel control data corresponding to the channel number (i.e. data of a first local oscillation frequency of a receiver block, not shown, of the transmitter/receiver block 18, for the receiver mode) is read from the control data memory block 12 at a step S12. Then, a receiving channel control signal based on the receiving channel control data is delivered via the control signal output block 16 to the transmitter/receiver block 18 at a step S13. In this state, the received data input block 19 enabled to receive the data from the transmitter/receiver block 18, and processing for the received data input interrupt by the received data input block 19, i.e. processing for automatically delivering MIDI data to the keyboard 2 when the MIDI data is received via the transmitter/receiver block 18 and the received data input block 19 from the remote keyboard, in the receiver mode, is permitted, at a step S14.

Further, in this state, the MIDI data input block 14 is also enabled to receive MIDI data, and hence processing for the MIDI data input interrupt by the MIDI data interrupt block 14, i.e. processing for automatically transmitting MIDI data to the remote keyboard 2 when the MIDI data is received via the MIDI data input block 14 from the keyboard, in the transmitter mode, is also permitted, at a step S15.

Further, the transmission/reception flag is reset at a step S16 to set the transmitter/receiver 3 to the receiver mode at a step S16, the automatic changeover mode flag is set at a step S17, and the changeover-permittting flag is set at a step S18. This terminates the automatic changeover mode-setting routine, and the program returns to the main routine.

Figure 5A:
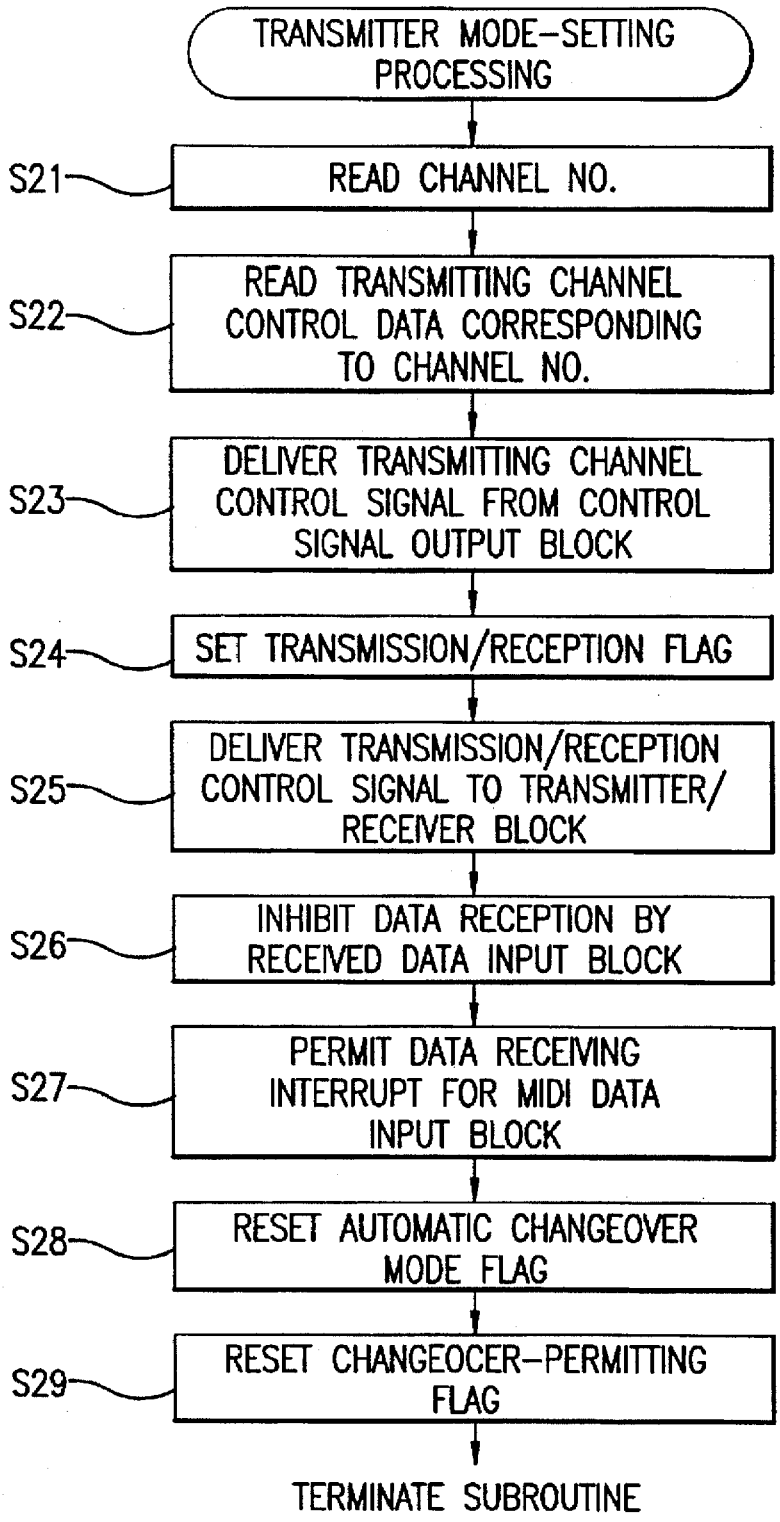
FIG. 5A is a flowchart of trasmitter mode-setting processing executed by the FIG. 2 MIDI data transmitter/receiver.
Figure 5B:
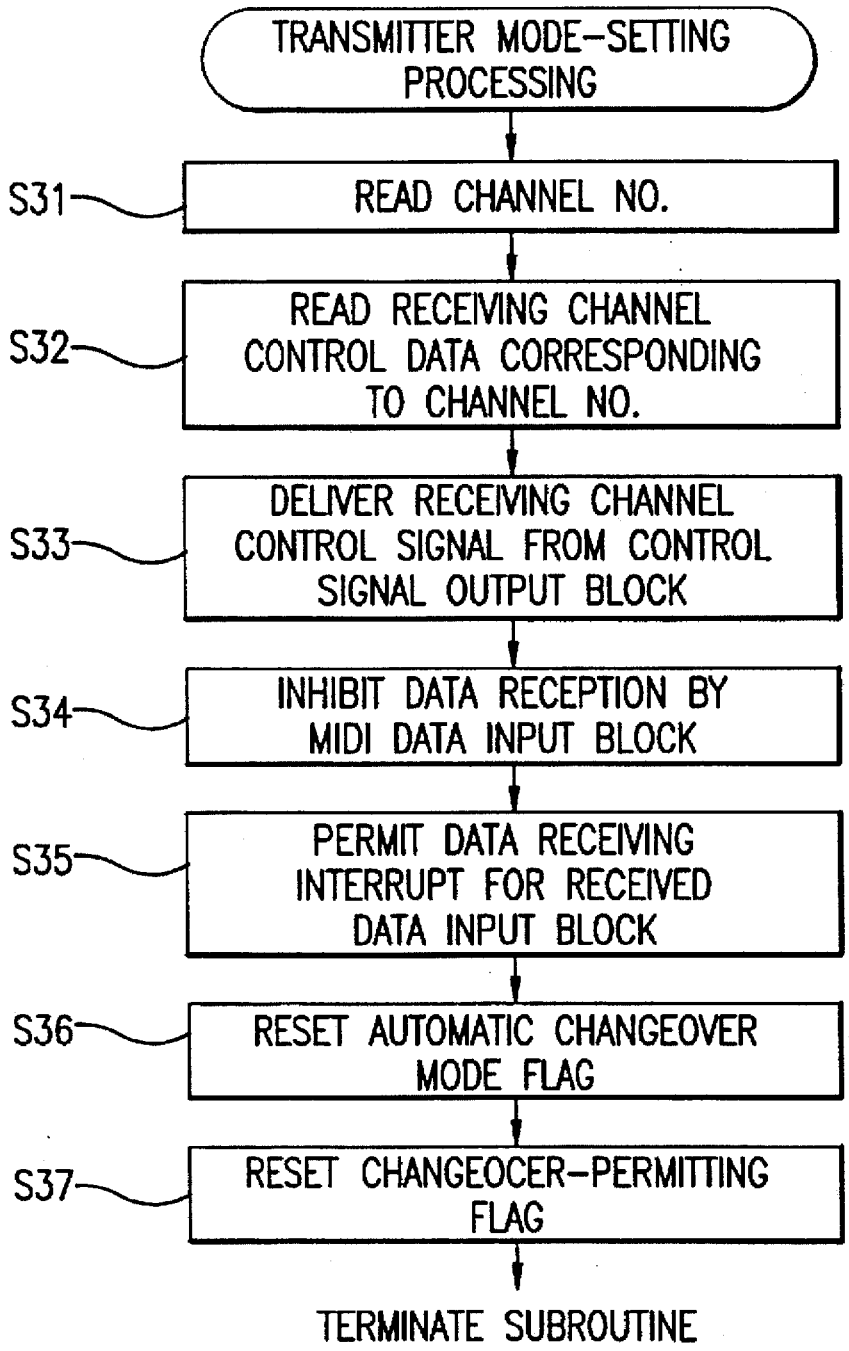
FIG. 5B is a flowchart of receiver mode-setting processing executed by the FIG. 2 MIDI data transmitter/receiver.

Next, transmitter mode-setting processing and the receiver mode-setting processing will be described with reference to FIG. 6A and FIG. 5B, respectively.

Figure 3:
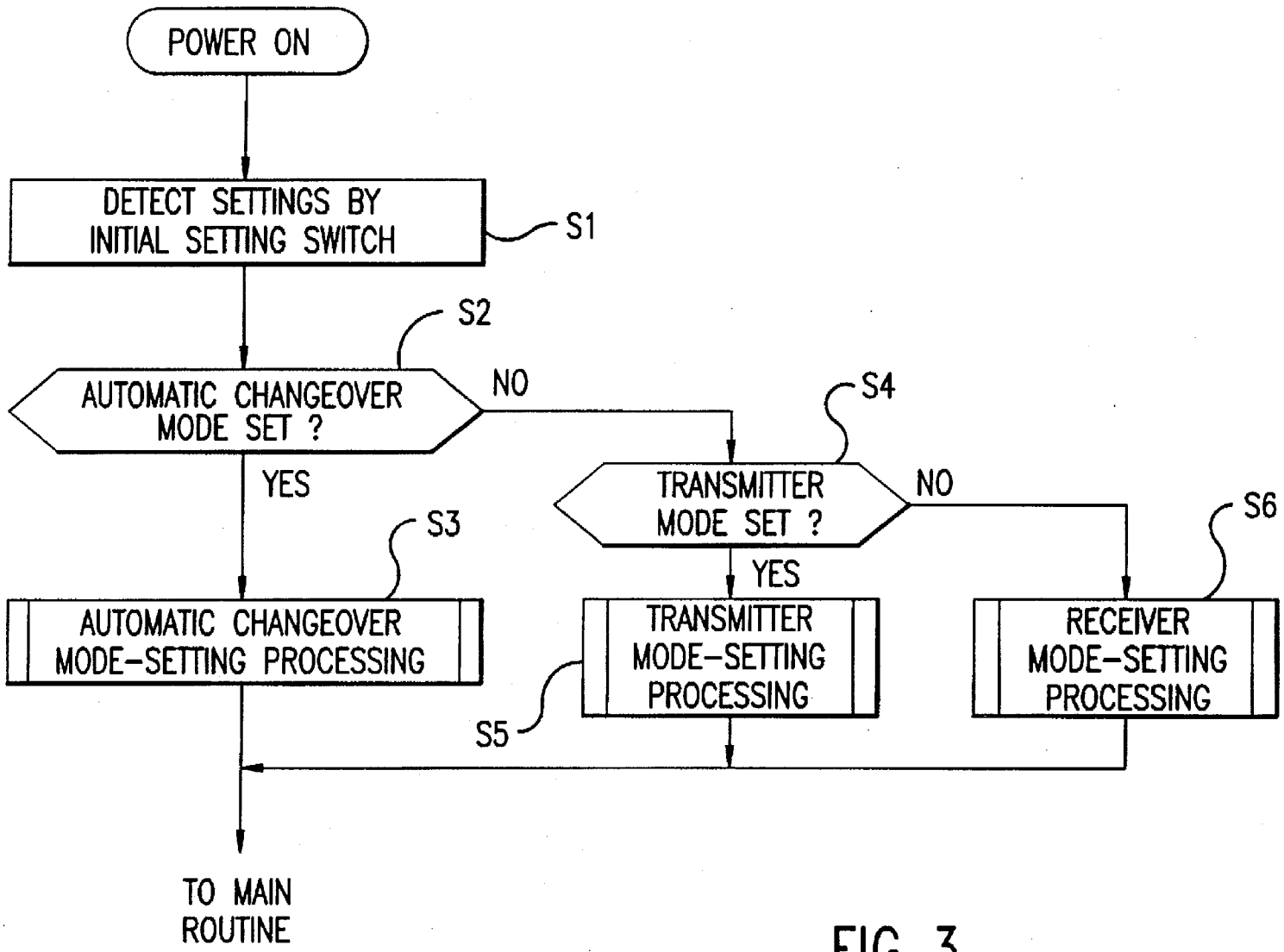
FIG. 3 is a flowchart of initialization processing carried out by the FIG. 2 MIDI data transmitter/receiver.

The transmitter mode-setting processing is carried out at the step S5 of the FIG. 3 program, for setting the transmitter/receiver 301 to the transmitter mode when the transmitter mode is set or designated by the initial setting switch. More specifically, the automatic changeover mode is canceled to set the manual mode, and the CPU 11 executes internal processing to set the transmitter/receiver to the transmitter mode, thereby placing the transmitter/receiver 301 in a predetermiued state e.g. suitable for causing the remote keyboard 2 to generate a tone based on the MIDI data transmitted from the present keyboard 2 incorporating the transmitter/receiver 301.

In this processing, first, the channel number set or designated by the initial setting switch is read at a step S21. Then, the transmitting channel control data corresponding thereto is read from the control data storage block 12 at a step S22. Then, the transmttting channel control signal based on the transmitting channel control data is delivered via the control signal output block 16 to the transmitter/receiver block 18 at a step S23. Then, the transmission/reception flag is set at a step S24, and the transmission/reception control signal (press signal) is delivered at a step S25. Then, the received data input block 19 is inhibited from receiving the MIDI data at a step S26. In this state, the MIDI data input block 14 alone is permitted to receive data, and the MIDI data input interrupt is permitted at a step 927. Then, the automatic changeover mode flag is reset at a step S28, to see the transmitter/receiver to the manual mode, and at the same time the changeover-permitting flag is reset at a step S29, followed by terminating the processing of changeover to the transmitter mode.

Next, the receiver mode-setting processing will be described with reference to FIG. 5B. This processing sets the transmitter/receiver block 18 to the receiver mode, when the receiver mode is set or designated by the initial setting switch. More specifically, the automatic changeover mode is canceled to set the manual mode, and the CPU 11 carries out internal processing to set the transmitter/receiver block 18 to the receiver mode. This processing is carried out e.g. when the keyboard 2 is exclusively used for the tone generator, i.e. for placing the transmitter/receiver in a predetermined state suitable for causing the keyboard 2 directly associated with the transmitter/receiver to give a performance based on the MIDI data received from the other keyboard 2. Further, this processing is distinguished from the transmitter mode-setting processing in that the transmitter/receiver 18 is not set to the transmitter mode, but to the receiver mode, in short, in causing the reception control signal to be delivered from the control signal output block 16.

In this processing, first at a step S31, the channel number set or designated by the initial setting switch is read at a step S31. Then, the receiving channel control data corresponding to the channel number is read from the control data storage block 12 at a step S32. Then, the receiving channel control signal based on the receiving channel control data is delivered via the control signal output block 18 to the transmitter/receiver block 18 at a step S33. Then, the MIDI data input block 14 is inhibited from receiving the MIDI data at a step S34. In this state, the received data input block 19 alone is permitted to receive MIDI data, and the received data input interrupt is permitted at a step S35. Then, the automatic changeover mode flag is reset at a step S36, to set the transmitter/receiver to the manual mode, and at the same time the changeover-permitting flag is reset at a step S37, followed by the program returning to the main routine.

Next, the main routine for controlling the operation of the transmitter/receiver 301 will be described with reference to FIG. 6. The main routine is constantly repeatedly carried out. In this routine, first at a step S41, it is determined whether or not the transmission/reception flag is set. If the transmission/reception flag is set, i.e. if the transmitter mode switch has been turned on, or if the transmitter/receiver 3 is in the transmitter mode while it has been set to the automatic changeover mode, the program proceeds to a step S42, where transmission data output processing for transmitting MIDI data received from the keyboard 2 to the remote keyboard 2 is carried out. If the transmission/reception flag is not set, i.e. if the transmission switch has not been turned on when the transmitter/receiver is in the manual mode, or if the transmission/receiver is not in the transmitter mode when it has been set to the automatic changeover mode, the program proceeding to a step S43, where MIDI data output processing for delivering MIDI received from the remote keyboard 2 to the keyboard 2 is carried out.

After the processing of the step S42 or the step S43 is carried out, it is determined at a step S44 whether or not the automatic changeover mode has been set. When the automatic changeover mode has been set, i.e. if the transmitter/receiver 301 is in the automatic changeover mode, write-in assigner processing for writing data of note-on keys into the assigner 21, with respect to all the MIDI channels, and assigner check processing for determining whether all data within the assigner are equal to "0", are carried out at steps S45 and S46, respectively. Then, the program returns to the step S41 to repeatedly carry out the main routine. If the answer to the question of the step S44 is negative, i.e. if the transmitter/receiver 301 is in the manual mode, the program immediately returns to the step S41, to repeatedly execute the main routine.

The CPU 11 monitors the switch block 13 for inputting of any switch signal corresponding to an item of operating conditions e.g. by the transfer control mode-selecting switch and the channel switch, and changes the initialized settings of channels and the like, based on the inputting of such switch signal.

As described above, according to the present embodiment, the CFU 1 initialize the operating conditions of the transmitter/receiver block when the power is turned on, based on the operating conditions of the transmitter/receiver 18 set by the user or operator with the initial setting switch. Therefore, according to a specific manner of use of the keyboard 2, the user can set initial operating conditions of the transmitter/receiver block as desired, which makes it possible to start transmission of MIDI data immediately after the power is turned on.

Next, a second embodiment of the invention will be described with reference to FIG. 7 and FIG. 8.

This embodiment is distinguished from the first embodiment only in the manner of initialization of the transmitter/receiver block when the power is turned on.

In the present embodiment, the initialization control carried out by the CPU 11 when the power is turned on is based on detected ON/OFF states of switches of the switch block 13, data of initial operating conditions designated by the switch block 13 for setting the operating conditions when the power is turned on, and data of operating conditions stored in a settings-storing block 22, described hereinafter.

Figure 2:
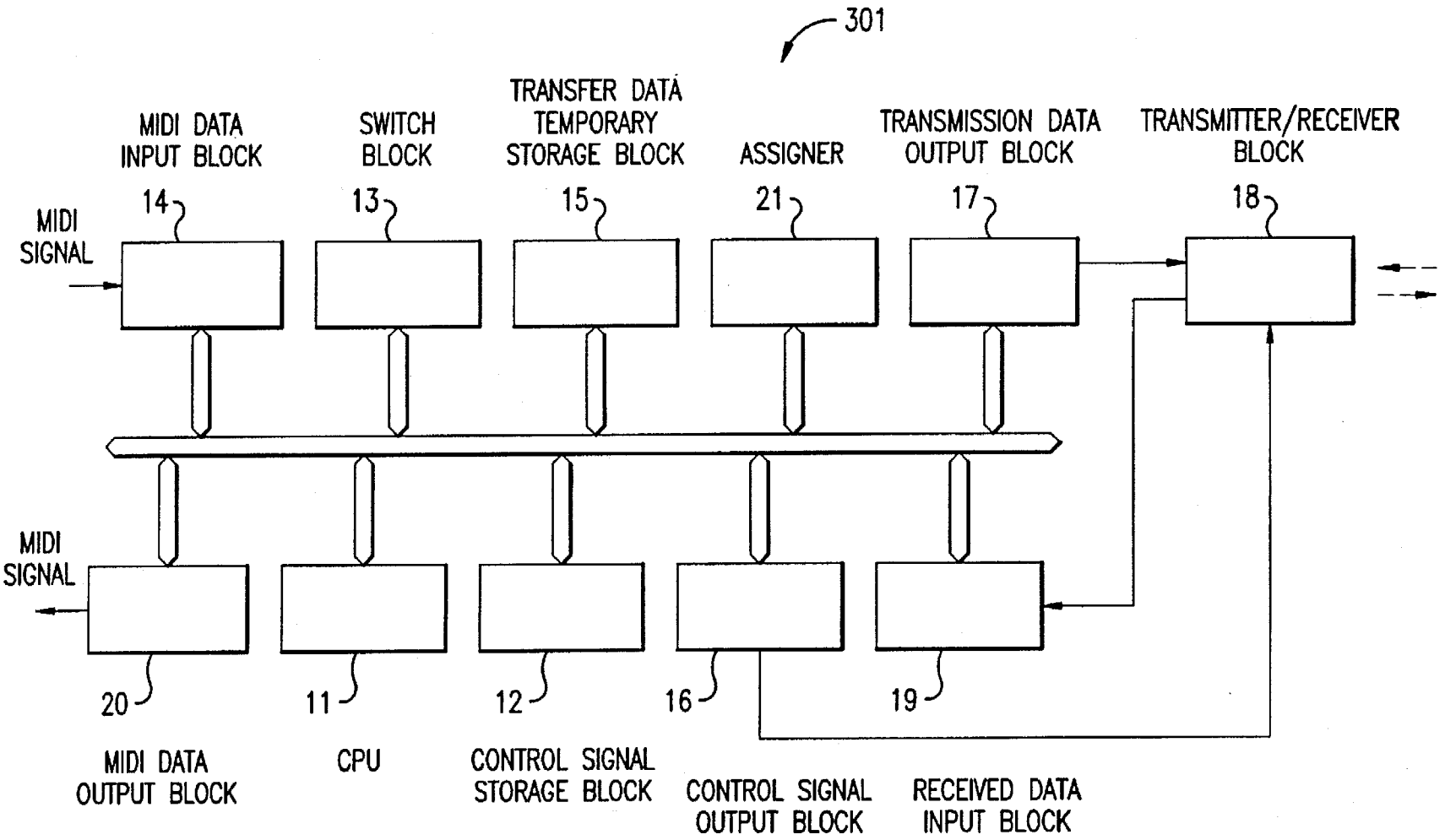
FIG. 2 is a block diagram showing the whole arrangement of one of the MIDI signal transmitter/receivers appearing in FIG. 1.
Figure 7:
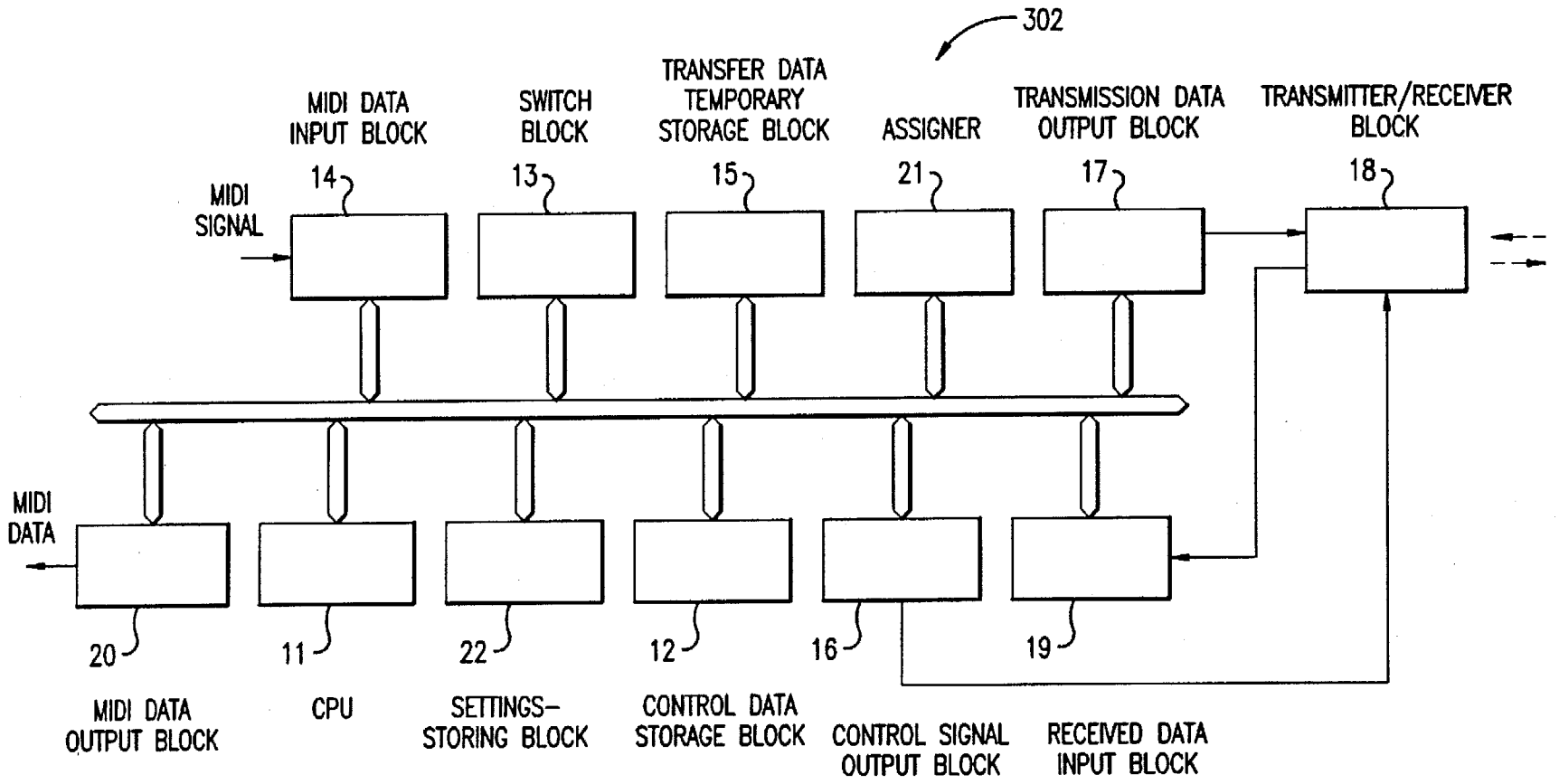
FIG. 7 is a block diagram showing the whole arrangement of a MIDI signal transmitter/receiver according to a second embodiment of the invention.
Figure 8:
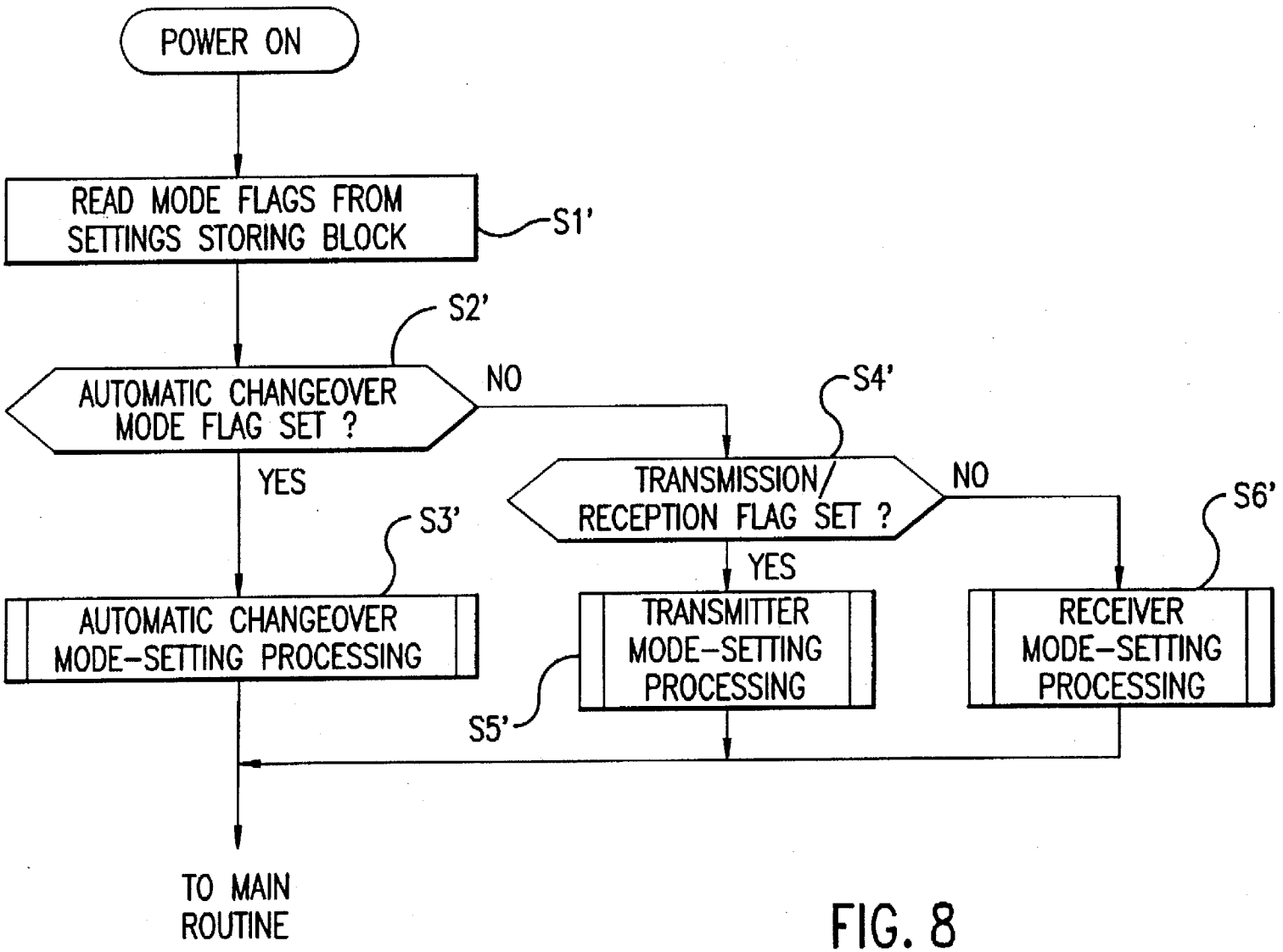
FIG. 8 is a flowchart of initialization processing executed by the FIG. 7 MIDI data transmitter/receiver.

As shown in FIG. 7, the transmitter/receiver of the present embodiment includes the settings-storing block 22 for storing data of the operating conditions, in addition to the component elements of the first embodiment shown in FIG. 2. When contents of storage in the settings-storing block 22 are lost due to failure of the back-up battery of the settings-storing block 22, the CPU 11 detects loss of the contents of storage, and initializes the transmitter/receiver block 18 to the operating conditions designated by the initial setting switch.

The settings-storing block 22 is formed of a RAM and a back-up battery, and holds data written therein even after the power of the transmitter/receiver 302 is turned off. The CPU 11 writes data of operating conditions set by the user by operating the channel switch, the transfer control mode switch, etc. into the settings-storing block 22 at respective predetermined addresses thereof. More specifically, when operating conditions are changed e.g. by the transfer control mode switch, the CPU 11 sets flags corresponding to the changed operating conditions, e.g. the automatic changeover mode flag and the transmission/reception flag, in the internal register, and at the same time writes data of "1" indicative of setting of each flag into the settings-storing block 22 at predetermined addresses for respective items of the operating conditions. On the other hand, when any of the flags are reset, the CPU 11 changes the data of "1" written in the settings-storing block 22 to data of "0". That is, the settings-storing block 22 stores data of the newest operating conditions changed by the user.

As described above, the transmitter/receiver of the present embodiment operates in the same manner as the first embodiment except for the initialization thereof.

An initialization routine for initializing the transmitter/receiver 301 when the power is turned on will be described with reference to FIG. 8. When the power is turned on, the CPU 11 reads the mode flags (corresponding to data of operating conditions) stored in the settings-storing block 22 at a step S1'. When the data of operating conditions are not stored, or only part thereof is stored, data of initial operating conditions designated by the initial setting switch is read for the operating conditions or part thereof. That is, data of operating conditions stored in the settings-storing block is read and used in preference to data of initial operating conditions set by the initial setting switch. Next, it is determined at a step S2' whether or not the automatic changeover mode is designated in the data of operating conditions indicative of the transfer control mode. If the answer to the question of the step S2' is negative (No), it is determined at a step S4' whether or not the transfer control mode is set to the transmitter mode (i.e. the transmission/reception flag is set). If the transmitter mode is designated, the transmitter mode-setting processing is carried out at a step S5', followed by the program proceeding to the main routine, whereas if the answer to the question of the step S4' is negative (No), the receiver mode-setting processing is carried out at a step S6', followed by the program returning to the main routine. In this connection, at the step S1', data of all operating conditions and data of the initial operating conditions are read out, and the operating conditions are set based on the data of the operating conditions. In the present embodiment, however, description is made on the mode settings and the channel settings as representative of all the settings.

Figure 4:
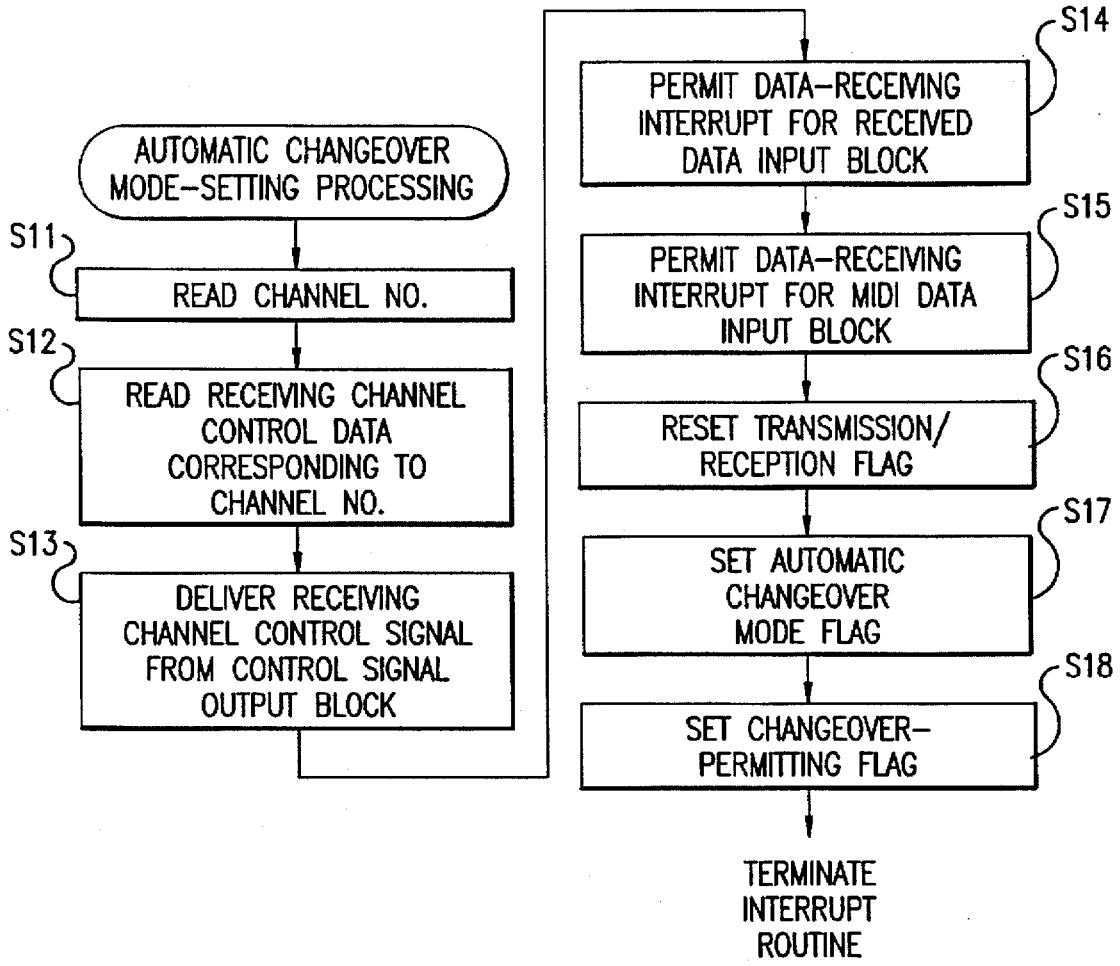
FIG. 4 is a flowchart of automatic changeover mode-setting processing executed by the FIG. 2 MIDI data transmitter/receiver.

The automatic changeover mode-setting routine is identical to that of the first embodiment shown in FIG. 4 except for the following point:

In the present embodiment, at the step S11 of FIG. 4, the channel number to be read out is designated by the data of the operating conditions.

Further, although the transmission/reception flag reset at the step S16 is usually already set to the receiver mode in the present embodiment, the transmission/reception flag has been set, when the transmitter mode had been set before the power was turned off.

Further, when the program returns to the main routine after terminating the automatic changeover mode-setting routine, results of setting and resetting of the flags are written into the settings-storing block 22 as data of the operating conditions. The same step is carried out for the other processings, whereby data of operating conditions is written in when each flag is set or reset.

The transmitter mode-setting processing and the receiver mode-setting processing are carried out at the steps S5' and S6', respectively, in the present embodiment. More specifically, the transmitter mode-setting processing sets the transmitter/receiver 302 to the transmitter mode when data of the operating conditions designates setting of the transmitter mode, whereas the receiver mode-setting processing sets the transmitter/receiver block 18 to the receiver mode when data of the operating conditions designates setting of the receiver mode. That is, these processings are carried out in the same manner as described in the first embodiment with reference to FIG. 5A and FIG. 5B.

Figure 6:
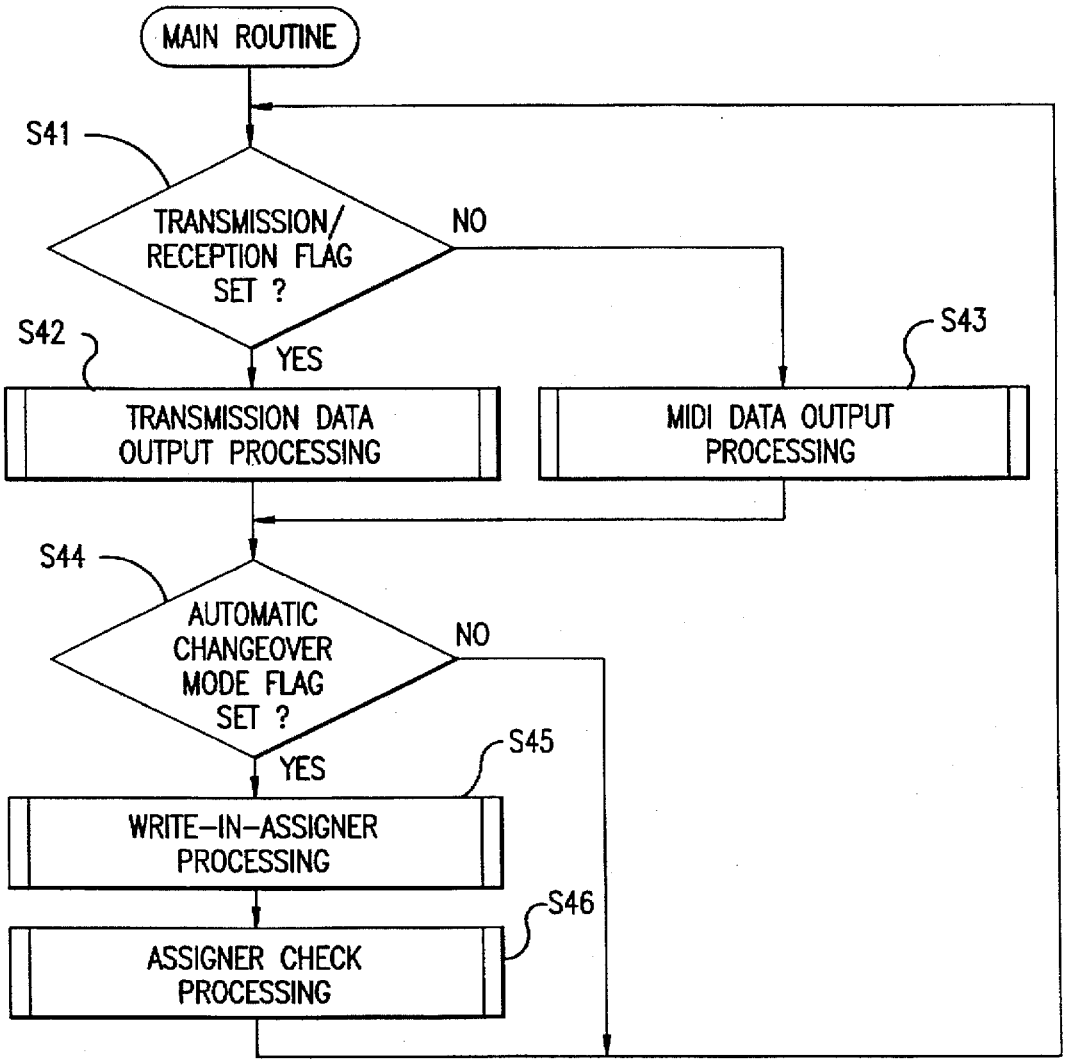
FIG. 6 is a flowchart of a main routine executed by the FIG. 6 MIDI data transmitter/receiver.

Further, the main routine is also carried as described in the first embodiment with reference to FIG. 6.

Further, in the present embodiment, the CPU 11 monitors inputting of switch signals corresponding to items of operating conditions through operation of the transfer control mode-selecting switch, the channel switch, etc., and writes data of operating conditions thus changed into the settings-storing block 22. In doing this, when the data of operating conditions corresponding to the changed data already exists, the latter is overwritten by the former, although not particularly restricted thereto. Further, if it is necessary to keep the existing data of operating conditions e.g. for storing the written data of operating conditions as history data, the area of the settings-storing block 22 may be divided into groups for each item of the operating conditions, whereby whenever data of operating conditions changed is prepared, it is written into an address different from the address of the existing data, and the data of operating conditions entered last is read out for use.

As described above, according to the present embodiment, the user is capable of setting initial operating conditions to operating conditions established before the power was turned off, when the power is turned on, which enables the user to start transmission of the MIDI data by the transmitter/receiver block 18 immediately after the power is turned on. Further, by the use of the initial setting switch, the user is capable of setting initial operating conditions as desired when the power is first turned on.

Further, although in the present embodiment, a RAM is used as the memory of the settings-storing block 22, this is not limitative, but an EEPROM (Electrically Erasable Programmable ROM) may be used instead. In this case, the back-up battery can be dispensed with.

Figure 10:
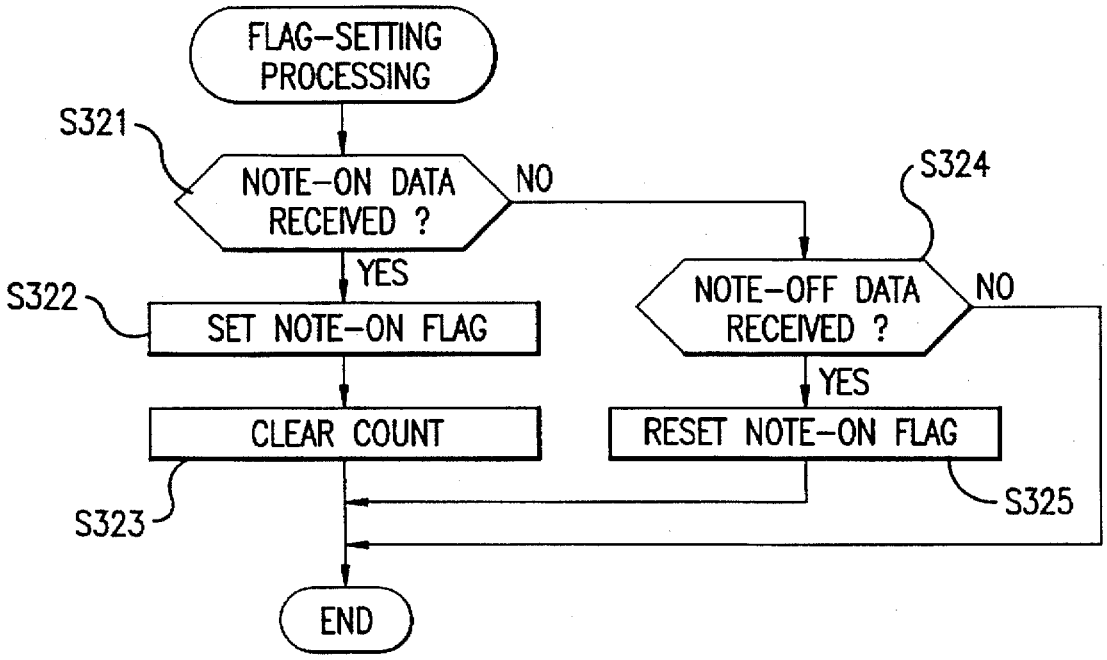
FIG. 10 is a flowchart of flag-setting processing executed by the FIG. 9 MIDI data processor according to the third embodiment.
Figure 11:
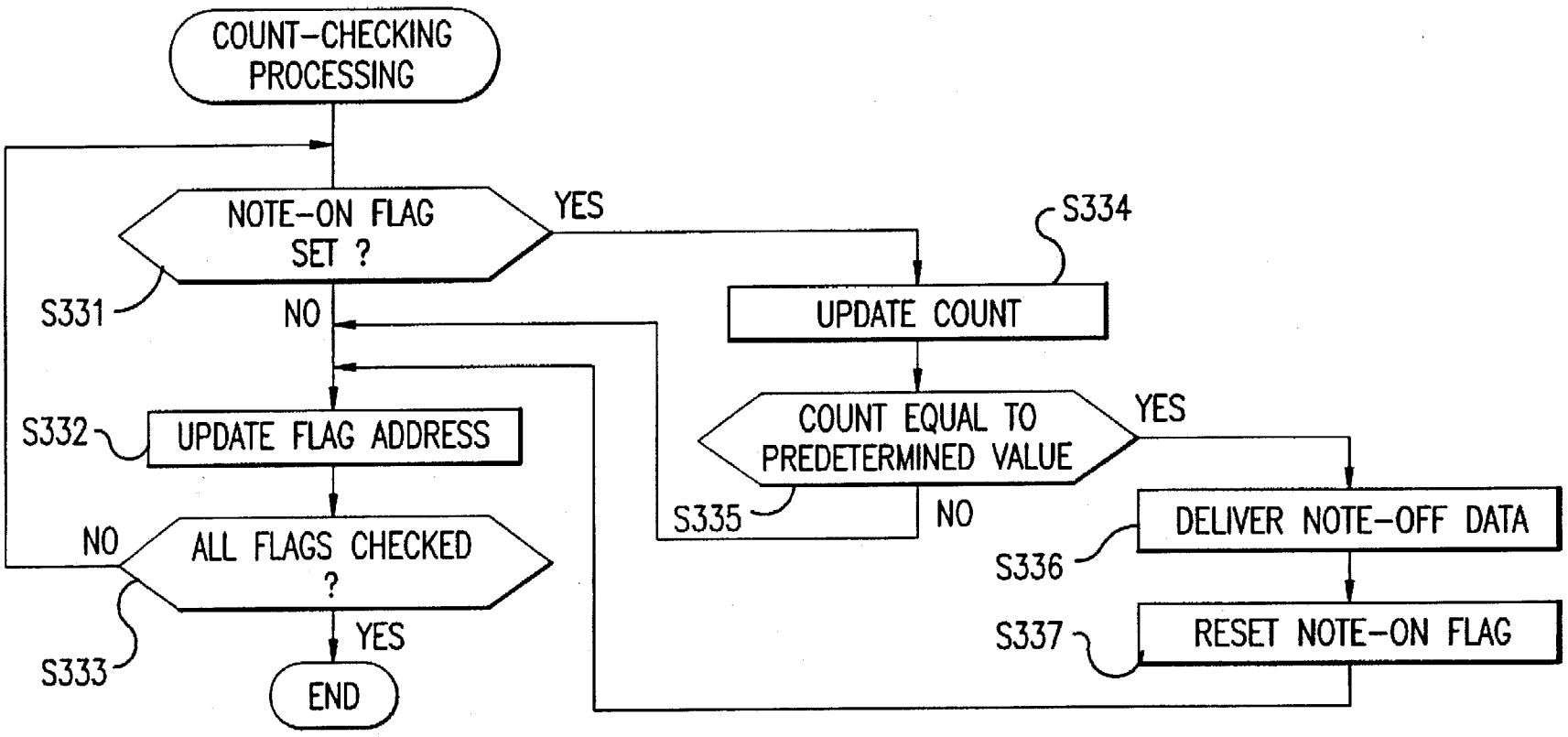
FIG. 11 is a flowchart of count-checking processing executed by the FIG. 9 MIDI data processor according to the third embodiment.

Next, a MIDI data processor according to a third embodiment of the invention will be described with reference to FIG. 9 to FIG. 11.

Figure 9:
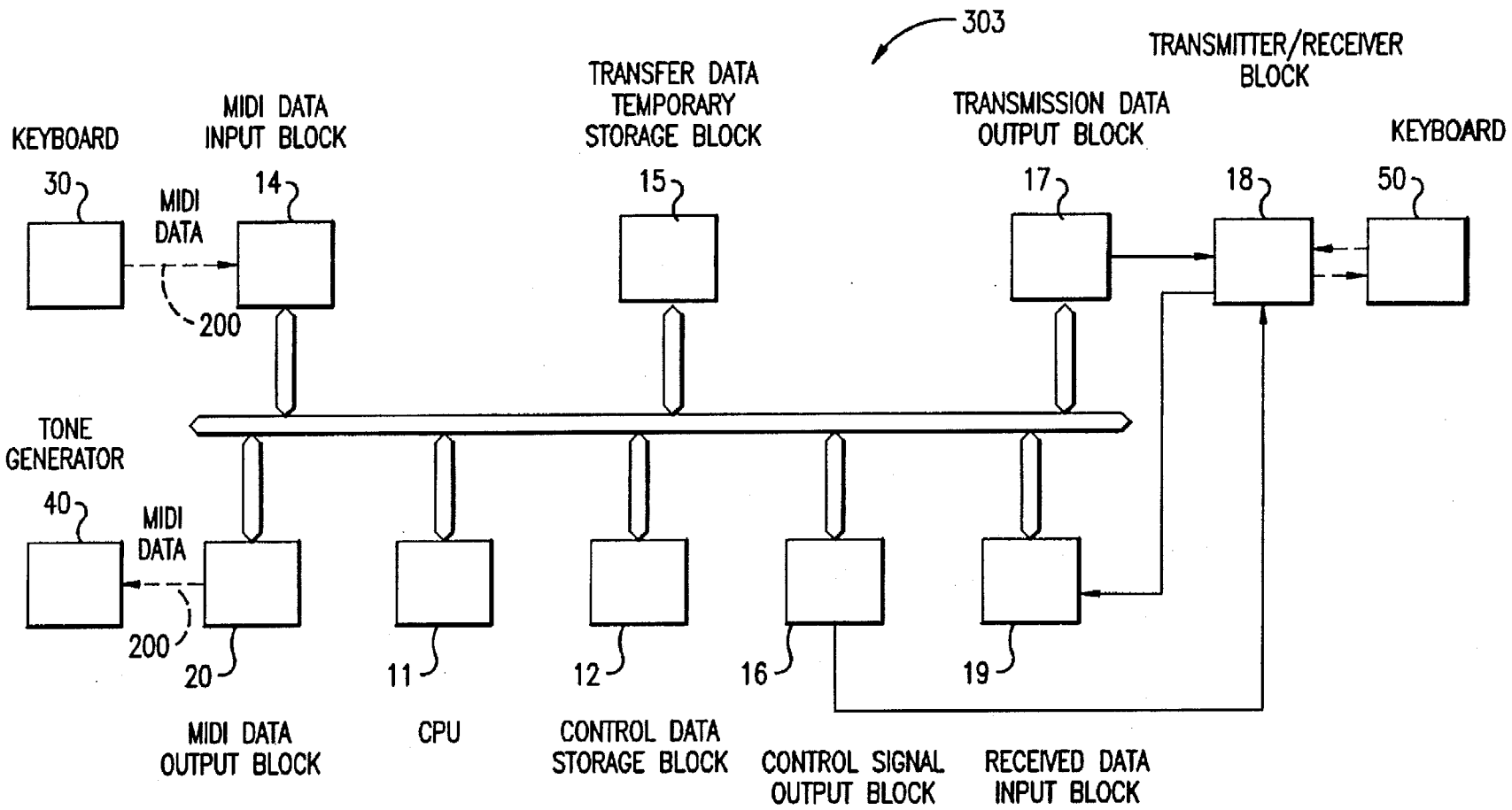
FIG. 9 is a block diagram showing the whole arrangement of a MIDI data processor according to a third embodiment of the invention.

FIG. 9 shows the arrangement of the MIDI data processor (hereinafter referred to as "the processor") according to the present embodiment. The arrangement shown in FIG. 9 is distinguished from the FIG. 2 arrangement of the first embodiment in that keyboards 300, 500 and a tone generator 400 are additionally explicitly shown, and several other component elements are omitted. That is, connected to the processor 303 are the keyboard 300 and the tone generator 400 via MIDI cables 200, and the remote keyboard 500 by way of a radio circuit. The keyboards 300, 500 deliver or transmit MIDI data, such as note-on data or note-off data, corresponding to a note number, in response to a note-operation or a note-off operation, to the processor 303. The tone generator 400 generates a tone corresponding to MIDI data delivered from either of the keyboards 300, 500 via the processor 303.

Next an outline of the processor 303 will be described with reference to FIG. 9. As shown therein, the processor 303 is comprised of the CPU 11, the control data storage block 12, the MIDI data input block 14, the transfer data temporary storage block 15, the control signal output block 16, the transmission data output block 17, the transmitter/receiver block 18, the received data input block 19, and the MIDI data output block 20.

Next, an outline of the operation of the processor 303 will be described. The processor 303 is capable of transmitting and receiving MIDI data. More specifically, the processor 303 transmits MIDI data delivered from the keyboard 300 to the remote keyboard 500 which serves as a tone generator via the transmitter/receiver block 18, or conversely, receives MIDI data transmitted from the remote keyboard 500 by the transmitter/receiver block 18 and delivers the received MIDI data to the tone generator 400. In the present embodiment, description will be made on an example of controlling generation of tones by the tone generator 400 based on MIDI data transmitted from the remote keyboard 500.

Next, the arrangement of the processor 303 will be described in detail.

The CPU 11 controls the overall operation of the processor 303, e.g. input control of MIDI data from the keyboard 300, output control of MIDI data to the tone generator 400, transmission/reception changeover control and channel changeover control of the transmitter/receiver block 18. Further, the CPU 11 is internally equipped with note-on flags corresponding to respective note numbers of all possible note-on data for 16 channels delivered by the keyboard 300, and counters corresponding to the note-on flags, respectively. Then, the CPU 11 operates to set a note-on flag corresponding to a note number of a channel when note-on data of the note number is delivered via the channel from the keyboard 500, and at the same time start a counter corresponding to the note number. When note-off data corresponding to the note number in the channel is delivered from the keyboard 500, the note-on flag is reset. On the other hand, when the count of the counter reaches a predetermined value, the note-off data corresponding to the note number is generated and delivered to the tone generator 400.

The control data storage block 12, the MIDI data input block 14, the control signal output block 16, the transmission data output block 17 and the received data input block 19 have the same functions as the corresponding ones of the first embodiment, and hence detailed description thereof is omitted.

The transfer data temporary storage block 15 is formed by a so-called FIFO (First-in First-out) memory, and temporarily stores therein MIDI data received via the MIDI data input block 14 from the keyboard 300, and MIDI data received from the remote keyboard 500 via the transmitter/receiver block 18. The MIDI data received from the keyboard 300 and written in the transfer data temporary storage block 15 is read by the CPU 11 in the written order, and transmitted via the transmitter/receiver block 18 as a radio signal to the remote keyboard 500. On the other hand, the MIDI data received from the remote keyboard 500 and written into the transfer data temporary storage block 15 is also sequentially read by the CPU 11 and delivered via the MIDI data output block 20 to the tone generator 400.

The transmitter/receiver block 18 is an FM transmitter/receiver, though not particularly limited thereto, which is comprised of a transmitter block for transmitting a radio signal and a receiver block for receiving a radio signal, with a transmitting/receiving frequency band of 430 MHz, a transmission output power of 10 mW, and 40 transmitting/receiving channels. The transmitter block generates the radio signal by modulating a high-frequency signal (carrier signal) with the MIDI data received via the MIDI data input block 14 and transmits the resulting radio signal via the antenna, not shown. The receiver block receives the radio signal via the antenna 4 from the remote keyboard 500, and demodulates the radio signal into the MIDI data to deliver the same to the received data input block 19.

The MIDI data output block 20 converts a MIDI data in a parallel form delivered from the CPU 11 into a MIDI data in a serial form, and delivers the same to the tone generator 400.

Next, determination of the note-on data and generation of the note-off data by the processor 303 will be described. The same processing is carried out on MIDI data in each channel, and hence description will be made on one channel.

First, an outline of the operation is as follows: When a note-on operation is carried out in the remote keyboard 500, MIDI data in a serial form indicative of the note-on operation and a note number is input via the transmitter/receiver block 18 by the radio signal into the received data input block 19. The received data input block converts the MIDI data in the serial form into MIDI data in a parallel form and then delivers the resulting data to the CPU 11. Upon receiving the data, the CPU 11 causes the data to be stored into the transfer data temporary storage block 15 and at the same time determines whether the MIDI data is note-on data or note-off data.

The CPU 11 carries out flag-setting processing, described hereinafter, when the MIDI data is determined to be note-on data, and then reads out the MIDI data stored in the transfer data temporary storage block 15 to deliver the same to the MIDI data output block 20. The MIDI data output block 20 converts the MIDI data input in the parallel form into MIDI data in the serial form and delivers the resulting data to the tone generator 400, which generates a sound corresponding to the note-on data.

The CPU 11 carries out the same processing on the MIDI data delivered successively from the keyboard 300.

On the other hand, if the CPU 11 determines that the MIDI data from the remoter keyboard 500 is note-off data, the note-on flag is reset when note-off data corresponding to the note number for which the note-on flag has already been set has been received, and the note-off data is delivered via the MIDI data output block 20 to the tone generator 400. Further, the CPU 11 carries out the count-checking processing described hereinafter. According to this processing, even if the note-off data of the note number for which the note-on flag has already been set is not received from the keyboard 500, the CPU 11 delivers the note-off data corresponding to the note number via the MIDI data output block 20 to the tone generator 400 to stop generating the tone of the note number, when a predetermined time period has elapsed after the note-on data was received.

Next, the flag-setting processing and the count-checking processing mentioned above will be described in detail with reference to FIG. 10 and FIG. 11.

First, the flag-setting processing will be described. According to this processing, it is determined whether or note MIDI data received is note-on data, and when the MIDI data is determined to be note-on data, the counter corresponding thereto is started for measuring time. Referring to FIG. 10, first at a step S321, it is determined whether or not the MIDI data is note-on data. If the answer to the question of the step S321 is affirmative (Yes), the program proceeds to a step S322, where the note-on flag is set, and then at a step S323, the count of a correspondent counter is cleared, followed by terminating the routine.

If the answer to the question of the step S321 is negative (No), the program proceeds to a step S324, where it is determined whether or not the MIDI data is note-off data. If the answer to this question is negative (No), the routine is immediately terminated, whereas if it is affirmative (Yes), the note-on flag is reset at a step S325, followed by terminating the program.

Next, the count-checking processing will be described with reference to FIG. 11. In this processing, the count of the counter started in the flag-setting routine is updated, and determination is made as to whether the count becomes equal to a predetermined value. This processing is carried out by timer interrupt. Referring to FIG. 11, first at a step S331, it is determined whether or not a note-on flag corresponding to Note number 1 has been set. If the answer to this question is negative (No), the count-checking on this note number is terminated, and then at a step S332, the note-on flag address is updated from 1 to 2 to determine whether or not a note flag corresponding to the next note number (Note number 2) has been set.

If the answer to the question of the step S331 becomes affirmative (Yes), the count corresponding to the note number is updated at a step S334. Then, it is determined at a step S335 whether or not the count has reached a predetermined value. If the answer to the question of the step S335 is negative (NO), the flag address is updated at the step S332.

If the answer to the question of the step S335 is affirmative (Yes), it is determined that a communication error has prevented reception of note-off data corresponding to the present note number, and note-off data corresponding thereto is generated and delivered via the MIDI data output block 20 to the tone generator, at a step S336. This makes it possible to cause the tone generator 400 to stop generating the tone. At the same time, the note-on flag corresponding to the note number is reset at a step S337, followed by updating the note-on flag address at the step S332.

After the note-on flag address is updated at the step S332, it is determined at a step S333 whether or not a state of a note-on flag and the count of a counter therefor have been checked as to all the note numbers. If the answer to this question is negative (No), the program returns to the step S331, whereas if the answer is affirmative (Yes), the present routine is terminated. The count-checking processing is constantly repeatedly carried out, and if all the counts of the counters have been checked, this processing is repeated again.

As described above, according to the present embodiment, the CPU 11 determines whether or not the MIDI data input is note-on data. If it is determined to be note-on data, a note-on flag corresponding to a note number thereof is set, and a counter therefor is started. When the count or the counter reaches a predetermined value, the CPU 11 generates and delivers note-off data to the tone generator 400. Therefore, even when note-off data cannot be received properly due to abnormality of a communication line, it is possible to stop endless tone generation by the tone generator 400. Further, since counters are provided which correspond to all the note numbers, respectively, even when a large amount of note-on data is received at a time from the remote keyboard 500, it is possible to immediately start counters for the data. This reduces the time before the counter is started. Further, it is possible to accurately stop endless tone generation on each of the all the note numbers.

Further, although in the present embodiment, description is made on an example of use of the radio line, this is not limitative, but the present invention can be applied to a case of a keyboard and a tone generator being connected by a MIDI cable, and like cases.

Further, although in the present embodiment, description is made on a case of use of note-on flags, this is not limitative, but note numbers of note-on data received may be stored into a RAM. Further, although in the present embodiment, description is made on an example of counting is carried out by software through utilization of internal counters of the CPU 11, this is not limitative, but a timer circuit or the like may be used to carry out counting by hardware.

Further, the number of counters may be smaller than the number of note numbers. That is, counters may be provided in a number equal to the maximum number of notes for which corresponding tones are to be generated at a time, and when received MIDI data is determined to be note-on data, a counter uhich is not in operation may be started in a manner corresponding to the note number of the note-on data for each occasion. In this case, the reduction of the number of counters leads to reduction of manufacturing costs.

Next, a MIDI data receiver/transmitter (hereinafter referred to as "the transmitter/receiver") 304 will be described with reference to FIG. 12 to FIG. 14.

Figure 12:
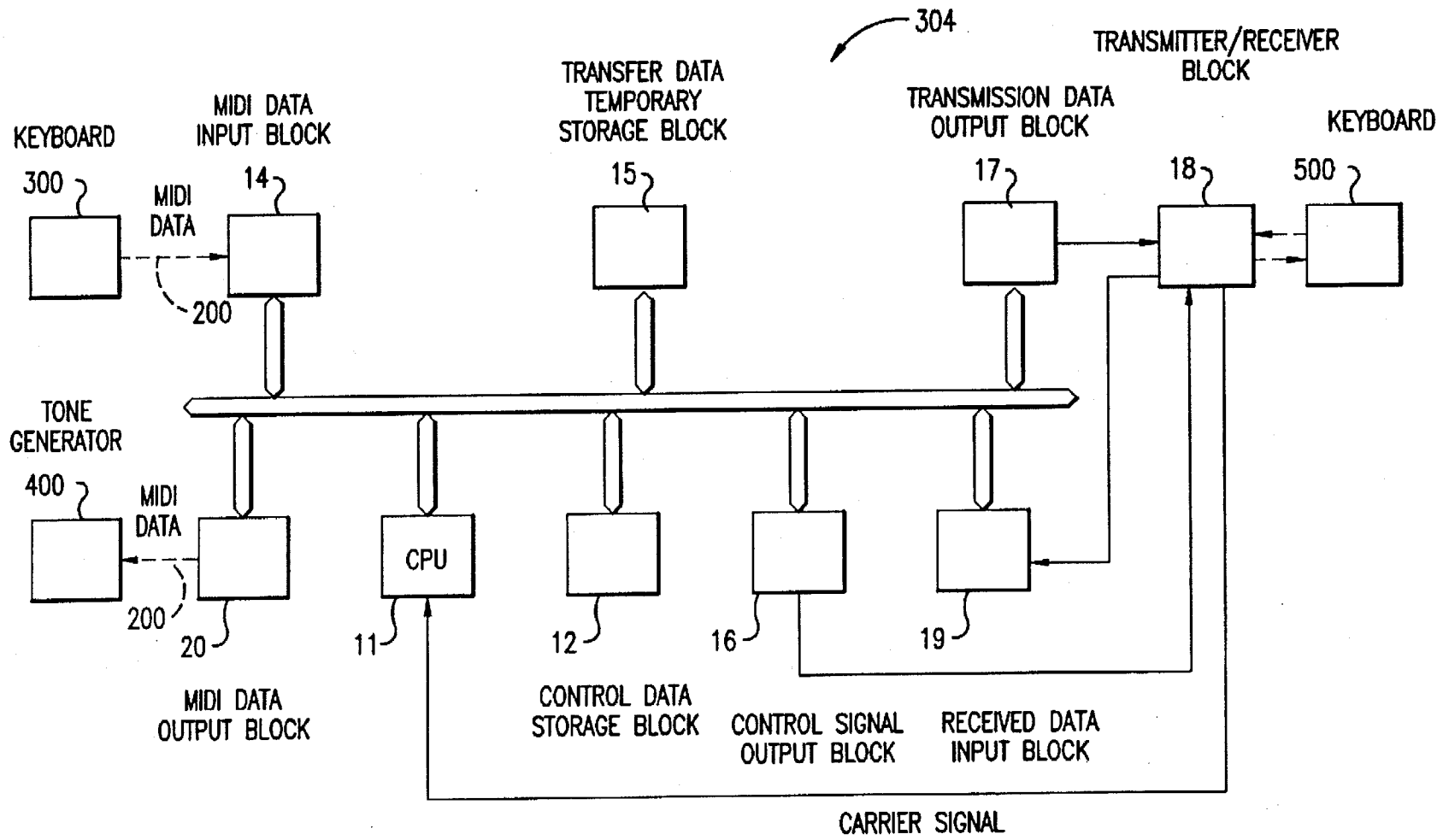
FIG. 12 is a block diagram showing the whole arrangement of a MIDI data transmitter/receiver according to a fourth embodiment of the invention.

FIG. 12 shows the arrangement of the transmitter/receiver 304. As is clear from FIG. 12, the arrangement of the transmitter/receiver 304 of the present embodiment is distinguished from the FIG. 9 arrangement of the third embodiment in that a carrier signal is delivered from the transmitter/receiver block 18 to the CPU 11.

In this embodiment, the CPU 11 for control of overall operations of the transmitter/receiver 304 specifically carries out input control of the MIDI data from the keyboard 300, output control of the MIDI data to the tone generator 400, as well as starting/terminating control of data transmission and reception, transmission/reception changeover control, channel control, of the transmitter/receiver block 18 and so on. Further, a counter is internally provided which measures a time having elapsed from the start of transmission or a time point of detection of the carrier signal, referred to hereinafter. When the counter counts up a predetermined number (predetermined time period), the CPU 11 causes MIDI data to be transmitted or delivered to the tone generator 400.

The control data storage block 12, the MIDI data input block 14, the transfer data temporary storage block 15, the control signal output block 16, the transmission data output block 17, and the MIDI data output block 20 have the same functions as described in the third embodiment, and hence detailed description thereof is omitted.

The received data input block 18 converts the MIDI data in a serial form received from the transmitter/receiver block 18 into MIDI data in a parallel form.

Next, the arrangement of the transmitter/receiver block 18 will be described with reference to FIG. 13.

The transmitter/receiver block 18 is an FM transmitter/receiver having a transmitting/receiving frequency band of 430 MHz, a transmitting output power of 10 mw, and 40 channels of transmitting/receiving channels. As shown in the figure, the transmitter/receiver block 18 is comprised of the antenna 4, a low-pass filter 31, an antenna switch 32, a receiver block 33, a transmitter block 34, and a first local oscillator 35.

The low-pass filter 31 prevents interference waves from being received in the receiver mode, and prevents unwanted waves from being transmitted in the transmitter mode. The antenna switch 32 changes over between the use of the antenna 4 in the receiver mode and that of the antenna 4 in the transmitter mode. That is, the antenna 4 is selectively connected via the low-pass filter 31 and the antenna switch 32 to the receiver block 33 in the receiver mode, and to the transmitter block 34 in the transmitter mode.

The receiver block 33 is comprised of a receiver RF amplifier 36, a first mixer 37, a first IF filter 38, a first IF amplifier 39, a receiver IC 40, a low-pass filter 41, and a comparator 42. The receiver RF amplifier 36 amplifies the received radio signal by a predetermined gain. The first mixer 37 generates a intermediate-frequency signal (IF signal) by mixing the radio signal and a first local oscillation signal generated by a VCO (Voltage Controlled Oscillator) 44, referred to hereinafter. The first IF filter 38 is formed by a crystal filter which enhances selectivity of the receiver IF circuit. The first IF amplifier 39 amplifies the IF signal by a predetermined gain. The receiver IC 40 enhances the selectivity of the IF circuit by the use of a second IF filter incorporated therein, and after amplifying the IF signal by an amplifier incorporated therein, mixes a second local oscillation signal generated by a second local oscillator incorporated therein with the IF signal to thereby demodulate the IF signal into a low-frequency signal by quadrature detection. Further, the receiver IC 40 delivers the carrier signal as a result of detection of the IF signal to the CPU 11. The low-pass filter 41 filters the low-frequency signal delivered from the receiver IC 40, and the comparator 42 shapes the low-frequency signal filtered by the low-pass filter 41 into MIDI data.

The transmitter block 34 is comprised of a low-pass filter 43 for limiting a frequency band of the MIDI data as a transmitting data signal delivered from the transmission data output block 17 in FIG. 2, the VCO 44 which forms part of the first local oscillator 35 and serves a modulating block, and a transmitter RF amplifier 45 which amplifies the radio signal prepared by modulation by the VCO 44.

The first local oscillator 35 is commonly used as a channel oscillator by the receiver block 33 and the transmitter block 34, and is comprised of the aforementioned VCO 44, an PLL (Phase Locked LOOp) IC 46 for controlling oscillation of the VCO 44, and a loop filter 47 for smoothing oscillation control voltage delivered from the PLL IC 46. The PLL IC 46 causes the VCO 44 to oscillator at a channel frequency selected for transmission and reception, based on the transmitting channel control signal and the receiving channel control signal, delivered from the control signal output block 16.

Next, the operation of the transmitter/receiver 304 will be described.

First, the operation of the transmitter/receiver 304 as the transmitter will be described. The CPU 11, when on standby, checks for inputting of the MIDI data from the keyboard 300 via the MIDI data input block 14. When the MIDI data is delivered, the CPU 11 causes the MIDI data to be stored into the transfer data temporary storage block 15, and then causes the control signal output block 16 to deliver a transmission control signal (press signal, and transmission start signal) to the transmitter/receiver block 18, thereby settting the transmitter/receiver block to the transmitter mode. Further, the CPU 11 delivers data other than MIDI data, e.g. dummy data formed of repetition of "1" and "0" as shown at the top level in FIG. 14, to the transmitter/receiver block 18 via the transmission data output block 17.

The VCO 44 of the transmitter/receiver block 18 delivers a first local oscillation signal modulated by the dummy data received via the low-pass filter 43 to the transmitter RF amplifier 45, which amplifies the received signal as the radio signal by a predetermined gain and transmits the resulting signal via the antenna 4.

Figure 14:
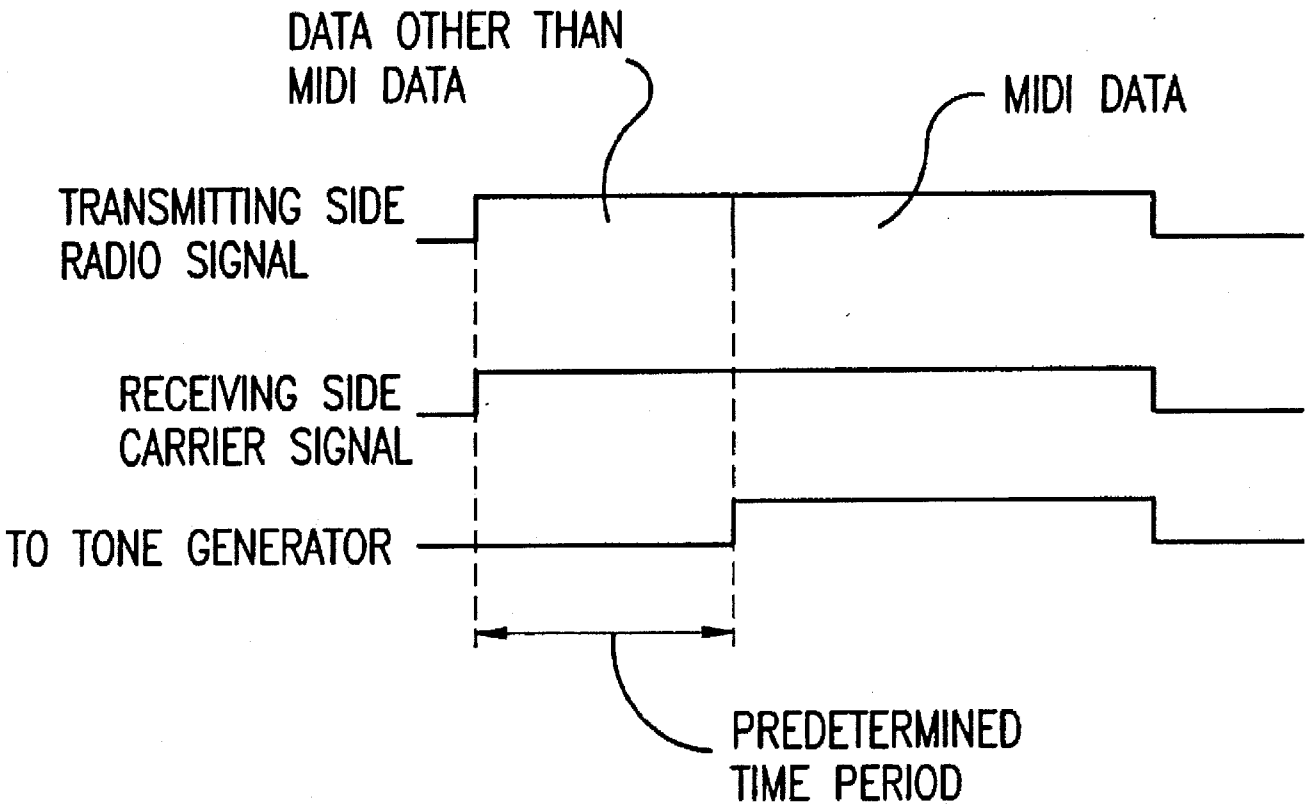
FIG. 14 is a timing chart showing operations of transmission of a radio signal from a transmitter side, delivery of a carrier detection signal on a receiver side and delivery of received data to a MIDI instrument.

On the other hand, the CPU 11 starts counting by the internal counter from a time point of delivery of the transmission control signal, and when the count reaches the predetermined value (corresponding to the predetermined time period), the delivery of the dummy data is stopped, and as shown at the top level of FIG. 14, the MIDI data stored in the transfer data temporary storage block 15 is delivered from the transmission data output block 17 to the transmitter/receiver block 18. Then, the VCO 44 delivers the first local oscillation signal modulated by the MIDI data to the transmitter RF amplifier 45. The transmitter RF amplifier 45 amplifies the signal by a predetermined gain, and then transmits the resulting radio signal via the antenna 4. Then, when all the MIBI data has been transmitted, the CPU 11 turns off the transmission control signal to terminate transmission.

Next, the operation of the transmitter/receiver 304 as the receiver will be described. The CPU 11, when on standby, checks for inputting of the carrier signal from the transmitter/receiver block 18. When the carrier signal is input (as indicated by a rise of the carrier signal shown at the medium level of FIG. 14), the CPU 11 causes the data received via the transmitter/receiver block 18 and the received data input block 17 to be stored into the transfer data temporary storage block 15, and synchronously with inputting of the data starts the internal counter. When the count of the internal counter reaches a predetermined value, the CPU 11 determines that the transmission of the dummy data has been terminated on the transmitter side, and regards data received thereafter as MIDI data, thereby delivering the received data via the MIDI data output block 19 to the tone generator 400, as shown at the bottom level of FIG. 4. Before the count of the counter reaches the predetermined value, the CPU 11 carries out determination as to whether the received data stored in the transfer data temporary storage block 14 is dummy data or control data. If the received data is determined to be control data, a predetermined control operation is carried out based on the control data.

As described above, according to the present embodiment, the transmitter/receiver 304 is capable of transmitting the MIDI data and data other than the MIDI data, such as control data, by the use of the same carrier. Further, since it is possible to distinguish the MIDI data from the other data without adding any specific identifier, the data other than the MIDI data can be prevented from being supplied to the tone generator, on the receiver side. Further, it is not necessary for the CPU 11 to carry out a constant determination as to whether the received data is MIDI data or not, which obviates load on the CPU 11 and thereby permitting the CPU 11 to effectively operate for other processings. Further, the received data of the control data or the dummy data can be used as synchronizing data, which makes it possible to carry out an accurate time measurement.

Further, since it is possible to transmit control data for controlling the receiver over a predetermined time period from the start of transmission, data-utilizing efficiency for transmission time does not decrease.

Further, although the carrier signal of the present embodiment is a carrier detection signal prepared by detection of the IF signal, this is not limitative, but there may be used a so-called noise-squelch signal based on detection of noise, or a logical product signal prepared from a logical product of the carrier detection signal and the noise-squelch signal.

Further, the transmitter/receiver block 18 may be constructed as being capable of transmission by infrared rays.

Further, although in the present embodiment description is made on transmission and reception of MIDI data between the keyboard 300 with the tone generator 400 and the remote keyboard 500, this is not limitative, but is possible to transmit and receive MIDI data between all MIDI instruments including performance means, such as a keyboards and MIDI guitars, stone generator, and sequencers. In this connection, if the transmitter/receiver 304 is connected to performance information-storing device, such as a sequencer, the performance information-storing device can receive a radio signal transmitted from a remote MIDI instrument, and store performance information demodulated from the radio signal (as processing of performance information).

Further, although in the present embodiment, the transmitter/receiver block 18 transmits and receives a FM radio signal, this not limitative, but it goes without saying that modulation may be effected by any suitable method including the ON/OFF modulation method, the AM modulation method, the PM modulation method, and the pulse modulation method. Further, the transmitter/receiver of the present embodiment receives and transmits by a simplex method, this is not limitative, but the transmitter/receiver may be comprised of a transmitter and a receiver which is capable of operating independently of each other for transmission and reception by a duplex method.

Further, in the present embodiment, for a predetermined time period after start of transmission, a radio signal is transmitted which is modulated by reception control data and dummy data, this is not limitative, but the transmitter/receiver may be constructed such that a radio signal modulated by null data, i.e. non-modulated radio signal is transmitted for the predetermined time period.

Next, a MIDI data transmitter/receiver according to a fifth embodiment of the invention will be described with reference to FIG. 16 to FIG. 28.

The transmitter/receiver of the present embodiment can be applied to the MIDI instrument system shown in FIG. 1.

Figure 15:
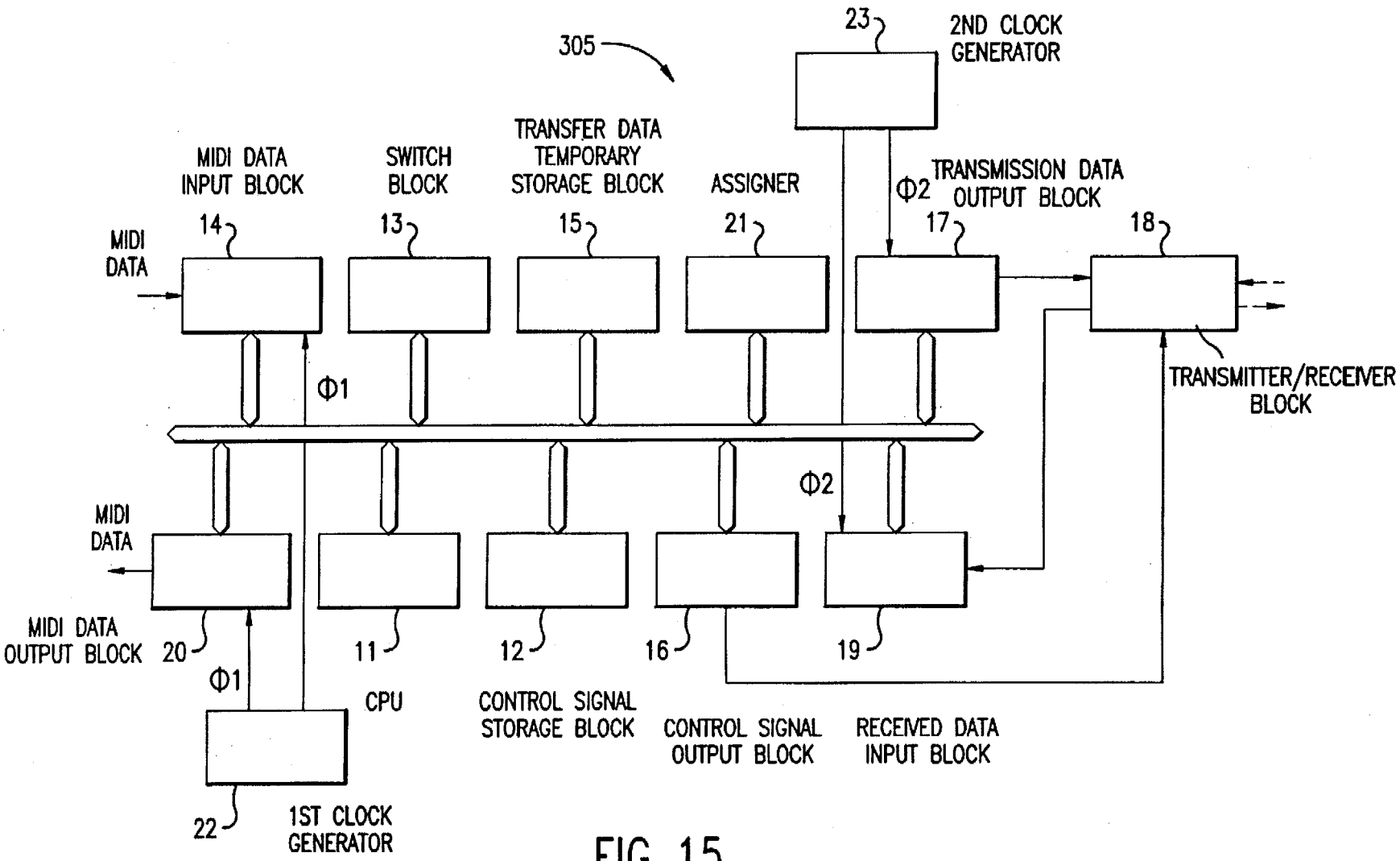
FIG. 15 is a block diagram showing the whole arrangement of a MIDI data transmitter/receiver according to a fifth embodiment of the invention.

Further, as shown FIG. 15, the transmitter/receiver 305 of the present embodiment is distinguished in construction from the FIG. 12 transmitter/receiver of the fourth embodiment in that it additionally includes a first clock generator 22, and a second clock generator 23.

The CPU 11 controls the overall operation of the transmitter/receiver 305. More specifically, it performs control concerning detection of an on/off status of each switch, not shown, of the switch block 13, input/output control of MIDI data delivered to or received from the keyboard 2, writing of received MIDI data into the transfer data temporary storage block 15 and reading the same therefrom, writing of the MIDI data into the assigner 21 and deleting and detection of the MIDI data therein, free area-checking control of FIFO of the transfer data temporary storage block 15, output control of all note-off data, as well as transmission/reception changeover control, control of transmitting/receiving frequencies, transfer control of transmission and reception data, for the transmitter/receiver block 18, and so forth.

The control data storage block 12, the MIDI data input block 14, the control signal output block 16, the transmission data output block 17, the transmitter/receiver 18, the received data input block 19, and the MIDI data output block 20 have the same functions as described in the first embodiment.

The switch block 13 includes the transmitter mode switch, the automatic changeover mode switch, the performance mode switch, and the channel switch, none of which are shown, and each switch has the same function as described in the first embodiment.

The transfer data temporary storage block 15 is formed of a so-called FIFO (First-in First-out) memory having a capacity of e.g. 4K byte, and has the same functions described in the first embodiment. In the transfer data temporary storage block 15, the address at which MIDI data is to be written is indicated by a writing pointer, and the address from which MIDI data is to be read is indicated by a reading pointer. Further, while there is no MIDI data written therein, the CPU 11 sets an internal FIFO empty flag.

During transmission, data is written into the transfer data temporary storage block 15 at a rate faster than data is read therefrom, so that if a large amount of MIDI data is input via the MIDI data input block 14 at a time, the free area in the storage block 15 is reduced to zero, which prevents the same from storing any more data. Even if such a large amount of MIDI data received can be stored, due to a low rate at which data is read therefrom, delay of performance may occur on a remote tone generator which receives transmitted data. To avoid this inconvenience, the CPU 11 constantly checks for an amount of free area of the FIFO memory, and when the amount of free area becomes smaller than a predetermined value, the CPU 11 clears all MIDI data stored in the FIFO memory, and writes all note-off data (FEh) therein for turning all notes off. The all note-off data is read out by the CPU 11, and transmitted by the radio signal from the transmitter/receiver 18.

The assigner 21 is a memory for storing data indicative of an ON/OFF status of every note number in every MIDI channel, which is input to the MIDI data input block 14 and the received data input block 19. Therefore, all the keys of the MIDI channels are made correspondent to memory areas of the assigner 21 having the address and bit value, and when note-on data of a specific key number is input to the transmitter/receiver 305 via the MIDI data input block 14 or the received data input block 19, the CPU 11 writes data of "1" into a predetermined memory area of the assigner 21.

The first clock generator 22 generates a reading sampling clock for the MIDI data input block 14 and an output synchronizing clock for the MIDI data output block 20. Further, the second clock generator 23 generates a synchronizing clock for delivering MIDI data to the transmission data output block 17, and a reading sampling clock for the received data input block 18.

Figure 13:
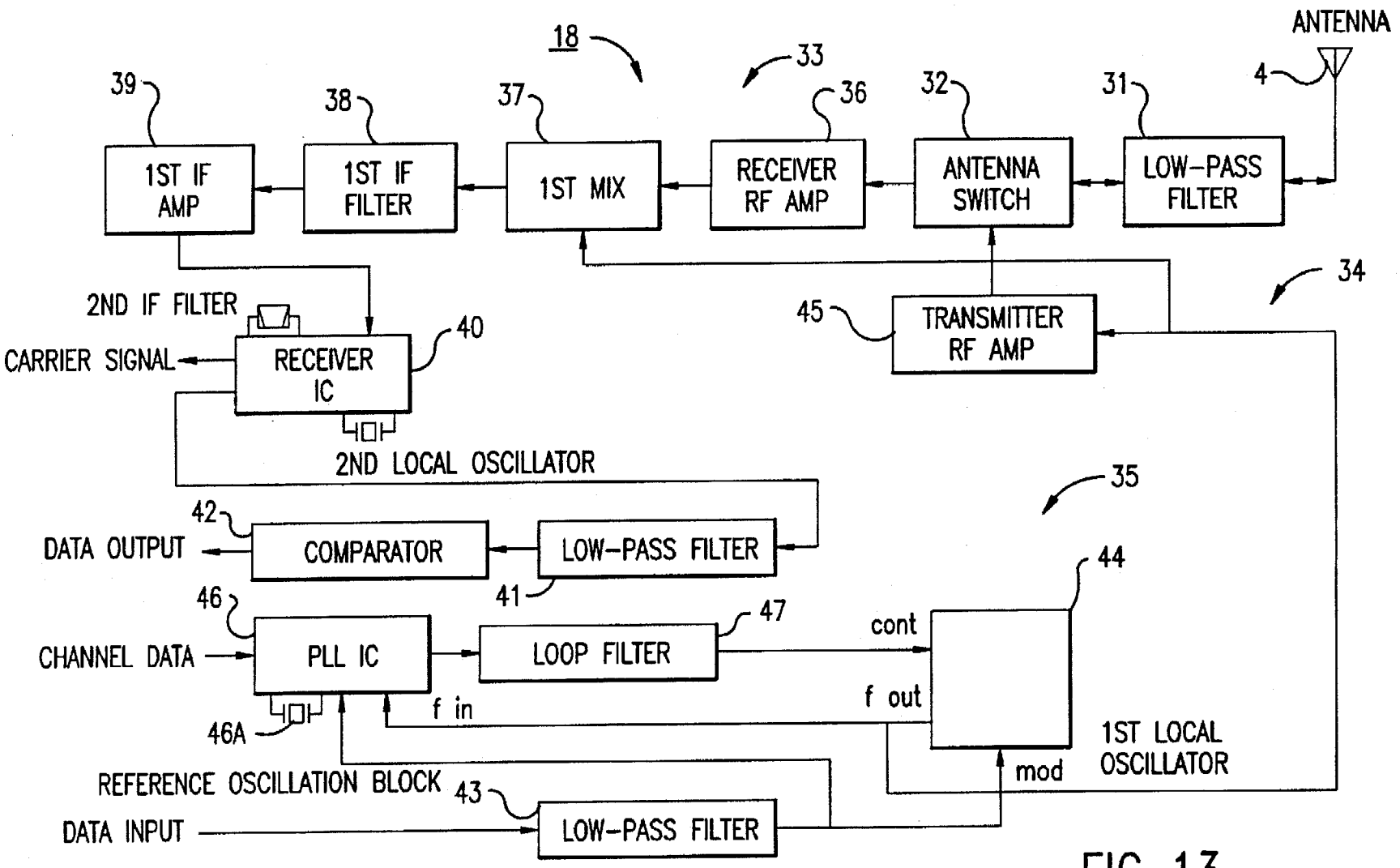
FIG. 13 is a block diagram showing a transmitter/receiver block appearing in FIG. 12 MIDI data transmitter/receiver according to the fourth embodiment.
Figure 16:
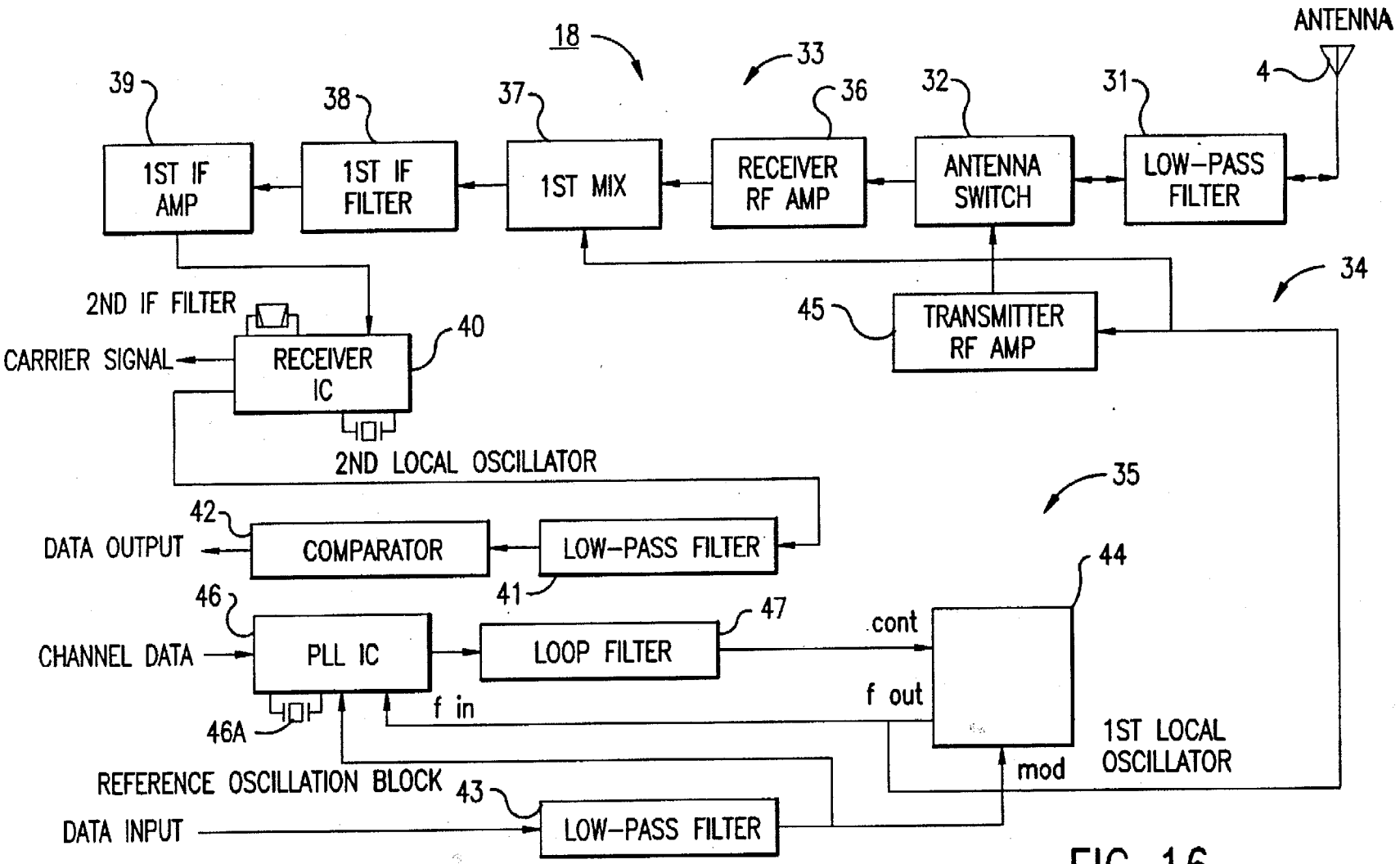
FIG. 16 is a block diagram showing a transmitter/receiver block appearing in FIG. 15 MIDI data transmitter/receiver according to the fifth embodiment.

The arrangement of the transmitted/receiver 18 of the fifth embodiment shown in FIG. 16 is identical to that of the same of the fourth embodiment shown in FIG. 13 except for omission of a line for delivering the carrier signal from the receiver IC 40 to the CPU 11. Therefore, detailed description of the arrangement is omitted.

Further, the outline of the operation of the transmitter/receiver 305 is identical to that described in the first embodiment, and description thereof is also omitted.

Next, details of the operation of the transmitter/receiver 305 will be described with reference to FIG. 17 to FIG. 28. It should be noted that the processings described below are all carried out by the CPU 11 unless otherwise specified. Further, in these processings, there are used flags enumerated below. When each of the flags the names of which are listed on the lefthand column set, the transmitter/receiver 305 is in a state corresponding thereto described on the righthand column.

Transmission/reception flag: transmitter mode

Automatic changeover mode flag: automatic changeover mode

FIFO empty flag: empty state of FIFO

Changeover-permitting flag: state immediately after switched to the automatic changeover mode, or standby state in the automatic changeover mode, after transmission or reception of data is once terminated, and before subsequent transmission or reception starts.

Figure 17:
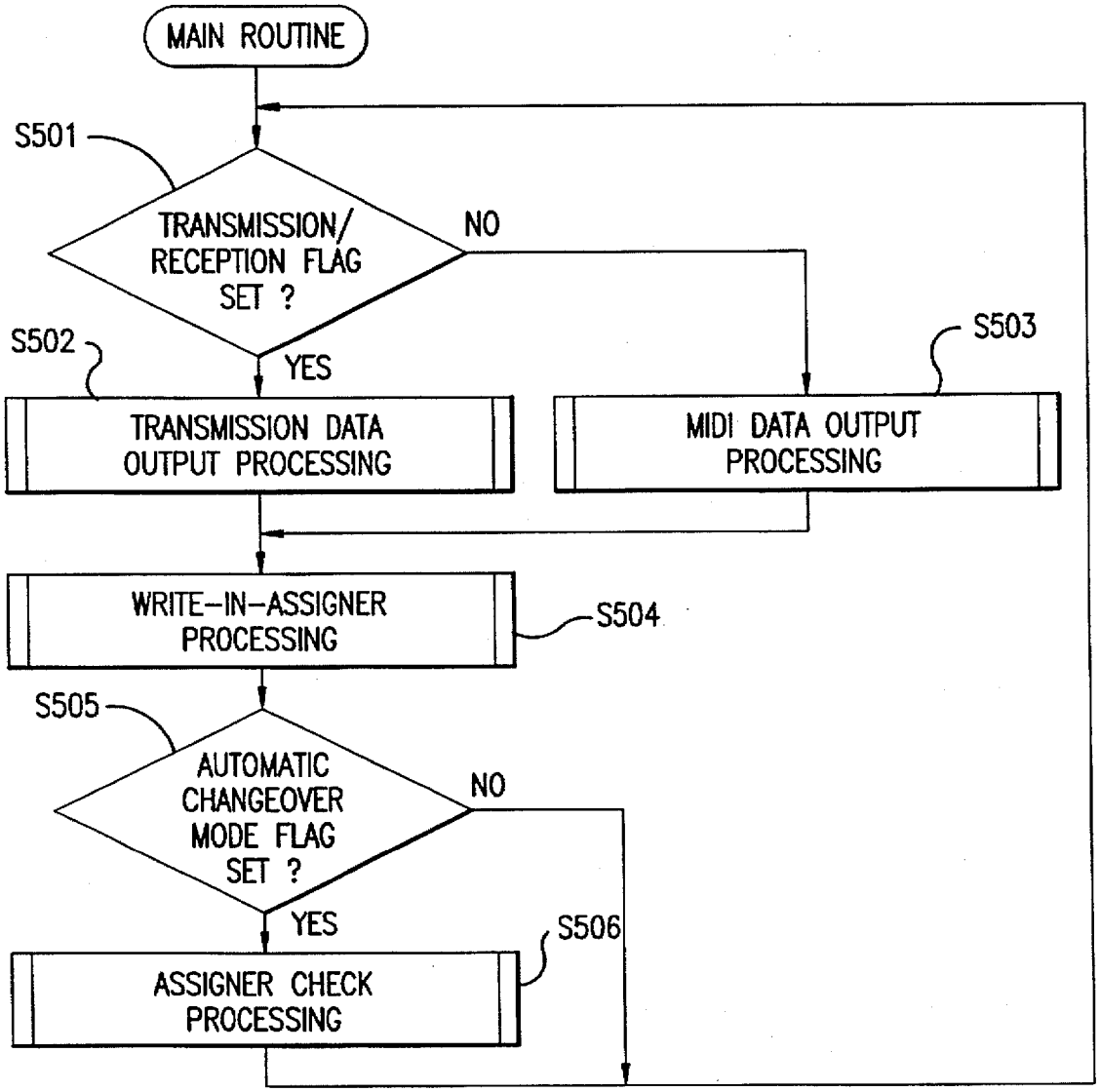
FIG. 17 is a flowchart of a main routine executed by the FIG. 15 MIDI signal transmitter/receiver according to the fifth embodiment.

Next, the main routine for controlling the operation of the transmitter/receiver 3 will be described with reference to FIG. 17.

Figure 18A:
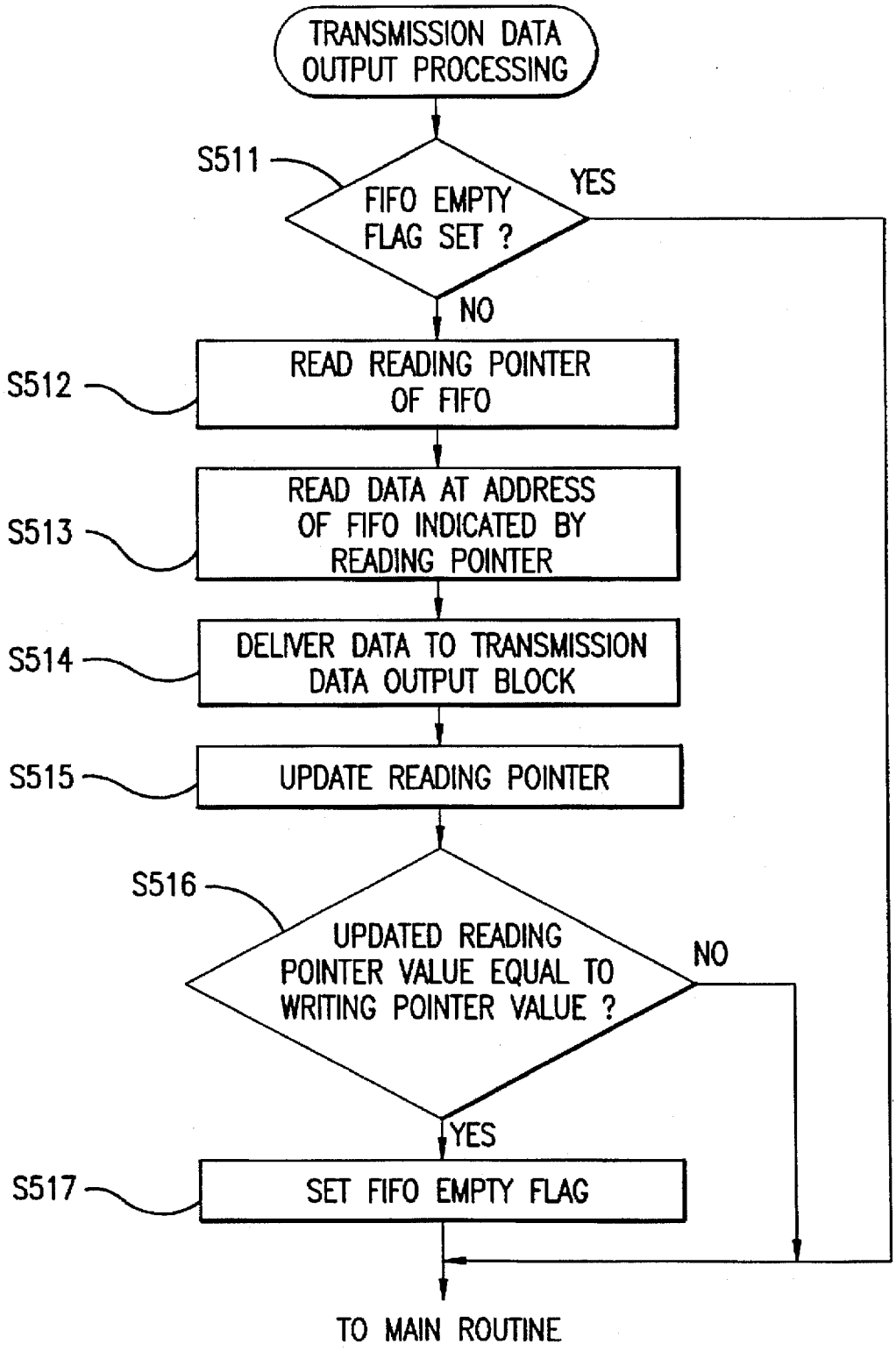
FIG. 18A is a flowchart of transmission data output processing executed by the FIG. 15 MIDI data transmitter/receiver according to the fifth embodiment.
Figure 18B:
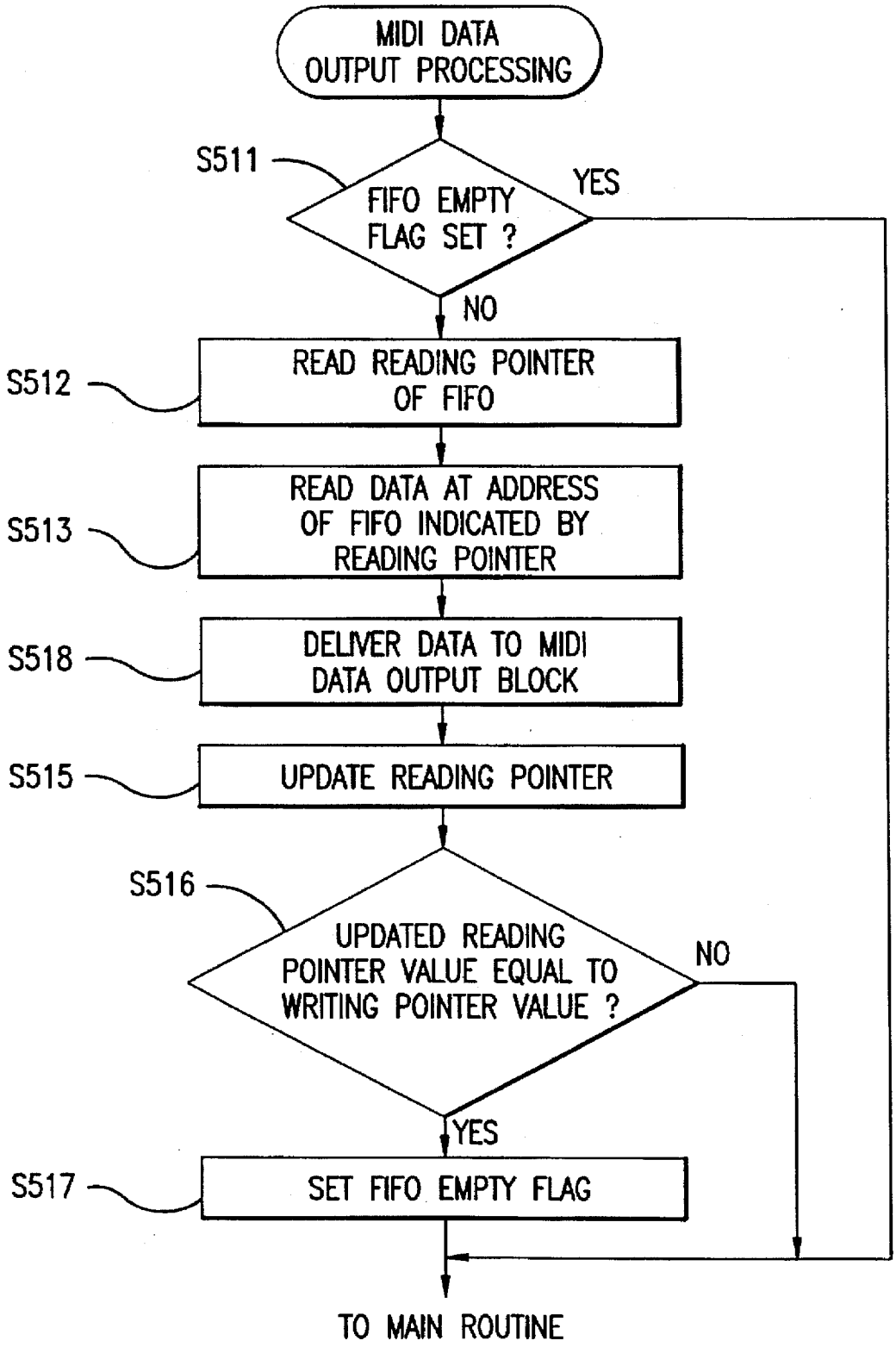
FIG. 18B is a flowchart of MIDI data output processing executed by the FIG. 15 MIDI signal transmitter/receiver according to the fifth embodiment.

The main routine is constantly repeatedly carried out. In this routine, first at a step S501, it is determined whether or no the transmission/reception flag is set. If the transmission/reception flag is set, i.e. if the transmitter mode switch has been turned on in the manual mode, or if the transmitter/receiver 305 is in the transmitter mode when it has been set to the automatic changeover mode, the program proceeds to a step S502, where the transmission data output processing, described in detail hereinafter with reference to FIG. 18A, is carried out. If the transmission/reception flag is not set, i.e. if the transmission switch has not been turned on when the transmitter/receiver is in the manual mode, or if the transmission/receiver is not in the transmitter mode when it has been set to the automatic changeover mode, the program proceeds to a step S503, where the MIDI data output processing, described in detail hereinafter with reference to FIG. 18B, is carried out.

Figure 21:
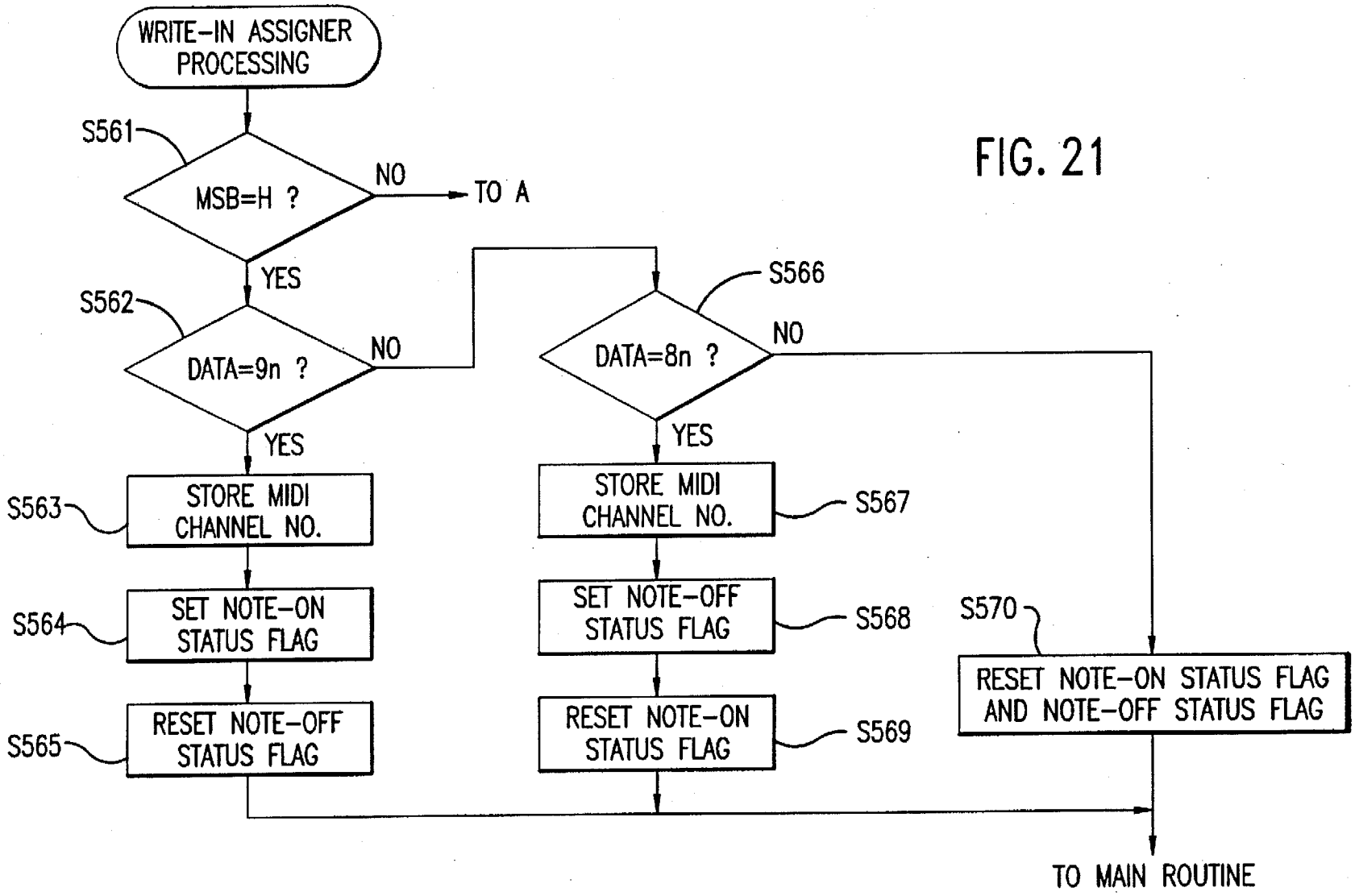
FIG. 21 is a flowchart of write-in assigner processing executed by the FIG. 15 MIDI signal transmitter/receiver according to the fifth embodiment.
Figure 22:
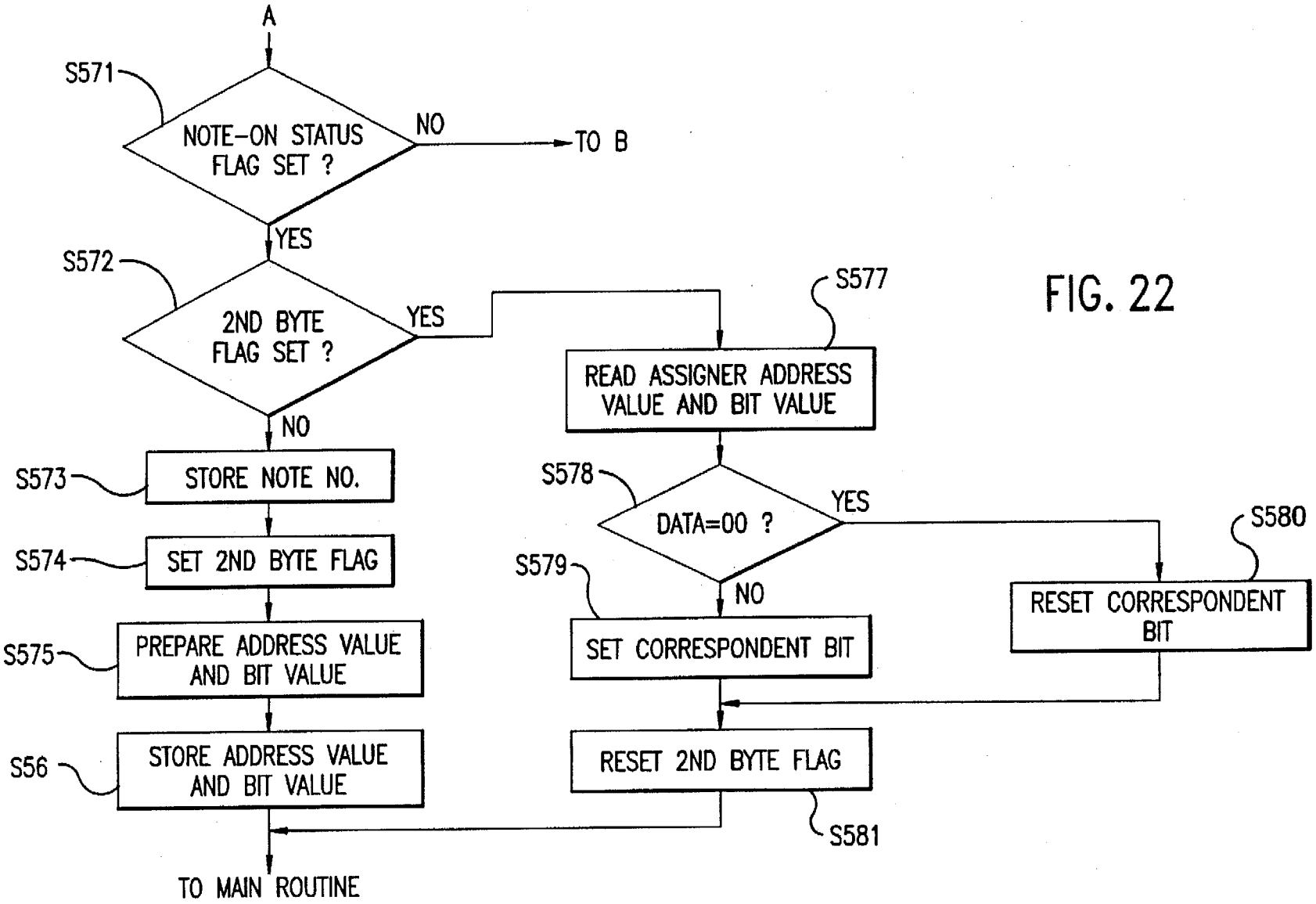
FIG. 22 is a continuation of the FIG. 21 flowchart.
Figure 23:
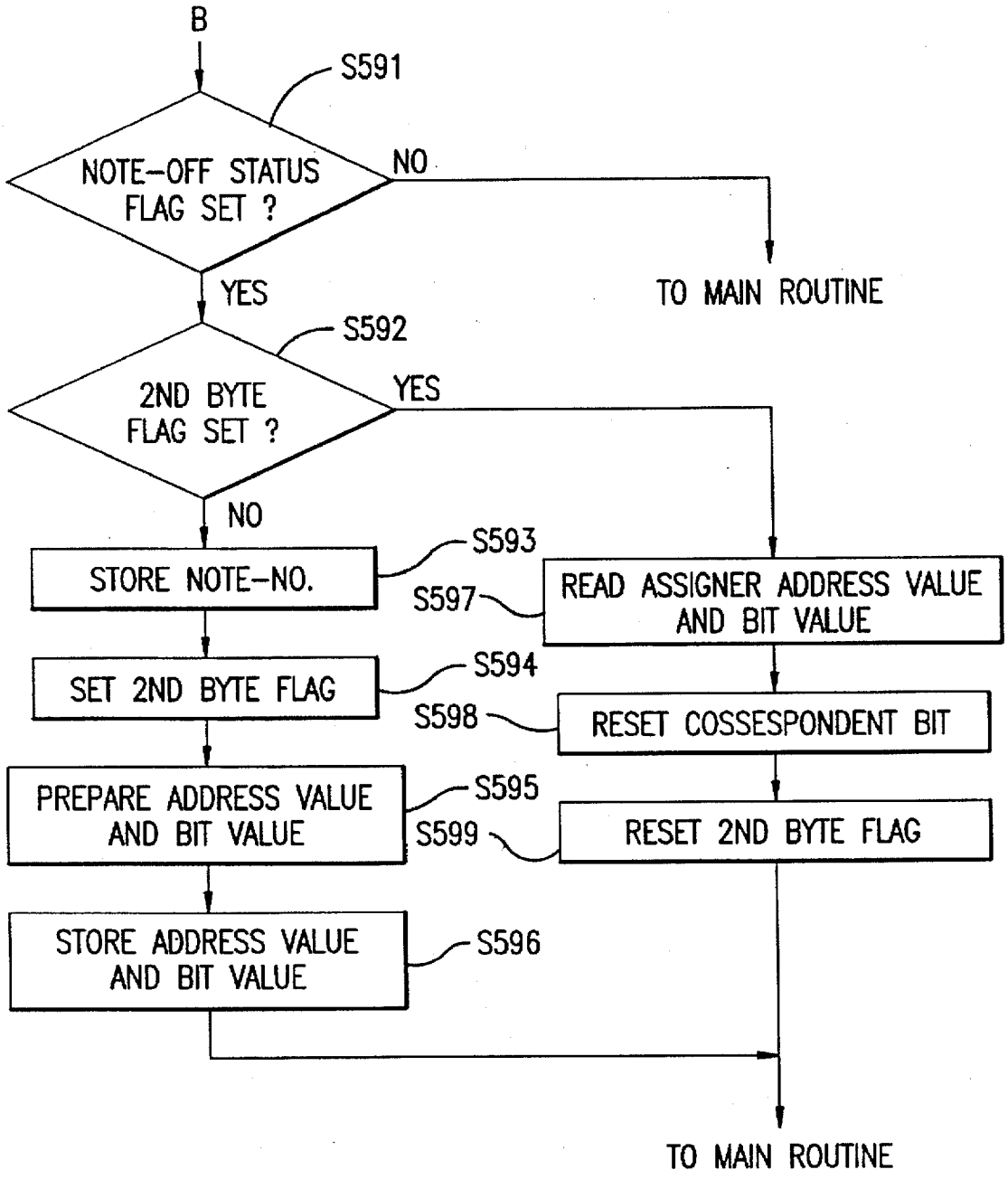
FIG. 23 is a continuation of the FIG. 22 flowchart.
Figure 24:
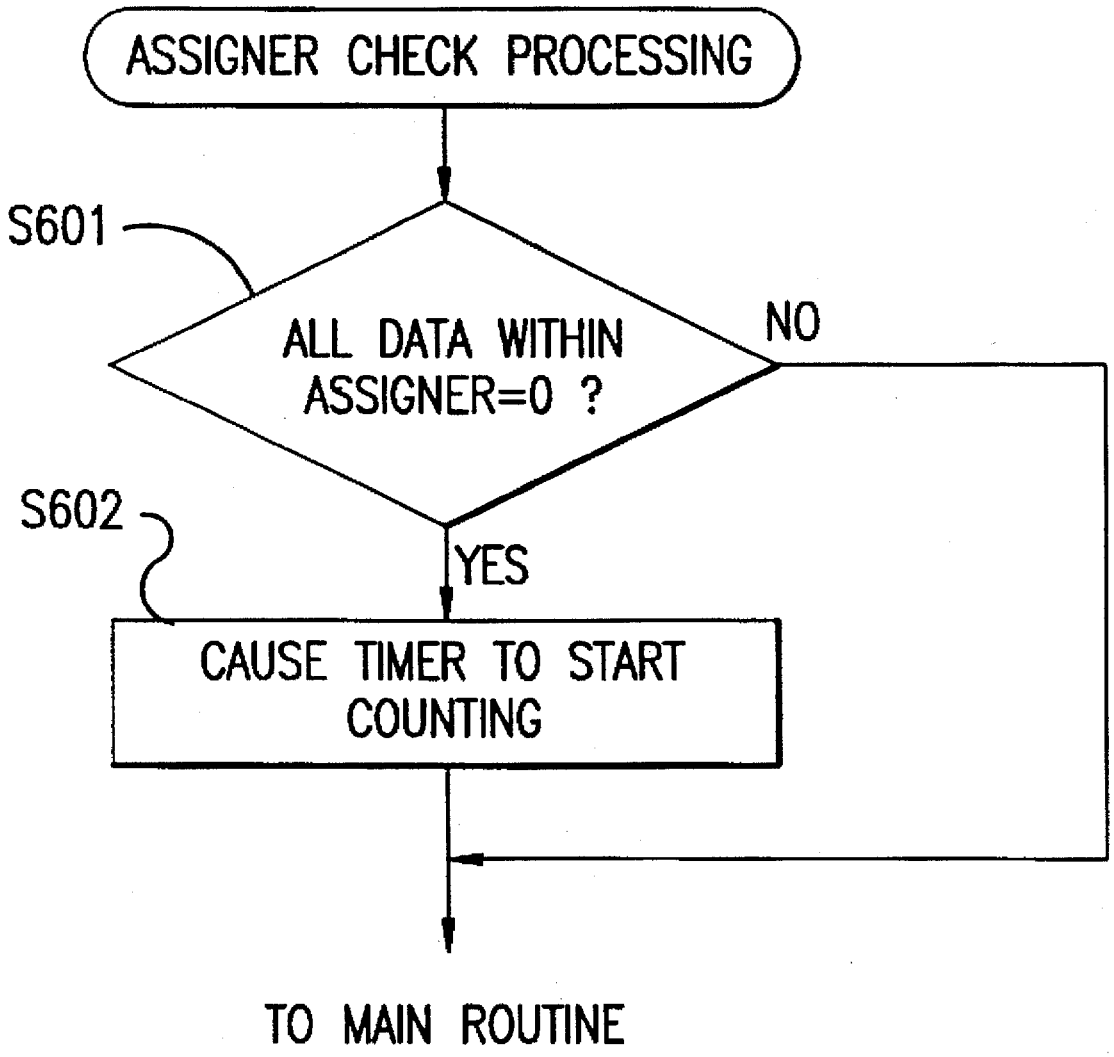
FIG. 24 is a flowchart of assigner check processing executed by the FIG. 15 MIDI signal transmitter/receiver according to the fifth embodiment.

After the processing of the step S502 or the step S503 is carried out, and write-in assigner processing, described in detail hereinafter with reference to FIG. 21 to FIG. 23, is carried out at a step S504, it is determined at a step S505 whether or not the automatic changeover mode is set. When the automatic changeover mode is set, i.e. if the transmitter/receiver 305 is in the automatic changeover mode, assigner check processing, described in detail hereinafter with reference to FIG. 24, is carried out at a step S506. Then, the program returns to the step S501 to repeatedly carry out the main routine. If the answer to the question of the step S505 is negative, i.e. if the transmitter/receiver 305 is in the manual mode, the program immediately returns to the step S501, to repeatedly execute the main routine.

Next, the transmission data output processing carried out at the step S502 of the main routine will be described in detail with reference to FIG. 18A. In this processing, MIDI data received from the keyboard (main part) 2 is transmitted to the remote keyboard 2. First, at a step S511, it is determined whether or not the FIFO empty flag is set. If the FIFO empty flag is set, i.e. if no MIDI data is stored in the FIFO memory, this routine is immediately terminated, followed by the program returning to the main routine.

If the answer to the question of the step S511 is negative (NO), i.e. if the FIFO empty flag is not set, i.e MIDI data exists in the FIFO memory, a value of the reading pointer of the FIFO memory is read at a step S512, and the MIDI data stored at the address of the FIFO memory indicated by the reading pointer is read at a step S513. Then, the MIDI data read out from the FIFO memory is delivered to the transmission data output block 17 at a step S514, and the reading pointer is updated at a step S515. Then, it is determined at a step S516 whether or not the updated value of the reading pointer is equal to a value of the writing pointer. If the former is equal to the latter, it is judged that no MIDI data remains in the FIFO memory, and the FIFO empty flag is set at a step S517, followed by the program returning to the main routine. On the other hand, if the answer to the question of the step S516 is negative (NO), it is judged that MIDI data remains within the FIFO memory, and the program returns to the main routine without seating the FIFO empty flag.

Then the MIDI date output processing carried out at the step S503 of the main routine will be described with reference to FIG. 18B. In this processing, the MIDI data received from the other keyboard 2 is delivered to the keyboard (main part) 2. This processing is similar to the transmission data output processing described above, and is distinguished therefrom in that the step S514 is replaced by a step S518, at which the MIDI data read out from the FIFO memory is not delivered to the transmission data output block 17 but to the MIDI data output block 20. In short, according to this processing, the MIDI data read out is sent to the MIDI data output block 26, thereby delivering the MIDI signal to the keyboard (main part) 2.

Then, the automatic changeover mode-setting processing will be described. According to this routine, when the automatic changeover mode switch is depressed or tuned on, the transmitter/receiver 305 is set to the automatic changeover mode by interrupt processing, while setting or resetting all the flags except for the FIFO empty flag, to respective predetermining states. This routine is distinguished from the routine described in the first embodiment with reference to FIG. 4 in that a channel number is designated by the channel switch, and detailed description thereof is omitted. In addition, the first local oscillation frequency of the receiver block corresponds to the first local oscillation frequency of the VCO 44 in the receiver mode.

Figure 19:
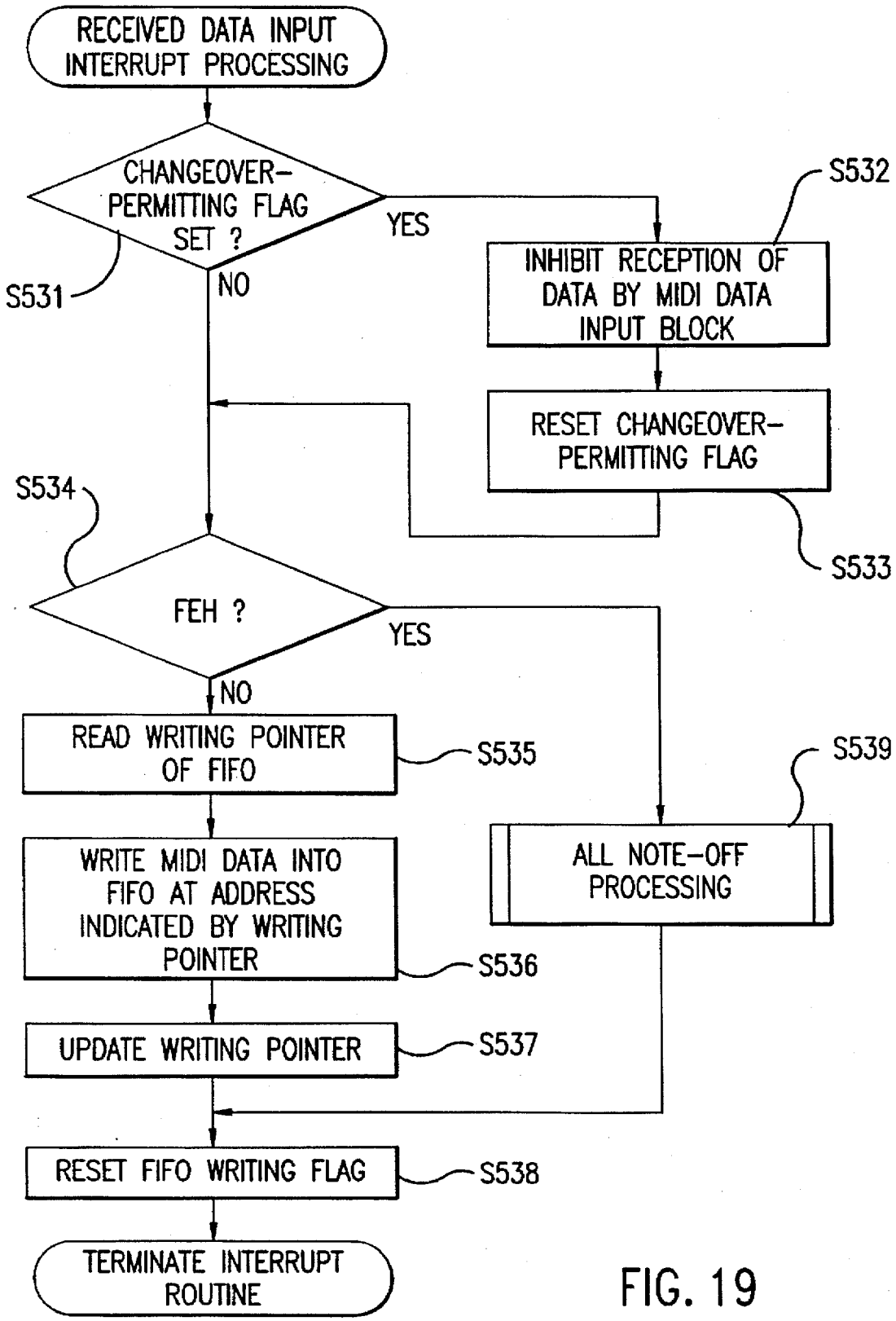
FIG. 19 is a flowchart of received data input interrupt processing executed by the FIG. 15 MIDI data transmitter/receiver according to the fifth embodiment.
Figure 20:
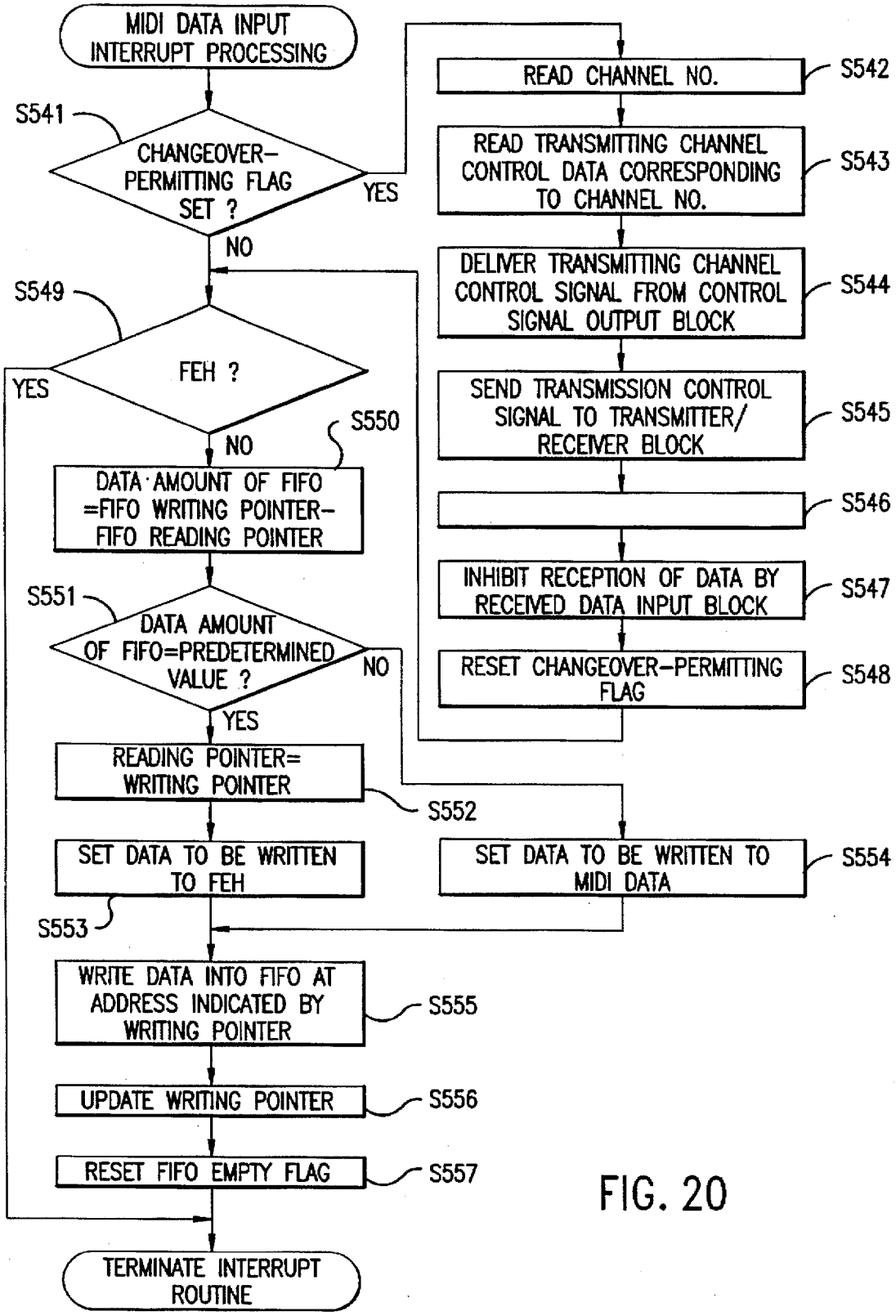
FIG. 20 is a flowchart of MIDI data input interrupt processing executed by the FIG. 15 MIDI data transmitter/receiver according to the fifth embodiment.

Then, interrupt processing for receiving data via the received data input block (received data input interrupt processing) and interrupt processing for receiving data via the MIDI data input block (MIDI data input interrupt processing), which are permitted in the automatic changeover mode-setting routine, will be described with reference to FIG. 19 and FIG. 20. It should be noted that these interrupt processings are also carried out in manual receiver mode-setting processing and manual transmitter mode-setting processing, both described in detail hereinbelow with reference to FIG. 20A and FIG. 20B, respectively.

First, the received data input interrupt processing will be described. According to this processing, when the transmitter/receiver 305 is in the receiver mode, the MIDI signal received via the transmitter/receiver block 18 and the received data input block 19 from the remote keyboard 2 is automatically delivered to the keyboard (main part) 2. In this processing, it is first determined at a step S531 whether or not the changeover-permitting flag is set. If the answer to this question is affirmative (YES), i.e. if the transmitter/receiver 305 is in the standby state, the MIDI data input block 14 is inhibited from receiving data at a step S532, and the changeover-permitting flag is reset at a step S533.

After resetting the changeover-permitting flag or if the answer to the question of the step S531 is negative (No), i.e. if the received data input interrupt is being carried out, it is determined at a step S534 whether or not the MIDI data is all note-off data (FEh). If the answer to this question is negative (NO), the writing pointer of the FIFO is read at a step S535, and then the MIDI data received via the transmission data input block 19 is written into an address of the FIFO indicated by the writing pointer at a step S536. Then, the writing pointer is updated at a step S537, and then the FIFO empty flag is reset at a step S538. If the answer to the question of the step S534 is affirmative (YES), the all note-off processing for setting all notes to note-off is carried out at a step S539, followed by the program jumping over to the step S538. This terminates the received data input interrupt processing, followed by the program proceeding to the main routine.

Then the MIDI data input interrupt processing will be described in detail with reference to FIG. 20. According to this processing. When the transmitter/receiver 305 is in the transmitter mode, the MIDI signal received via the MIDI data input block 14 from the keyboard (main part) 2 is automatically transmitted to the remote keyboard 2. In this processing, it is first determined at a step S541 whether or not the changeover-permitting flag is set. If the answer to this question is affirmative (YES), i.e. if the transmitter/receiver 305 is in the standby state, a channel number designated by the channel switch is read at a step S542, and transmitting channel control data corresponding to the channel number (i.e. data of the first local oscillation frequency of the VCO 44 in the transmitter mode) is read from the control data memory block 12 at a step S543. Then, the transmitting channel control signal based on the transmitting channel control data is delivered via the control signal output block 16 to the transmitter/receiver block 18 at a step S544, while the transmission control signal is delivered to the transmitter/receiver block 18 via the control signal output block 16 at a step S545. Thereafter, the transmission/reception flag is set at a step S546, the received data input block 19 is inhibited from receiving data at a step S547, and the changeover-permitting flag is reset at a step S548.

After this flag is reset, or if the answer to the question of the step S541 is negative (NO), i.e. if the MIDI data input interrupt is already being carried out, it is determined at step S549 whether or not the MIDI data received is active sensing data (FEh in MIDI standards). If the answer to this question is affirmative (YES), the present routine is terminated.

On the other hand, if the answer to the question of the step S549 is negative (NO), an amount of data stored in the FIFO or the transfer data temporary storage block 15 is checked at a step S550. This amount is calculated from the difference between a value of the writing pointer of the FIFO means and a value of the reading pointer thereof. Alternatively, an amount of free area, i.e. the difference between the maximum amount of data which can be stored and the writing pointer may be calculated. Then, it is determined at a step S551 whether or not the amount of data in the FIFO is equal to a predetermined value, i.e. whether the free area of the FIFO is smaller than a predetermined value. If the answer to this question is affirmative (YES), a value of the reading pointer is set to the writing pointer at a step S552. This nullifies the MIDI data written in the FIFO.

Then, data to be written into the address of the FIFO indicated by the writing pointer is set to "FEh" at a step S553. That is, the data to be written next is set to all note-off data for turning off all notes each being set to note-on status. On the other hand, if the answer to the question of the step S551 is negative (NO), the program proceeds to a step S554, where the data to be written into the address of the FIFO indicated by the writing pointer is set to the received MIDI data.

After setting the data to be written to "FEh" or the received MIDI data, the "FEh" or the MIDI data received via the MIDI data input block 14 is written into the address of the FIFO indicated by the writing pointer at a step S555. Then, the writing pointer is updated at a step S556, and the FIFO empty flag is reset at a step S557. This terminates the MIDI data input interrupt processing.

Next, the write-in assigner processing carried out at the step S504 of the main routine will be described with reference to FIG. 21 to FIG. 23. According to this processing, data of note-on keys of the keyboard 2 concerning MIDI channel is written into the assigner 21 after one byte of MIDI data is transmitted at the step S502 or delivered to the keyboard (main part) at the step S503.

First, MIDI data received via the MIDI data input block 14 or the received data input block 19 is checked as to whether the MSB (Most Significant Bit) thereof is "H", i.e. equal to "1" at a step S561. If the answer to this question is negative (NO), i.e. if the MIDI data is a data byte, the program proceeds to a step S571 shown in FIG. 22, whereas if the answer is affirmative (YES), i.e. if the MIDI data is a status byte, it is determined at a step S562 whether or not the more significant four bits is equal to 9*n*, i.e. whether they are "1001". If the answer is affirmative (YES), it is judged that the MIDI data designates a note-on status, and a MIDI channel number is stored at a step S563. Then, the note-on status flag is set at a step S564, while resetting the note-off status flag at a step S565, to thereby prevent the note-on status flag and the note-off status flag from being both set simultaneously, followed by returning to the main routine.

If the answer to the question of the step S562 is not equal to "9*n*", it is determined at a step S566 whether or not the more significant four bits is equal to 8*n*, i.e. whether or not they are "1001. If the answer to this question is affirmative (YES), i.e. if the MIDI data designates a note-off status, a MIDI channel number is stored at a step S567, and the note-off status flag is set at a step S568, while resetting the note-on status flag at a step S569. In this case as well, the flags are prevented from being both set simultaneously. If the answer to the question of the step S566 is negative (NO), it means that the present MIDI data represents neither the note-on status nor the note-off status, and hence the note-on status flag and the note-off status flag are reset, at a step S570, followed by the program returning to the main routine.

The processing carried out when the answer to the question of the aforementioned step S561 is negative (NO), i.e. when the MIDI data is a data byte will be described with reference to FIG. 22. This program is executed when the input MIDI data is a data byte. First, it is determined at the step S571 whether or not the note-on status flag is set, i.e. whether or not the note-on status flag has been set at the step S564 in FIG. 21.

If it is determined that the note-on status flag is not set, i.e. if the MIDI data received is not note-on data, the program proceeds to a step S591 shown in FIG. 23, whereas if the answer is affirmative (YES), it is determined at a step S572 whether or not a second byte flag is set, i.e. whether or not the MIDI data is data of the second byte. If the answer to this question is negative (NO), i.e. if the MIDI data received is the second byte data of the MIDI data, the note number is stored at a step S573, and the second byte flag is set at a step S574. Then, from the MIDI channel number stored at the step S563 and the note number stored at the step S573, the address value and the bit value for the assigner 21 are prepared at a step S575, and then stored at a step S576. This makes it possible to check to which key of which MIDI channel corresponds data of the third byte to be received next.

On the other hand, if the answer to the question of the step S572 is affirmative (YES), i.e. if the second byte flag is set, i.e. if the MIDI data received is data of the third byte, the address value and bit value of the assigner 21 are read out at a step S577. Then, it is determined at a step S578 whether or not the data is "00 (volume 0)", i.e. if it designates a note-off. If the answer to this question is negative (NO), a correspondent bit (memory area) of the assigner 21 is set, i.e. "1" is written therein to set the note-on status, at a step S579. If the answer is affirmative (YES), a correspondent bit of the assigner 21 is reset, i.e. "0" is written therein, at a step S580, and the second byte flag is reset at a step S581, followed by the program returning to the main routine.

Now description will be made with reference to FIG. 23 on the case in which the answer to the question of the step S571 is negative (NO), i.e. the note-on status flag is not set, in other words, the MIDI data received is not the note-on data. If the data other than the note-on data is received, it is determined at a step S591 whether or not the note-on status flag is set. If the note-off status flag is not set, i.e. if the data received is neither the note-on data nor the note-off data, it is judged that performance data other than the note data is received, followed by the program returning to the main routine.

If the note-off status flag has been set, it is determined at a step S592 whether or not the second byte flag is set. If the answer to this questions negative (NO), the note number is stored at a step S593, and the second byte flag is set at a step S594. Then, from the MIDI channel number stored at the step S563 and the note number stored at the step S693, the address value and the bit value for the assigner 21 are prepared at a step S595 and at the same time stored at a step S596. This makes it possible to determine to which key of which MIDI channel corresponds data of the third byte to be received next.

On the other hand, if the answer to the question of the step of the step S592 is affirmative (YES), the address value and bit value of the assigner 21 are read out at a step S597. Then, a corresponding bit of the assigner is reset, i.e. "0" is written therein at a step S598, and the second byte flag is reset at a step S599. In short, it is assumed here that the key which was set to the note-on status, is changed into the note-off status. This completes the assigner processing, and the program returns to the main routine.

Next, the assigner check routine carried out at the step S506 of the main routine will be described with reference to FIG. 24.

If the write-in assigner processing at the step S504 of the main routine is terminated and the automatic changeover mode flag has been set, it is determined at a step S601 whether or not all the data within the assigner is equal to "0". This check is made to determine whether or not all the MIDI data received via the MIDI data input block 14 or the MIDI data received via the received data input block 19 have been delivered via the MIDI data output block 20 to the keyboard (main part) 2, or transmitted to the other keyboard via the transmitter/receiver block 18, setting all the keys within the MIDI channel off. If all the data within the assigner 21 are equal to "0", a timer incorporated within the CPU 11 is started at a step S602. When the count of the timer becomes equal to a predetermined number (i.e. if a predetermined time period, e.g. 1 or 2 seconds elapses), the timer interrupt, described hereinbelow, is carried out.

Figure 25:
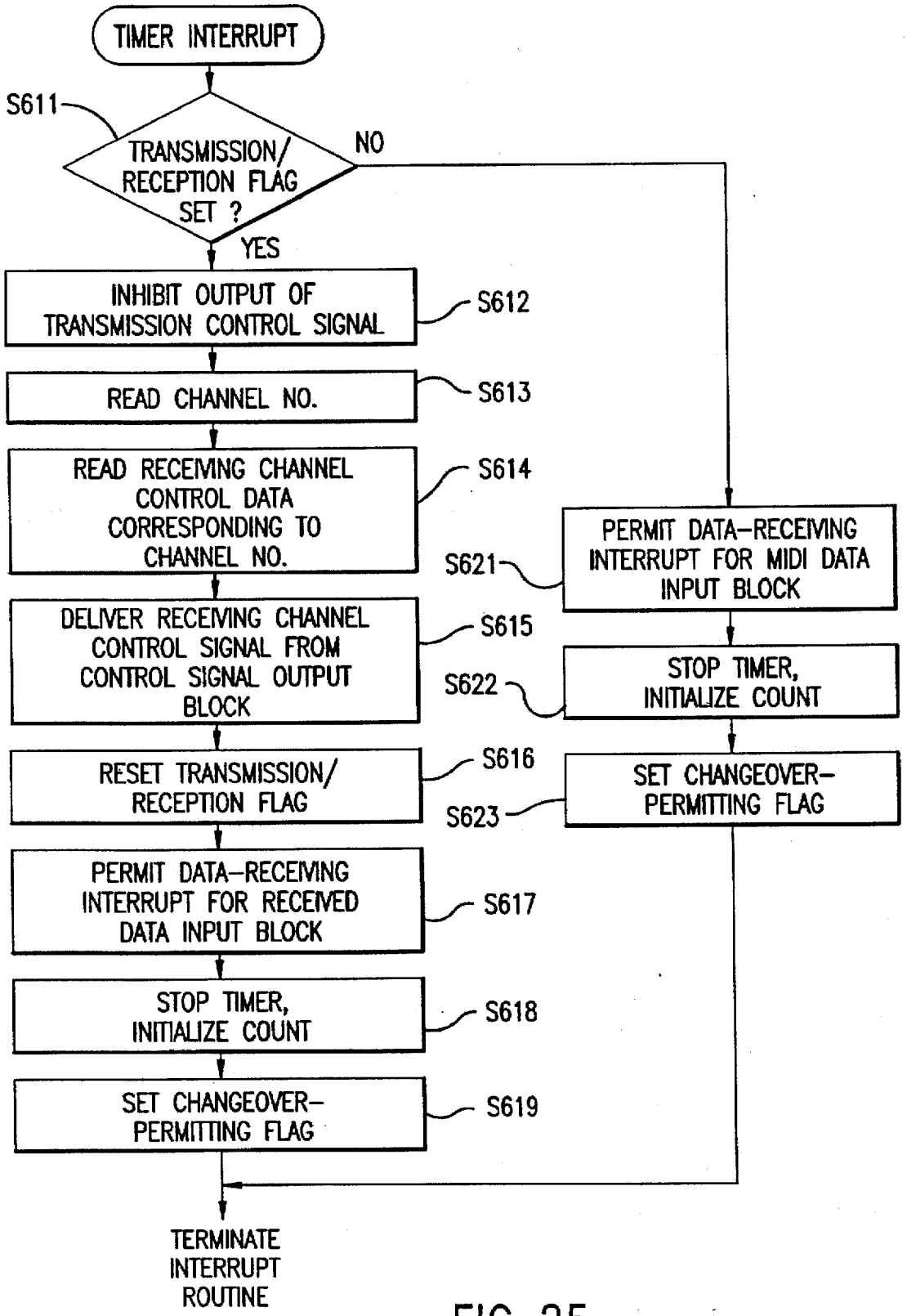
FIG. 25 is a flowchart of timer interrupt processing executed by the FIG. 15 MIDI signal transmitter/receiver according to the fifth embodiment.

Next, the timer interrupt processing carried out when the timer runs out at the step S602 in FIG. will be described with reference to FIG. 25.

The timer interrupt processing resets the transmitter/receiver 305 to the initial state of the automatic changeover mode when the received data input interrupt or the MIDI data input interrupt is carried out and terminated in the automatic changeover mode. In other words, when the assigner 21 does not store the MIDI data for a predetermined time period, it automatically sets the transmitter/receiver 305 to a state which permits the received data input interrupt processing and the MIDI data input interrupt processing.

In this processing, it is determined at a step S611 whether or not the transmission/reception flag is set. If the answer to this question is affirmative (YES), the output of the transmission control signal is inhibited at a step S612, i.e. the transmitter/receiver block 18 is set to a data-receiving status, and then the channel number designated by the channel number switch is read at a step S613. The receiving channel control data corresponding to the channel number is read from the control data storage block 12 at a step S614. Then, the receiving channel control data read is delivered to the transmitter/receiver block 18 by way of the control signal output block 16 at a step S615. Then, the transmission/reception flag is reset at a step S616, thereby setting the received data input block 19 to a state in which data can be received, and the received data input interrupt is permitted at a step S617. Then, the counting of the timer at the step S692 of the assigner check processing carried out at the step S506 of the main routine is stopped, and the count of the timer is initialized at a step S118. Then, the changeover-permitting flag is set at a step S119.

If the answer to the question of the step S611 is negative (NO), i.e. if the MIDI data input block 14 is already set to a state in which data can be received, the MIDI data input interrupt is permitted at a step S621. Then, similarly to the step S618, the counting of the timer is stopped, and the count of the sense is initialized at a step S622. Then, the changeover-permitting flag is set at a step S623. This terminates the timer interrupt processing, and the program returns to the main routine.

As described above, in the timer interrupt processing, when it is determined that no note-on data is stored in the assigner 21, the operation of the transmitter block 34 is inhibited (the transmitter mode is canceled), and the receiver block 33 is made operative (the receiver mode is set at the step S612). Then, the received data input interrupt is permitted at the step S617, and the MIDI data input interrupt is permitted at the step S621. This automatically makes it possible to input the MIDI signal from the keyboard (main part) 2 to the transmitter/receiver 305, which in turn transmits the MIDI signal via the transmitter block 34 to the other keyboard, and also to deliver the MIDI signal received via the receiver block 3 to the keyboard (main part) 2.

Further, the timer count processing provides an extra time period when the keyboard (main part) 2 or the remote keyboard immediately starts delivery or transmission of the MIDI data when all the data in the assigner becomes equal to "0", which makes it possible to reliably transmit all the MIDI signals from the keyboard (main part) 2 and the MIDI signal received from the remote keyboard 2, to the remote keyboard 2 and the keyboard (main part) 2, respectively.

Figure 26A:
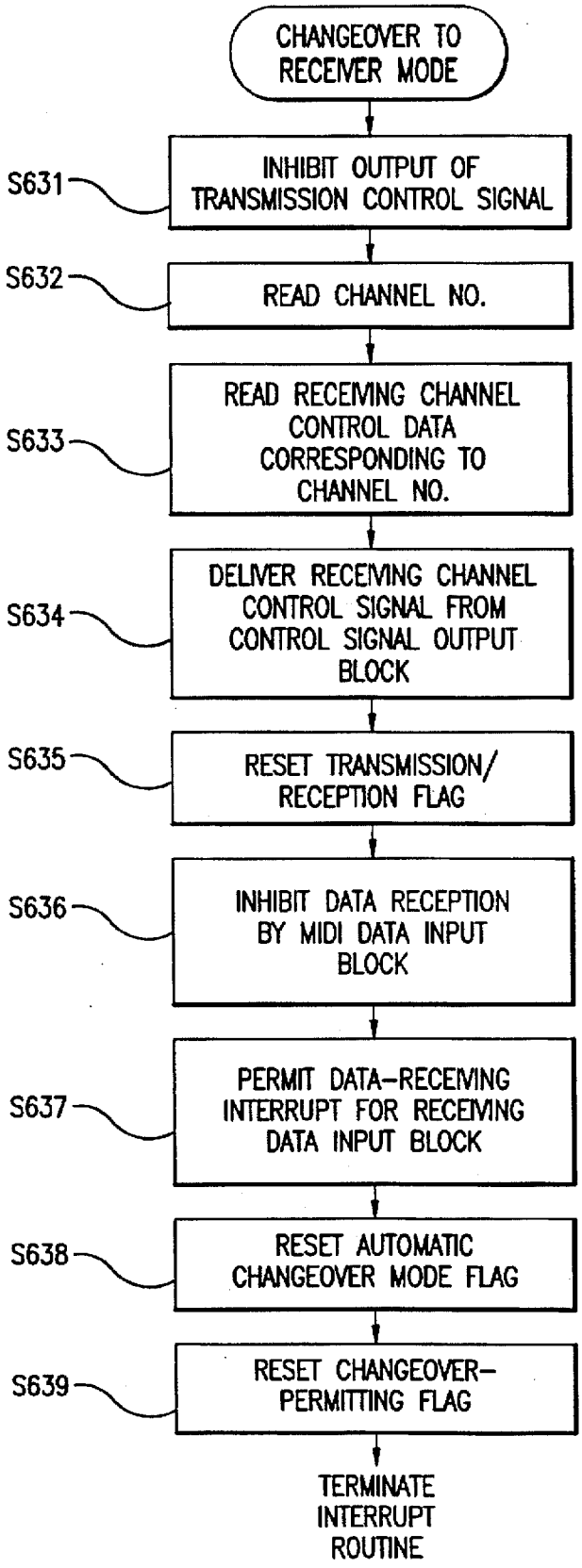
FIG. 26A is a flowchart of receiver mode-setting processing executed by the FIG. 15 MIDI signal transmitter/receiver according to the fifth embodiment.
Figure 26B:
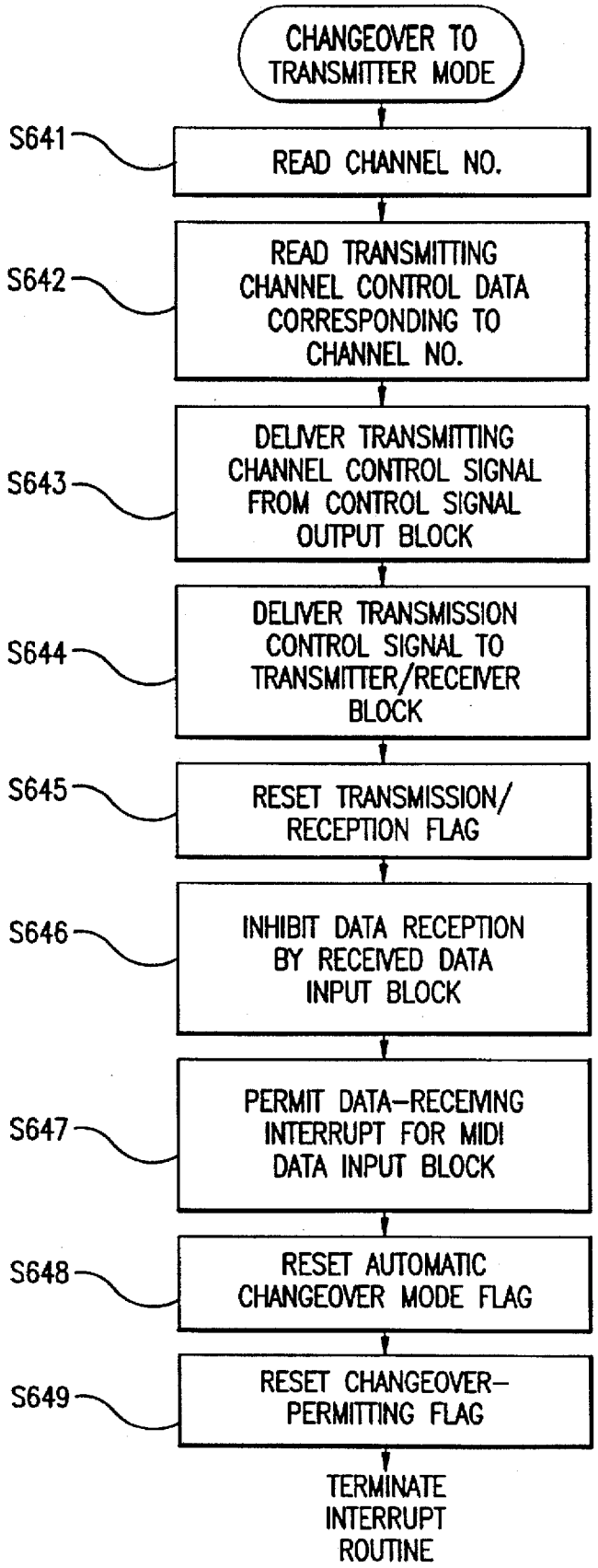
FIG. 26B is a flowchart of transmitter mode-setting processing executed by the FIG. 15 MIDI signal transmitter/receiver according to the fifth embodiment.

Next, the processing (manual receiver mode-setting processing) of changeover to receiver mode and the processing of changeover to transmitter mode (manual transmitter mode-setting processing) in the manual mode will be described with reference to FIG. 26A and FIG. 26B.

First, the processing of changeover to receiver mode in the manual mode will be described with reference to FIG. 26A. This processing is carried out, when the automatic changeover mode switch is turned off to set the transmitter/receiver 305 to the manual mode, and at the same time the receiver mode switch is turned on to set the same to the receiver mode, thereby using the keyboard 2 exclusively as a tone generator. In short, this processing is executed when the keyboard 2 is caused to give a performance in response to the MIDI signal received from the other keyboard 2.

According to this processing, when the on-status of the receiver mode switch is detected, the transmission control signal is inhibited from being delivered at a step S631, and the transmitter/receiver block 18 is set to the receiver mode and at the same time the channel number designated by the channel switch is read at a step S632. Then, the receiving channel control data corresponding to the channel number is read from the control data storage block 12 at a step S633. Then, the receiving channel control signal based on the receiving channel control data is delivered via the control signal output block 16 to the transmitter/rcceiver block 18 at a step S634. Then, the transmission/reception flag is reset at a step S635 to make the transmitter/receiver block 18 capable of receiving data, and at the same time, the MIDI data input block 14 is inhibited from receiving the MIDI data at a step S636. In this state, the received data input block 19 alone is permitted to receive the data, and the received data input interrupt is permitted at a step S637. Then, the automatic changeover mode flag is reset at a step S638, to set the transmitter/receiver to the manual mode, and at the same time the changeover-permitting flag is reset at a step S639, followed by the program returning to the main routine.

Next, the processing of changeover to transmitter mode in the manual mode will be described with reference to FIG. 26B. This processing is carried out, when the automatic changeover mode switch is turned off to set the transmitter/receiver 305 to the manual mode, and at the same time the transmitter mode switch is turned on to set the same to the transmitter mode, thereby setting the transmitter/receiver 305 to a predetermined state in which the present keyboard 2 causes the remote keyboard 2 to give a performance in response to the MIDI signal transmitted therefrom. Further, this processing is substantially similar to the processing of changeover to the receiver mode in the manual mode described above, and is distinguished therefrom only in that the transmitter/receiver block 18 is set not to a data-receiving status, but to a data-transmitting status, in short, in delivery of the transmission control signal from the control signal output block 16.

In this processing, the channel number is read at a step S641. Then, the transmitting channel control data corresponding thereto is read from the control data storage block 12 at a step S642. Then, the transmitting channel control signal based on the transmitting channel control data is delivered via the control signal output block 16 to the transmitter/receiver block 18 at a step S643. Then, the transmission control signal is delivered at a step S644, and the transmission/reception flag is set at a step S645. Then, the received data input block 19 is inhibited from receiving the MIDI data at a step S646. In this state, the MIDI data input block 14 alone is permitted to receive data, and the MIDI data input interrupt is permitted at a step S647. Then, the automatic changeover mode flag is reset at a step S648, to set the transmitter/receiver to the manual mode, and at the same time the changeover-permitting flag is reset at a step S649, followed by terminating the processing of changeover to transmitter mode.

As described above, when in the manual mode, by selective operation of the transmitter mode switch and the receiver mode switch, the operation of the transmitter/receiver 305 can be easily set to one of the transmitter mode and the receiver mode. Therefore, it is possible to use the keyboard 2 as a single or isolate MIDI performance device, or as a tone generator controlled by the other keyboard 2. Further, it can be used as a tone generation control device for controlling the tone generation by the other keyboard 2. In this case, it is quite unnecessary to change connections of MIDI cables and transmitter/receivers 305.

Figure 27A:
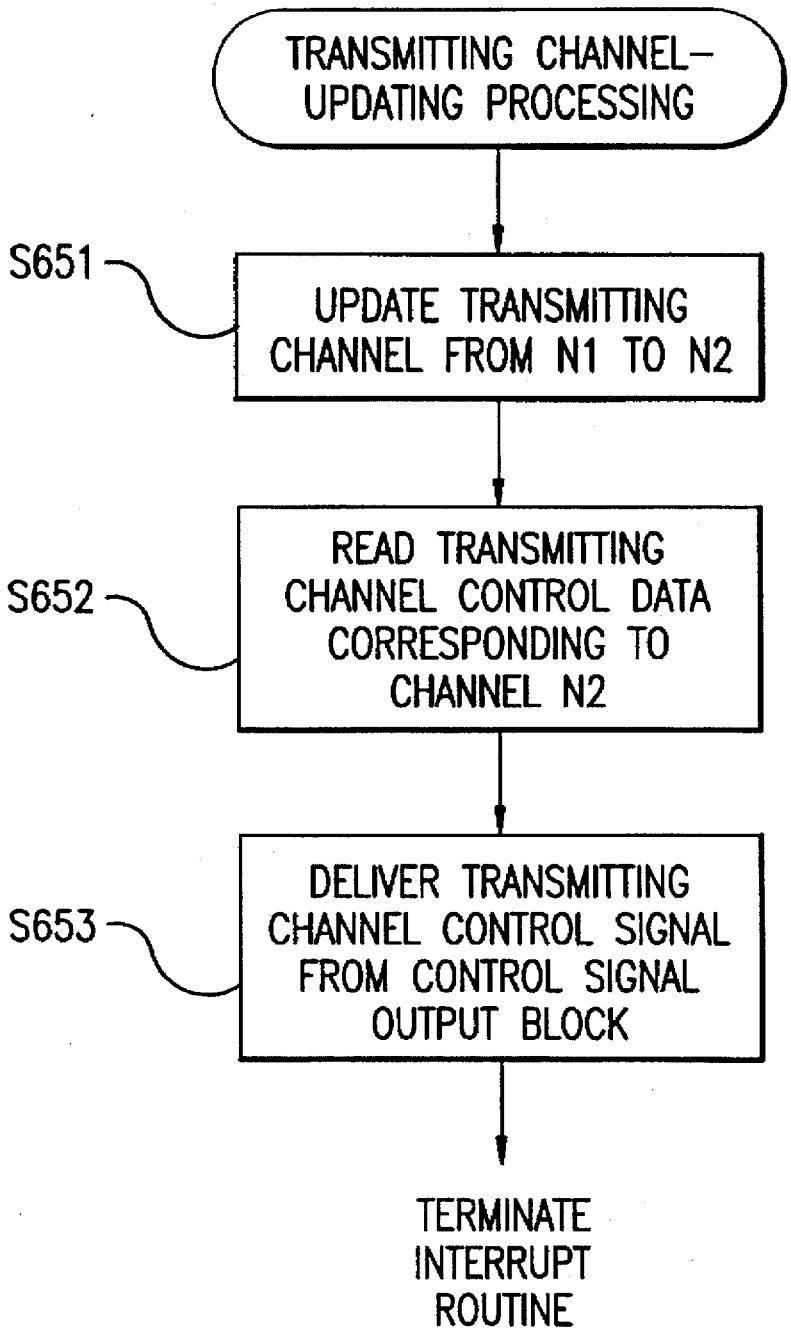
FIG. 27A is a flowchart of transmitting channel-updating processing executed by the FIG. 15 MIDI signal transmitter/receiver according to the fifth embodiment.
Figure 27B:
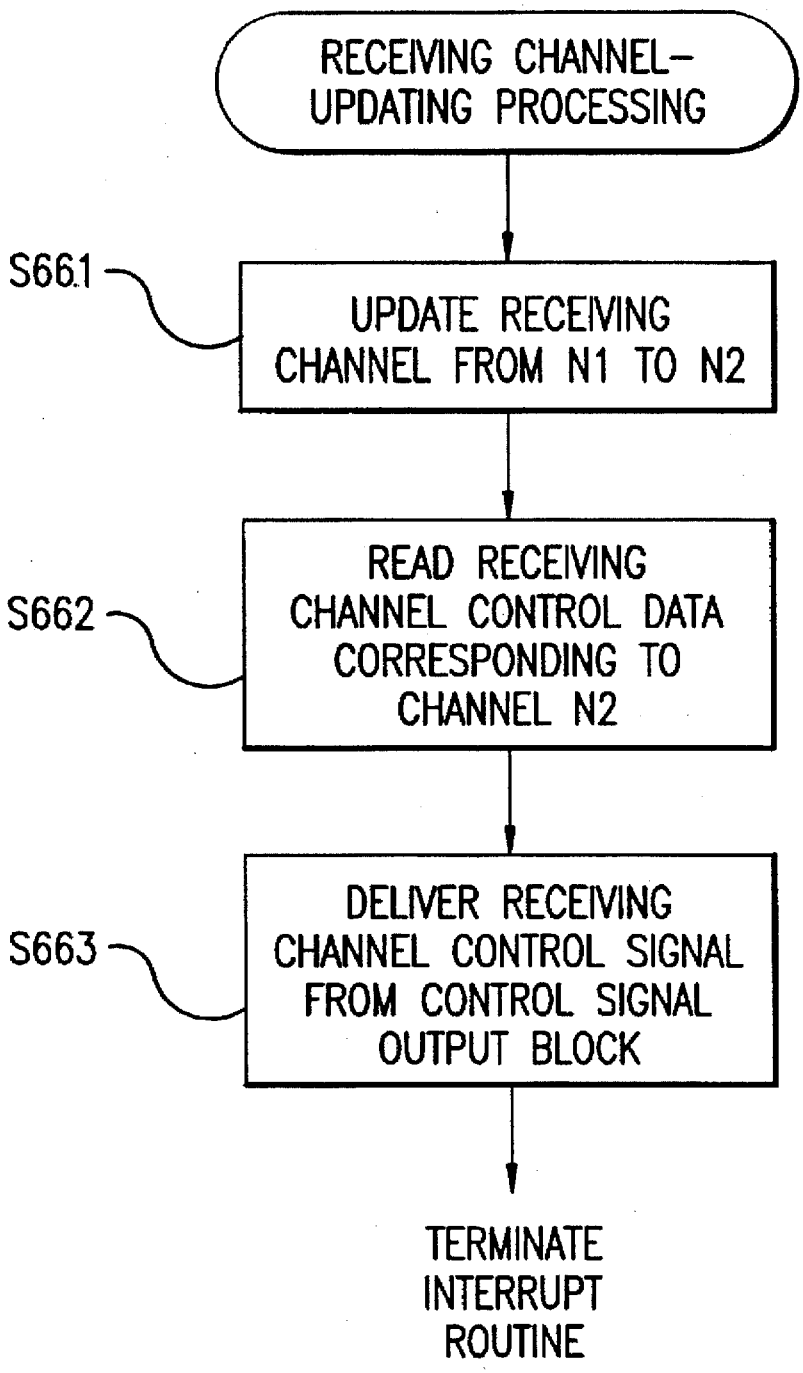
FIG. 27B is a flowchart of receiving channel-updating processing executed by the FIG. 15 MIDI signal transmitter/receiver according to the fifth embodiment.

Next, the transmitting channel-updating processing and the receiving channel-updating processing will be described with reference to FIG. 27A and FIG. 27B. These processings are carried out by interruption when the channel switch is operated.

First, the transmitting channel-updating processing will be described with reference to FIG. 27A. When the transmitting channel number is changed from N1 to N2 at a step S651, the transmitting channel control data corresponding to the transmitting channel N2 is read from the control data storage block 12 at a step S652. Then, the transmitting channel control signal based on the transmitting channel control data is delivered via the control single output block 16 to the transmitter/receiver block 18 at a step S653. This sets the first local oscillation frequency of the transmitter/receiver block 18, to place the transmitter/receiver block 18 in a standby state for transmission of data. This terminates the present processing, and the program returns to the main routine.

Next, the receiving channel-updating processing will be described with reference to FIG. 27B. This processing is distinguished from the transmitting channel-updating processing in that according to this processing, in the receiver mode, the receiving channel control data designated by the channel switch is delivered. When the receiving channel number is changed from N1 to N2 at a step S661, the receiving channel control data corresponding to the receiving channel N2 is read at a step S662, and the receiving channel control signal is delivered to the transmitter/receiver block 18 at a step S663. This sets the first local oscillation frequency of the transmitter/receiver block 18, to place the transmitter/receiver block 18 in a standby state. This terminates the present processing, and the program returns to the main routine.

Figure 28:
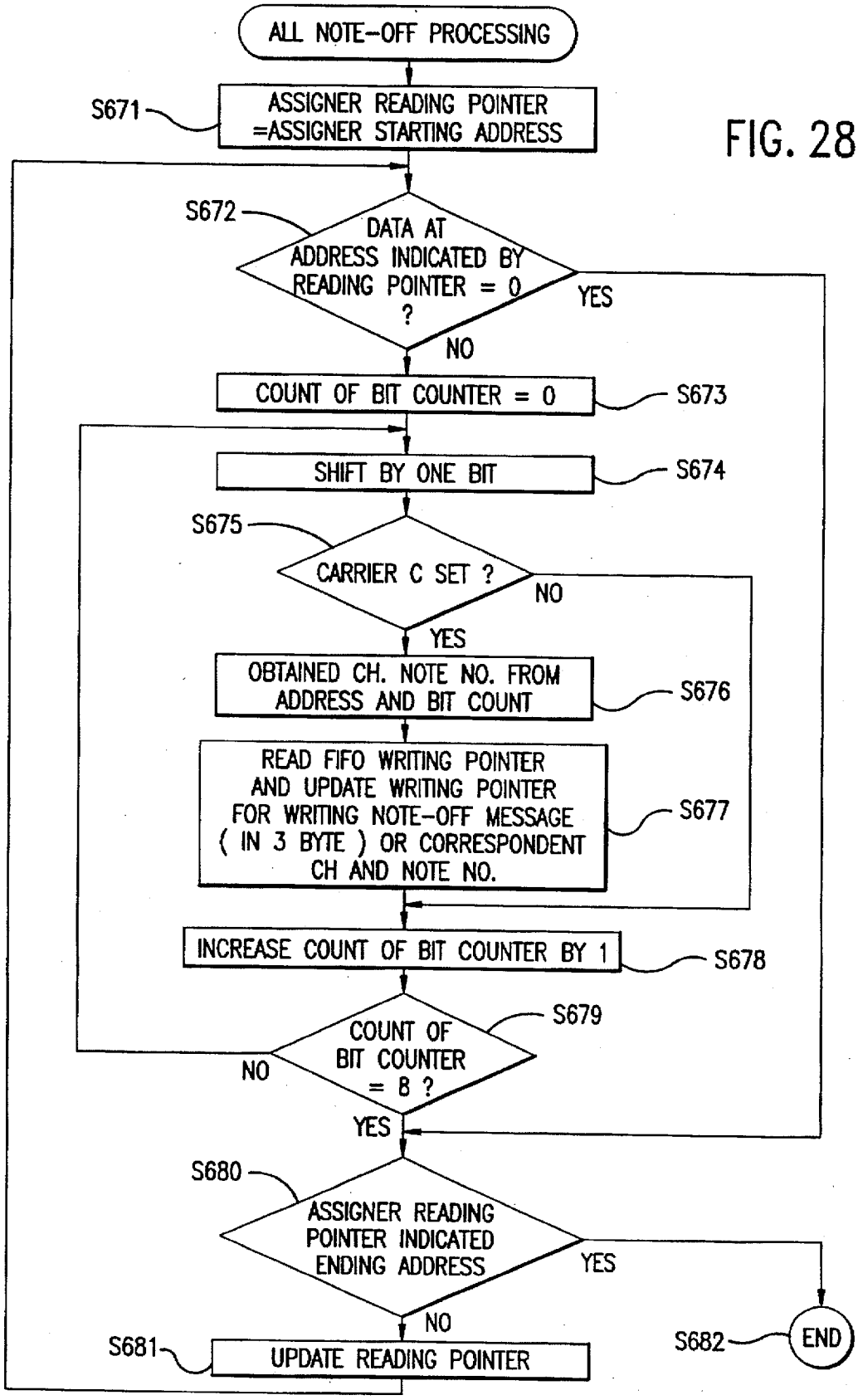
FIG. 28 is a flowchart of all note-off processing executed by the FIG. 15 MIDI signal transmitter/receiver according to the fifth embodiment.

Next, the aforementioned all note-off processing at the step S539 of the received data input interrupt processing in FIG. 19 will be described with reference to FIG. 28. In this processing, note numbers in MIDI channels, which are each set to a note-on status are searched for out of data written in the assigner 21. First, an assigner reading pointer is set to a starting address of the assigner 21 at a step S671. Then, it is determined at a step S672 whether or not data at the address indicated by the assigner reading pointer has a value of 0. If the answer to this questions affirmative (YES), the program jumps over to a step S680, whereas if the answer is negative (NO), a bit counter is set to a value of 0. The bit counter is provided for checking all data areas of the assigner 21 bit by bit as to whether a value of 1 is written therein, and indicates a bit address value of the address for each byte of data which is indicated by the assigner reading pointer.

Next, data of the address indicated by the reading pointer is shifted by one bit at a step S874, and it is determined at a step S675 whether or not a carrier C is set, i.e. whether or not a note-on status is set. If the answer to this question is affirmative (YES), it is determined that the data is note-on data, and then from the value of the address pointer and the count of the bit counter, the channel number of the MIDI data and the note number set to a note-on status in the channel are calculated at a step S676. Then, the writing pointer value of the FIFO of the transfer data temporary storage block 15 is read out, and a note-off message (3-byte data) for the note number in the MIDI channel and is written into the address of the FIFO indicated by the writing pointer, followed by updating the writing pointer at a step S677. Thus, the note-off data delivered to the tone generator via the MIDI data output block 20 is written into the transfer data temporary storage block 15.

Next, the count of the bit counter is increased by one at a step S678, and then it is determined at a step S679 whether or not the count is equal to 8. If it is determined that the count is not equal to a value of 8, the program returns to the step S674. If the answer to the question of the step S679 is affirmative (YES), which means that checking of one byte (note number) is completed, and then it is determined at a step S680 whether or not the reading pointer of the assigner 21 agrees with the ending address thereof. If the answer to this question is negative (NO), the reading pointer is updated at a step S681, and the program jumps over to the step S672. This procedure is repeatedly carried out until the reading pointer of the assigner agrees with the ending address. If the answer to the question of the step S680 is affirmative, the present program is terminated at a step S682. Thus, the note-off data for all note-on data written in the assigner 21 are written into the FIFO of the transfer data temporary storage block 15, which are sequentially delivered via the MIDI data output block 20 to the tone generator.

As described above, according to the present embodiment, when MIDI data is written into the transfer data temporary storage block 15 at a rate faster than MIDI data is read therefrom, and due to successive delivery of note-on/note-off data in a short time period, the free area of the FIFO becomes smaller than a predetermined value, the CPU 11 writes all note-off data ("FEh") into the FIFO of the transfer data temporary storage block 15, and the note-off data is sent via the transmitter/receiver block 18 to the remote keyboard 2. Then, the remote keyboard 2 having received all note-off data searches for all note-on data written in the assigner 21, and writes note-off data for the note numbers of the note-on data into the transfer data temporary storage block 15. Then, the note-off data is delivered to the tone generator, whereby setting all the tones being generated to note-off status. As a result, it is possible to prevent the tones from continuously being generate.

In the present embodiment, the active sensing data (FEh in MIDI standards) is not transmitted and received between units of the transmitter/receiver 305, but a squelch signal can substitute for the active sensing data. That is, the remote transmitter/receiver 305 having received the note-on data via the radio signal can turn off all the notes being in note-on statuses, judging that there is a disconnection in the radio circuit, when the transmitter/receiver block 18 thereof does not deliver a squelch signal within a predetermined time period (e.g. 300 msec.), in other words, when the transmitter/receiver block 18 does not receive a signal over the predetermined time period.

Next, a MIDI data transmitter/receiver according to a sixth embodiment of the invention will be described with reference to FIG. 29 to FIG. 32.

The MIDI data transmitter/receiver can be applied to the MIDI instrument system shown in FIG. 1. The construction of the system is described in detail in the first embodiment, and hence description thereof is omitted.

Figure 29:
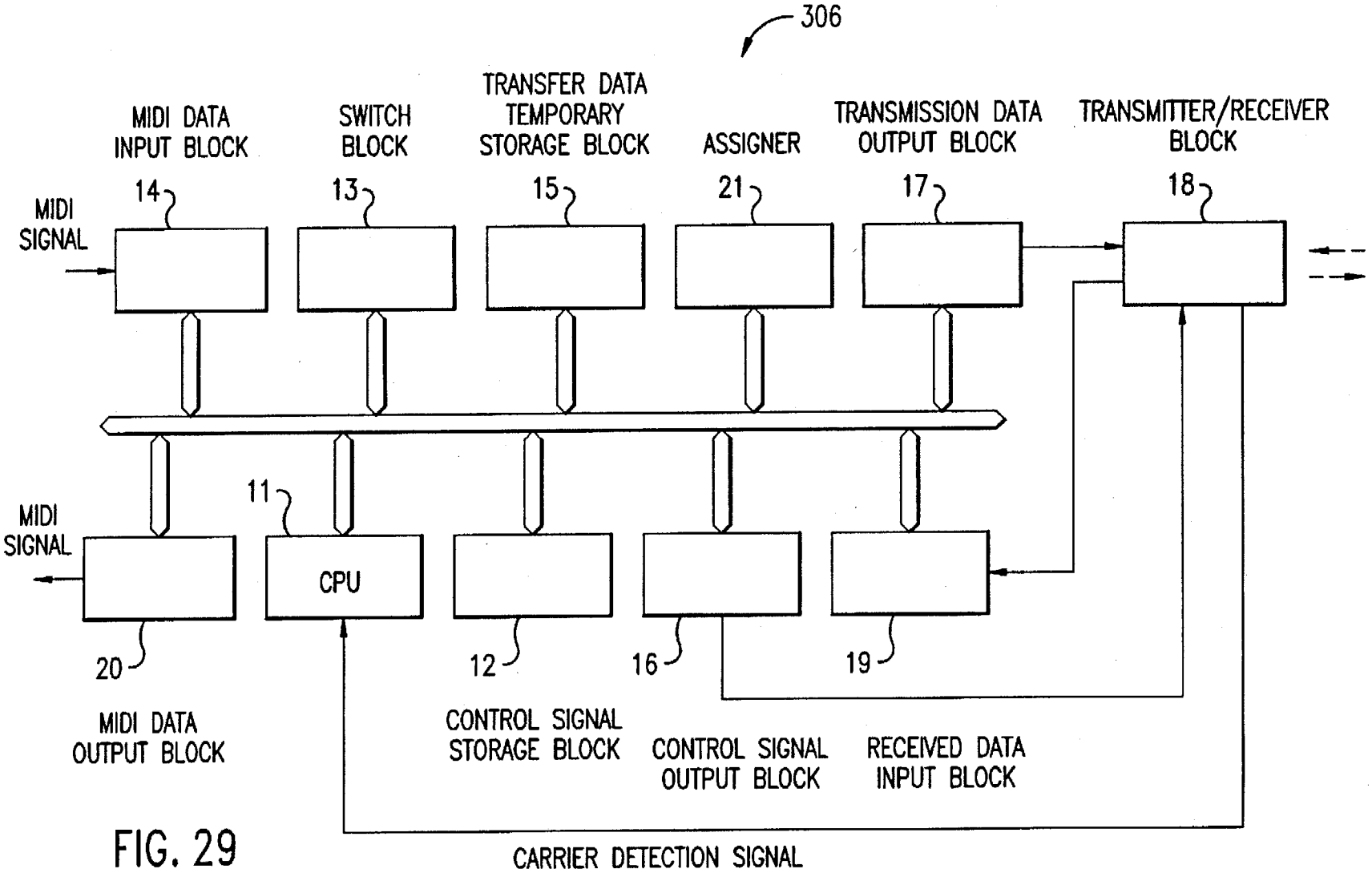
FIG. 29 is a block diagram showing the whole arrangement of a MIDI data transmitter/receiver according to a sixth embodiment of the invention.

As shown in FIG. 29, a MIDI data transmitter/receiver 306 of the present embodiment is distinguished from the first embodiment shown in FIG. 2 in that a line for sending a carrier-detection signal from the transmitter/receiver block 18 to the CPU 11 is additionally provided, and component elements corresponding to those of the first embodiment are indicated by the same reference numerals, and detailed description thereof is omitted.

In the present embodiment, the CPU 11 controls the overall operation of the transmitter/receiver 306. More specifically, it performs control concerning search for a free channel, described hereinafter, detection of an on/off status of each switch, not shown, of the switch block 13, input/output control of MIDI data delivered to or received from the keyboard 2, writing of received MIDI data into the transfer data temporary storage block 15 and reading the same therefrom, writing of the MIDI data into the assigner 21 and deleting and detection of the MIDI data therein, as well as transmission/reception changeover control, control of transmitting/receiving frequencies, transfer control of transmission and reception data, for the transmitter/receiver block 18, and so forth.

The switch block 13 includes the transmitter mode switch, the automatic changeover mode switch, the performance mode switch, and the channel switch, none of which are shown. Each switch has the same function as described in the first embodiment, and hence detailed description thereof is omitted.

Figure 30:
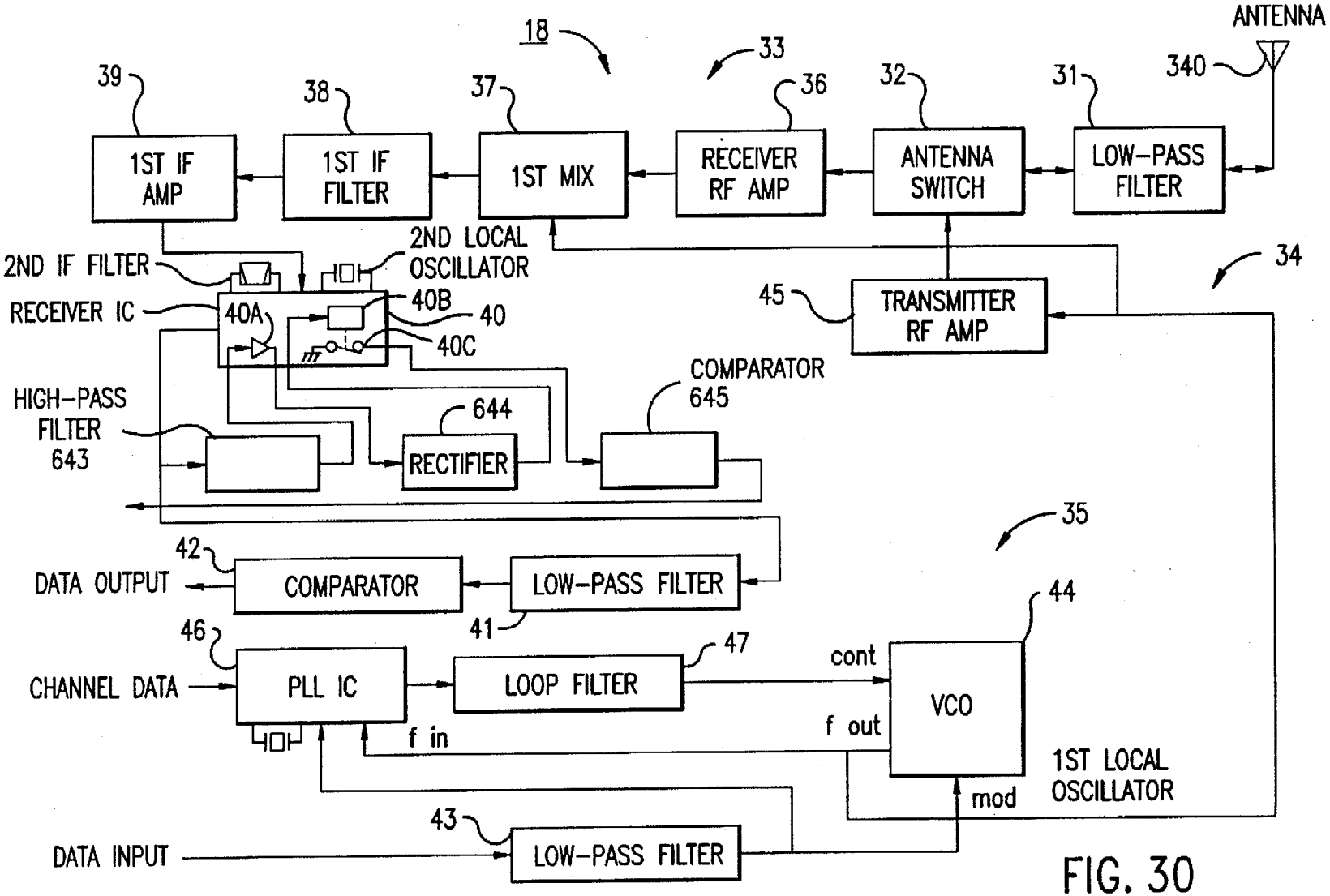
FIG. 30 is a block diagram showing a transmitter/receiver block appearing in the FIG. 29 MIDI data transmitter/receiver according to the sixth embodiment.

Next, the arrangement of the transmitter/receiver bock 18 will be described with reference to FIG. 30. In this connection, the component elements corresponding to those of the sixth embodiment are designated by the same reference numerals.

The transmitter/receiver block 18 is, though not particularly limited, an FM transmitter/receiver having a transmitting/receiving frequency hand of 430 MHz, a transmittting output power of 10 mW, and 40 channels of transmitting/receiving channels including one control channel. As shown in the figure, the transmitter/receiver block 18 is comprised of a low-pass filter 31 for removing undesired waves, the antenna switch 32 for changeover of transmission and reception, the receiver block 33, the transmitter block 34, and the first local oscillator 35.

The receiver block 33 is comprised of the receiver RF amplifier 36 for amplifying a received radio signal by a predetermined gain, a first mixer 37 for mixing the first local oscillation signal delivered from the (Voltage Controlled Oscillator) 47 with the radio signal to from an intermediate frequency signal (IF signal), a first IF filter 38 formed of a crystal filter, a first IF amplifier 39 for amplifying the IF signal by a predetermined gain, a receiver IC 40 for amplifying the IF signal by an amplifier incorporated therein, then mixing the resulting IF signal with a second local oscillation signal from a second local oscillator incorporated therein, and demodulating the resulting signal into a low-frequency signal by quadrature detection, a low-pass filter 41 for filtering out the low-frequency signal, and a comparator 42 for shaping the detected low-frequency signal into MIDI data.

Further, the receiver block 33 includes a carrier detection circuit for use in searching for a free channel. The carrier detection circuit is comprised of the receiver IC 40, a high-pass filter 643, a rectifier 644, and a comparator 645.

This circuit filters out noise alone from the low-frequency signal from the receiving IC 40, amplifies the noise with an amplifier 40*a* incorporated in the receiving IC and rectifies the resulting noise. The DC voltage obtained by rectification starts a squelch trigger circuit 40*b* to operate a squelch switch 40*c* whereby a squelch signal is generated. The comparator 645 responsive to the squelch signal delivers a carrier detection signal to the CPU 11. That is, the comparator delivers carrier data (low-level signal) since the noise level of a receiving channel is low when the receiving channel is used, whereas it delivers no carrier data (high-level signal) since the noise level of the receiving channel is high when the receiving channel is free or not used.

The transmitter block 34 is comprised of the low-pass filter 43 for limiting a frequency band of the MIDI data as a transmitting data signal delivered from the transmission data output block 17, the VCO 44 which forms part of the first local oscillator 35 and serves a modulating block, and the transmitter RF amplifier 45 which amplifies the radio signal prepared by modulation by the VCO 44.

The first local oscillator 35 is commonly used as a channel oscillator by the receiver block 33 and the transmitter block 34, and is comprised of the aforementioned VCO 44, the PLL (Phase Locked Loop) IC 46 provided with the reference oscillation block 49*a* for controlling oscillation of the VCO 44, and the loop filter 47 for smoothing oscillation control voltage delivered from the PLL IC 46. The CPU 11 causes the control signal output block 16 to deliver channel data to the PLL IC 46 to thereby set a frequency of the transmitting/receiving channel.

Next, an outline of the operation of the transmitter/receiver 306 will be described separately for the automatic changeover mode and the manual mode.

In the automatic changeover mode, the transmitter/receiver 306 is normally set to the receiver mode, whereby it is in a standby state in which a MIDI data can be received via the MIDI data input block 14 from the keyboard (main part) 2, and MIDI data via the transmitter/receiver block 18 from the remote keyboard 2. In the standby state, when the MIDI signal is received via the data input block 14 from the keyboard (main part) 2, a free channel-detecting processing is carried out. When the free channel is detected, the transmitter/receiver block 13 is automatically set to the transmitter mode, to thereby transmit the MIDI signal received via the transmission data output block 17 and the transmitter/receiver block 18 to the other keyboard 2. On the other hand, when the MIDI signal is received via the transmitter/receiver block 18 and the received data input block 19 from the remote keyboard 2, in the standby state, the receiving channel of the transmitter/receive block 18 is set to a receiving frequency corresponding to the free channel, and the MIDI signal received from the other keyboard 2 is delivered via the MIDI data output block 20 to the keyboard (main part) 2.

In the manual mode, it is possible to select one of the transmitter mode and the receiver mode in an alternative manner. More specifically, in the manual mode, the keyboard 2 can be fixedly used as either the performance device or the tone generator. When the transmitter mode switch is turned on in the manual mode, the transmitter/receiver 3 is set to the transmitter mode. When MIDI data is received thereafter via the MIDI data input block 14 from the keyboard (main part) 2, the free channel-detecting processing is carried out as described above, and then the free channel is used to transmit the MIDI data the remote keyboard 2. On the other hand, when the receiver mode switch has been turned on, the transmitter/receiver 3 is set to the receiver mode with the receiving channel being set to the free channel, and when MIDI data is received via the transmitter/receiver block 18 and the received data input block 19 from the remote keyboard 2, the receiving channel is changed to the free channel, whereby the MIDI signal is delivered via the MIDI data output block 20 to the keyboard (main part) 2.

Figure 31A:
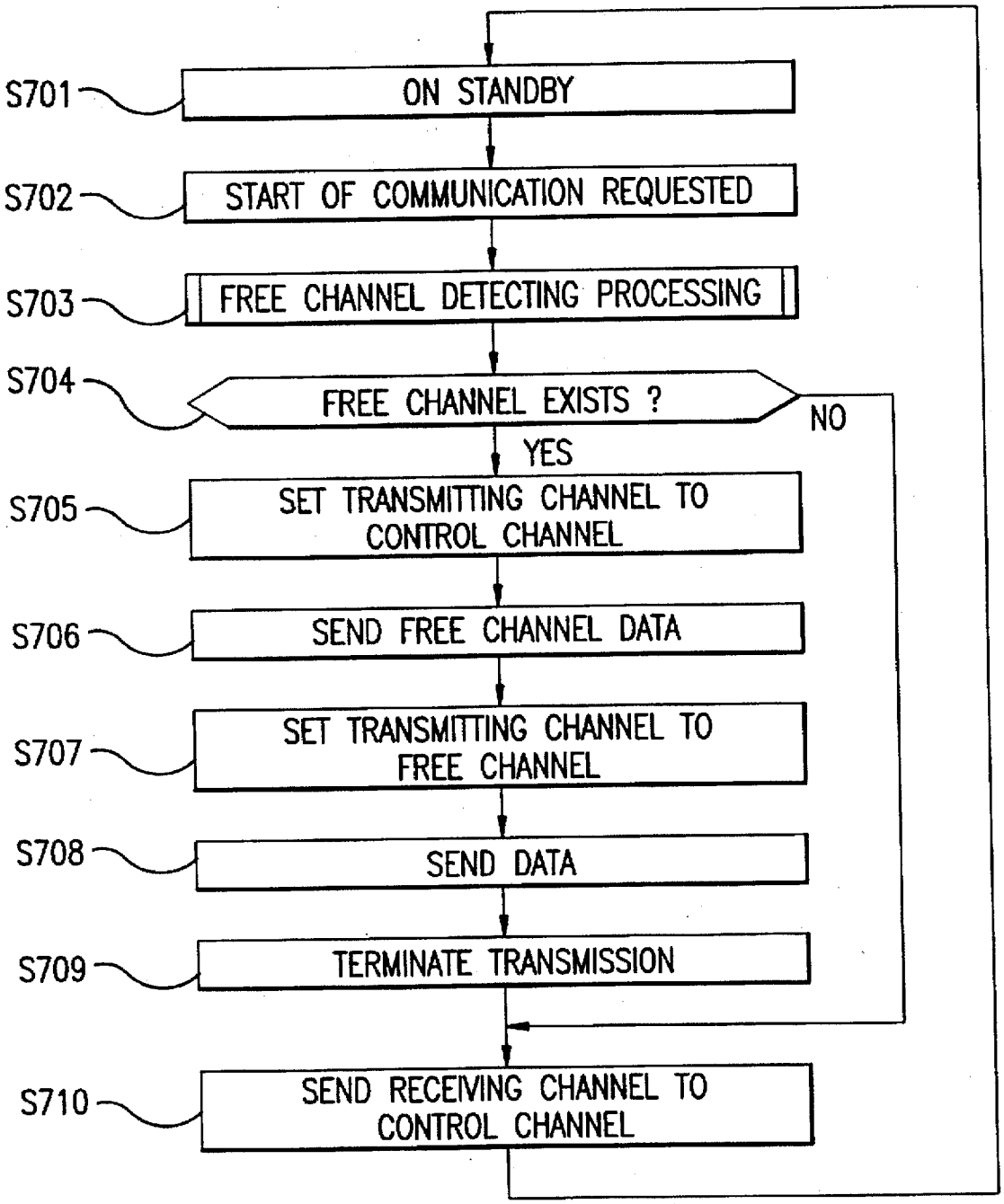
FIG. 31A is a flowchart of control processing executed by the FIG. 29 MIDI data transmitter/receiver device according to the sixth embodiment during transmission of data.
Figure 31B:
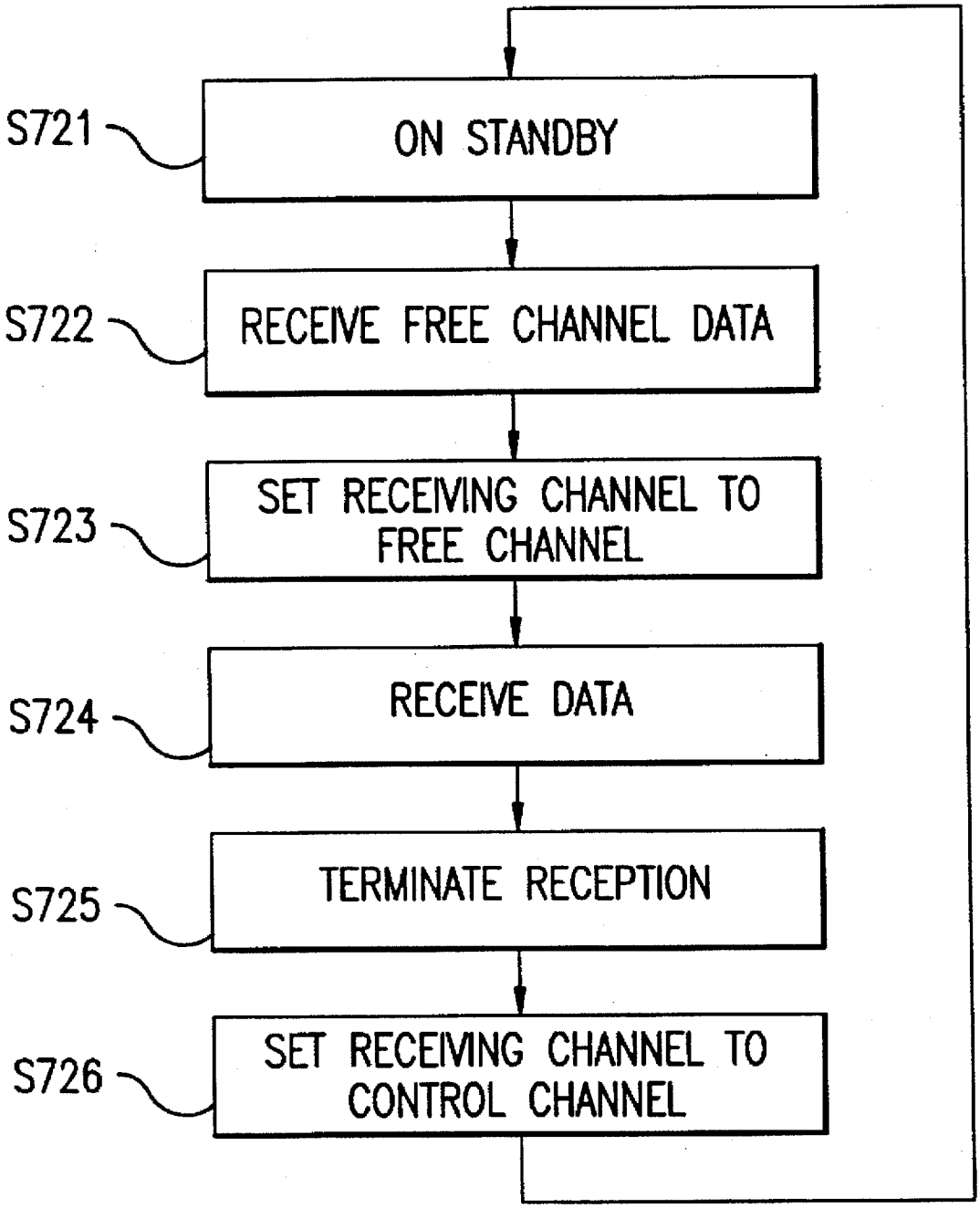
FIG. 31B is a flowchart or control processing executed by the FIG. 29 MIDI data transmitter/receiver according to the sixth embodiment during reception of data.
Figure 32:
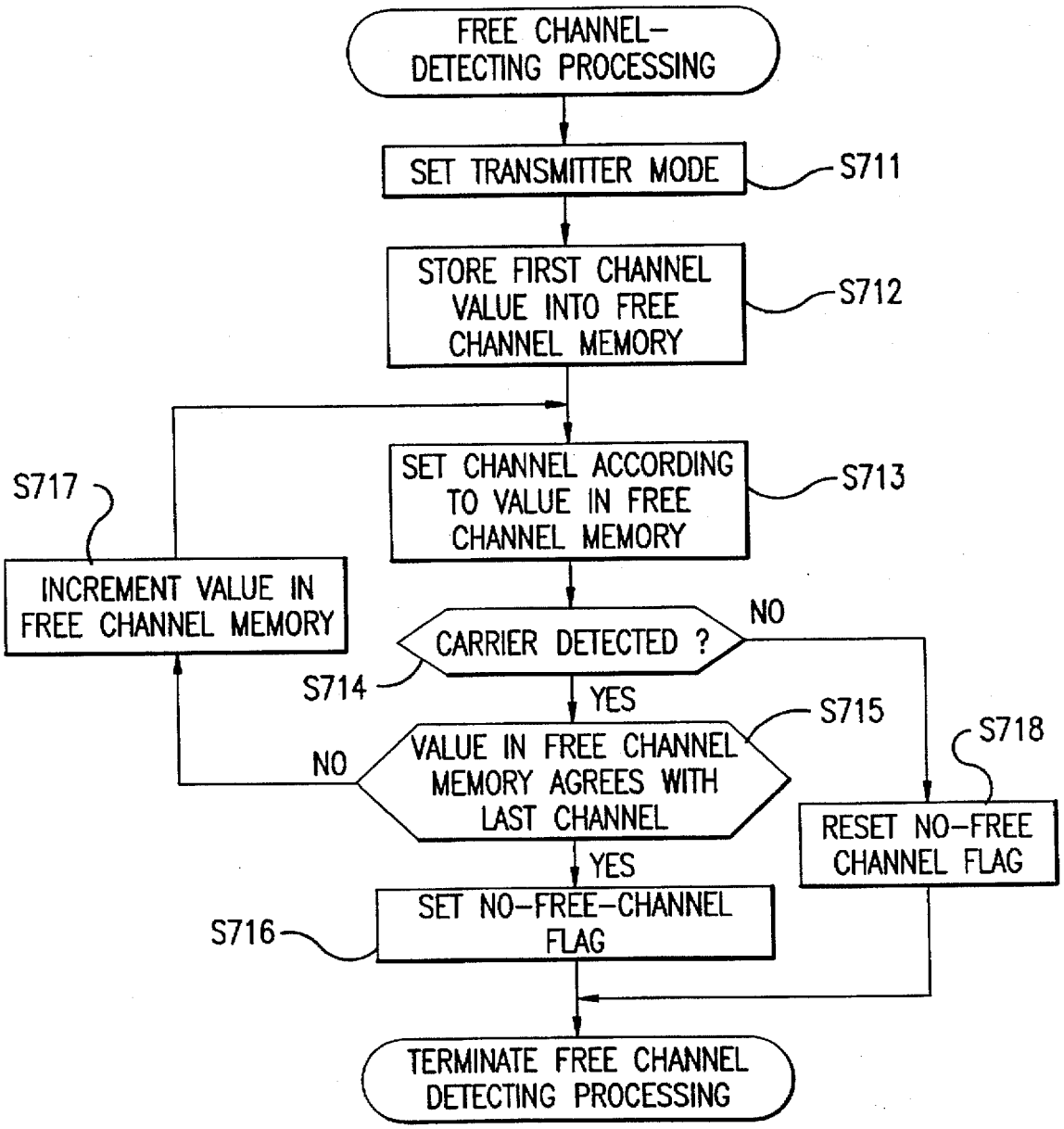
FIG. 32 is a flowchart of unused channel-detecting processing executed by the FIG. 29 MIDI data transmitter/receiver device according to the sixth embodiment.

Next, the operation of the transmitter/receiver 306 for transmitting and receiving MIDI data-will be described with reference to FIG. 31A, FIG. 31B, and FIG. 32. The processings described hereafter are carried out by the CPU 11.

First, the processing carried out by the transmttter/receiver 306 for transmitting MIDI data to a remote transmitter/receiver 306 will be described with reference to FIG. 31A. The transmitter/receiver 306 is usually on standby at a step S701, and when request of start of communication occurs at a step S702, the free channel-detecting processing is carried at a step S703. The request of start of communication is automatically recognized by the CPU 11 when the transmitter/receiver 306 receives the MIDI data delivered from the keyboard 2 connected thereto. The free channel-detecting processing will be described in detail hereinbelow.

Next, it is determined at a step S704 whether or not a free channel is detected. If the answer to this question is affirmative (YES), control channel data and a transmission control signal are delivered from the control signal output block 16 to the transmitter/receiver block 18, thereby setting the transmitter/receiver block 18 to the transmitter mode and at the same time setting the transmitting channel to the control channel at a step S705. Then, data of the free channel detected is delivered from the transmission data output block 17 to the transmitter/receiver 18, thereby transmitting the data of the free channel (free channel data) detected, at a step S706.

Then, channel data corresponding to the free channel is delivered from the control signal output block 12 to the transmitter/receiver 18, thereby changing the transmitting channel of the transmitter/receiver block 18 to the free channel at a step S707. Thereafter, MIDI data is transmitted from the transmission data output block 17 to the transmitter/receiver block 18, thereby transmitting the data to the remote keyboard 2 at a step S708. Thus, the transmission of the MIDI data is completed at a step S709. Then, the channel data corresponding to the control channel and a reception control signal are delivered from the control signal output block 16 to the transmitter/receiver block 18, thereby setting the transmitter/receiver block 18 to the receiver mode, and at the same time setting the receiving channel to the control channel to make the transmitter/receiver block 18 on standby, at a step S710.

Further, if no free channel is detected at the step S704, the transmitter/receiver block 18 does not carry out transmission of the MIDI data, and the program proceeds to the step S710 to make the transmitter/receiver block 18 on standby in the receiver mode.

Next, the aforementioned free channel-detecting processing will be described with reference to FIG. 32. First, at a step S711, the transmission control signal is delivered from the control signal output block 16 to set the transmitter/receiver 18 to the receiver mode at a step S711. Then, a value is stored into a free channel memory incorporated in the CPU 11 to indicate a first channel, at a step S712. Then, the receiving channel is set correspondingly to the value stored in the free channel memory at a step S713. That is, channel data corresponding to a value of the free channel memory is delivered from the control signal output block 16, thereby setting the transmitter/receiver block 18 to a receiving channel having the smallest channel number.

Next, it is determined at a step S714 whether or not the transmitter/receiver block 18 delivers the aforementioned carrier data. If the answer to this question is affirmative (YES), it is determined at a step S715 whether or not the value written in the free channel memory agrees with the final channel number, i.e. whether the channel being checked is the last channel to be checked. If the answer to this question is affirmative (YES), a no-free-channel flag is set at a step S716, followed by terminating the program.

If the answer to the question of the step S715 is negative (NO), the program proceeds to a step S717 where the value in the free channel memory is incremented by one, and then the program proceeds to the step S713. That is, it is determined channel by channel whether a carrier is detected, and this processing is continued until a free channel is detected, or until all the channels are checked.

Further, if the answer to the question of the step S714 is negative (NO), the no-free-channel flag is reset at a step S718. So long as the no-free-channel flag is not set, it means that there is a free channel detected and the value written in the free channel memory indicates the number of the channel which is free.

Next, the processing carried out by the transmitter/receiver 306 for receiving MIDI data will be described with reference to FIG. 31B. The transmitter/receiver 306 is usually on standby for receiving data via the control channel at a step S721, whereby the CPU 11 monitors the outputting of received data from the transmitter/receiver block 18 via the received data input block 19, thereby checking for reception of free channel data. When the free channel data is received at a step S722, channel data corresponding to the free channel data is delivered via the control signal output block 16 to the transmitter/receiver 18, thereby changing the receiving channel of the transmitter/receiver block 18 at a step S723. Then, MIDI data is received at a step S724, and when the reception of the MIDI data is completed at a step S725, channel data corresponding to the control channel is delivered from the control signal output block 16 to the transmitter/receiver 18 thereby changing the receiving channel to the control channel at a step S726.

As described above, according to the present embodiment, the transmitter/receiver 306 automatically carries out the free channel-detecting processing and changes the transmitting channel to a free channel, upon reception of request of start of communication, irrespective of whether the transmitter/receiver 306 is in the automatic changeover mode or in the manual mode. Therefore, it is possible to transmit MIDI data more promptly compared with a conventional transmitter/receiver which each time requires operating the channel switch to search for a free channel. Further, the receiving channel of the transmitter/receiver 306 on the receiving side is automatically changed to the free channel, which makes it unnecessary for a user or operator to take the trouble of going to a place where the remote transmitter/receiver 306 is installed to thereby change the receiving channel.

In addition, in transmitting the free channel data, by adding a unit number of a remote transmitter/receiver to which the free channel data is transmitted, it is possible to send MIDI data only to the remote transmitter having the unit number alone. Further, the free channel-detecting processing can be repeatedly carried out several times until a free channel is detected. Further, prior to transmission of MIDI data, a free channel may be detected in advance. In this case, MIDI data can be transmitted even more promptly.

Next, a MIDI data transmitter and receiver according to a seventh embodiment of the invention will be described with reference to FIG. 33 to FIG. 53.

Figure 33:
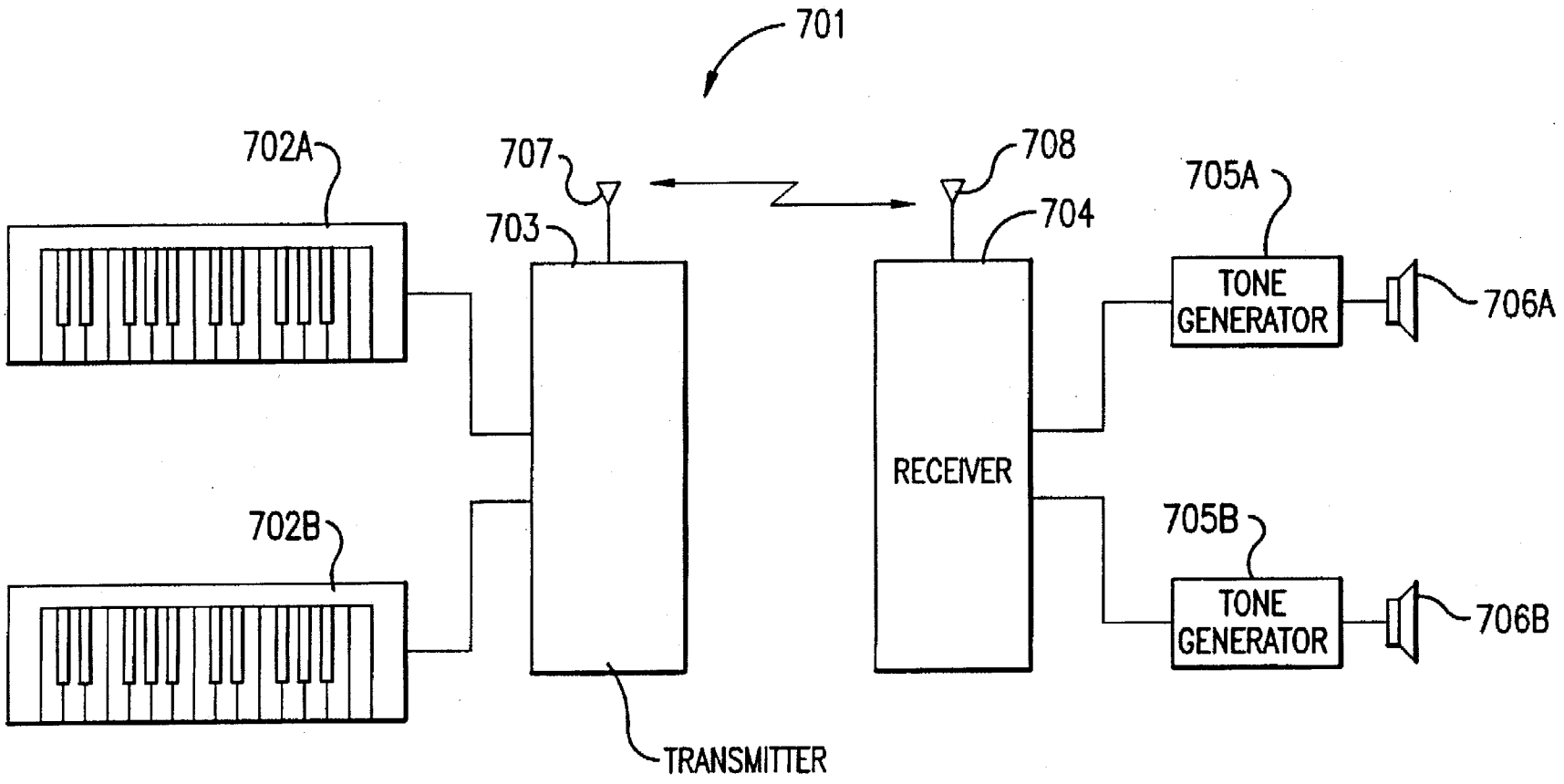
FIG. 33 is block diagram schematically showing a MIDI instrument system comprised of a transmitter and a receiver according to a seventh embodiment of the invention.

FIG. 33 shows MIDI instrument system 701 to which the MIDI data transmitter and receiver according to the invention is applied. As shown in FIG. 33, the MIDI instrument system 701 is comprised of two keyboards 702*a*, 702*b* (hereinafter each referred to as "the keyboard 702" when one is not discriminated from the other), a transmitter 703, a receiver 704, two tone generators 705*a*, 705*b* (hereinafter each referred to as "the tone generator 705" when one is not distinguished from the other), speakers 706*a*, 706*b* (hereinafter each referred to as "the speaker 706" when one is not discriminated from the other). Further, the transmitter 703 and the receiver 704 are equipped with antennas 707, 708, respectively.

In the MIDI instrument system 1, when the keyboards 702*a* and 702*b* having the unit numbers "a" and "b" are played, MIDI data delivered from the keyboard 702*a* is transmitted to the tone generator 705*a*, and MIDI data delivered from the keyboard 702*b* is transmitted to the tone generator 705*b*. As a result, the tone generators 705*a*, 705*b* generate tones corresponding to depressed keys of the keyboard 702*a*, 702*b*, respectively. More specifically, when each keyboard 702 is played, MIDI data is delivered to the transmitter 703. The transmitter 703 receives the MIDI data, and transmits a radio signal modulated by the MIDI data to the receiver 704. The receiver demodulates the radio signal into MIDI data, and delivers the resulting MIDI to each tone generator 705. The tone generators 705 delivers tone signals to the speakers 708.

Figure 34:
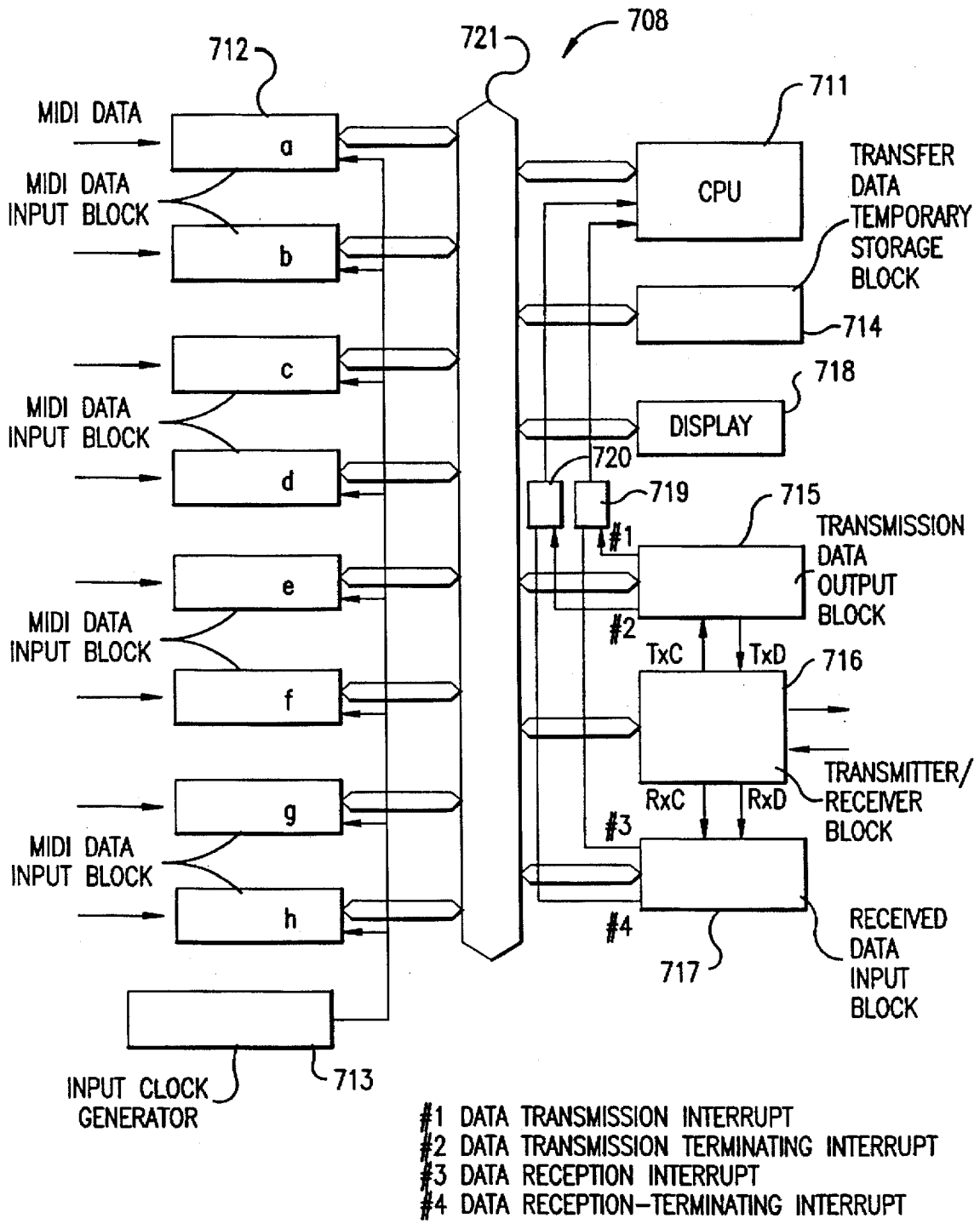
FIG. 34 is a block diagram showing the whole arrangement of the transmitter appearing in FIG. 33.

As Shown in FIG. 34, the transmitter 703 is comprised of a CPU 711, MIDI data input blocks 712*a* to 712*h* (hereinafter each referred to as "the MIDI data input block 712" when one is not discriminated from the others), an input clock generator 713 connected to the MIDI data input blocks 712*a* to 712*h* a transfer data temporary storage block 714, a transmitter/receiver block 716, a received data input block 717, and a display 718, all of which except the input clock generator 713 are connected to each other by a bus line 721. The CPU 711 is conducted via interrupt signal output blocks 719, 720 to the transmission data output block and the received data output block 717 by dedicated lines, for receiving various kinds of interrupt signals.

The CPU 711 performs transmission/reception changeover control of the transmitter/receiver block 716, and interrupt processing based on interrupt signals from the transmission data input block 715 and the received data input block 717, as well as MIDI data writing processing. In the MIDI data writing processing, the CPU 711 carries out writing of MIDI data input via the MIDI data input blocks 712*a* to 712*h* into the transfer data temporary storage block 714, writing of MIDI data stored in the transfer data temporary storage block 714 into the transmission data output block 715, and writing of MIDI data output from the received data input block 717 into the transfer data temporary storage block 714.

The MIDI data input blocks 712*a* to 712*h* can be connected to separate keyboards independently of each other, and in the present embodiment, the MIDI data input blocks 712*a* and 712*b* are connected to the keyboards 702*a* and 702*b*, respectively. The MIDI data input block 712 is an interface for receiving MIDI data asynchronously input thereto at a rate of 31.25 KHz, which receives MIDI data in a serial form by sampling, converts the same into data a parallel form, and delivers the data in the parallel form to the CPU 711 via the bus line 721.

The input clock generator 713 generates a sampling clock for enabling the MIDI data input block 712 to input MIDI data, and delivers the sampling clock to the MIDI data input blocks 712.

The transfer data temporary storage block 714 is comprised of a transmission data preparation buffer, a transmission data buffer, and a reception data buffer, none of which are shown. The transmission data preparation buffer stores transmission data. In this case, the transmission data is formed of data of a number or the MIDI data input block 712 to which the MIDI data is input, that is, a unit number of the keyboard 702 connected to the MIDI data input block 712 (e.g. "a"), and MIDI data (e.g. "F0h") received from the keyboard having the unit number. In this connection, the unit number is automatically added to the transmission data by the CPU 711. The transmission data buffer stores the transmission data transferred from the transmission data preparation buffer by the CPU 711, and the reception data buffer stores received data input form the received data input block 717.

The buffers each store data of "DATA number" which indicates storage of data by a number of data at a starting address thereof, and transmission data at subsequent addresses. The "DATA number" is written by the CPU 711 by timer T1 interrupt, described hereinafter.

The transmission data output block 715 once stores transmission data stored in the transmission data buffer of the transfer data temporary storage block 714 into an internal buffer, and converts the stored transmission data in a parallel form into transmission data in a serial form, to thereby deliver the resulting transmission data to the transmitter/receiver block 716 in a manner synchronous to a synchronizing clock signal, referred to hereinafter. The transmission data output block 715 delivers a data transmission interrupt signal (#1 in FIG. 33) to the CPU 11, when there is produced a free area in the internal buffer thereof. The CPU 11 responsive to the data transmission interrupt signal transfers transmission data stored in the transfer data temporary storage block 714 to the transfer data output block 715, for sequential storage therein. Further, the transmission data output block 715 adds a start code to a head of transmission data, and an error correction code and a stop code to a tail of the transmission data, before transmitting transmission data to the transmitter/receiver block 716.

Further, when the transmission data output block 715 has delivered all data to the transmitter/receiver block 716, it delivers a data transmission terminating interrupt signal (#2 in FIG. 33) indicative of delivery of all data to the transmitter/receiver block 716 to the CPU 711 via the interrupt signal output block 720, and then enters the standby state.

The transmitter/receiver block 716 is a transmitter/receiver based on a spread spectrum method of 2.4 GHz, which can modulate a carrier at a modulating rate of approximately 250 KHz. As a result, the transmitter/receiver block 716 modulates 8 systems of MIDI data serially input at a rate of 31.25 KHz in real time, and transmits the modulated radio signal.

The transmitter/receiver 716 incorporates an internal CPU, a ROM, etc. The internal CPU performs frequency control, synchronization control of spread code, and interface control between the transmission data output block 715 and the transmitter/receiver block 716. More specifically, the transmitter/receiver block 716 performs the following operations: When the start of transmission is requested by the CPU 711, the internal CPU carries out processing of start of transmission, and upon completion of transmission preparation, delivers a synchronizing clock signal (TXC) to the transmission data output block 715, thereby sequentially taking in transmission data (TXD) from the internal buffer of the transmission data output block 715. Then, the internal CPU delivers the transmission data to an internal modulator, whereby the/receiver block 716 performs spread modulation, and transmits a radio signal as a modulated spread signal via an antenna 707. Then, upon completion of transmission of the data, the internal CPU terminates transmission based on a transmission terminating signal delivered from the CPU 711.

Further, the internal CPU performs the reception start processing when a reception start signal is delivered from the CPU 11. Upon completion of preparation of reception, the internal CPU delivers a synchronizing clock signal (RXC) and received data (RXD) to the received data input block 717. When the CPU 711 delivers a reception terminating signal, the internal CPU carries out reception terminating processing to finish all kinds of reception processing.

The reception data input block 717 operates when the transmitter 703 operates as the transmitter, and stores transmission data received from the transmitter/receiver block 716. The received data input block 717 detects the start code, the error correction code, and the stop code from data received by the transmitter/receiver block 716, and stores the received data into the internal buffer, when the start signal is detected. Then, after storing all the received data into the internal buffer, the reception data input block 717 delivers a data reception interrupt signal (#3 in FIG. 33) via the interrupt signal output block 719 to the CPU 711. In response to the signal, the CPU 711 transfers the received data to the transfer data temporary storage block 714. Further, the received data input block 717 detects the error correction code and the stop code, and after determining whether or not an error has occurred, delivers a data reception terminating interrupt signal (#4 in FIG. 33) via the interrupt signal output block 720 to the CPU 711. This terminates data reception of the transmitter/receiver 716, and the received data input block 717 enters the standby state. In addition, the received data input block 717 automatically deletes the start code, the error correction code, and the stop code, and stores only received data which is necessary.

The display 718 displays contents of processing being executed, such as transmitting /receiving operations of the transmitter/receiver block 716, a reading operation of MIDI data from the MIDI data input block 712, and a reading operation of received data from the received data input block 717, and errors.

Figure 35:
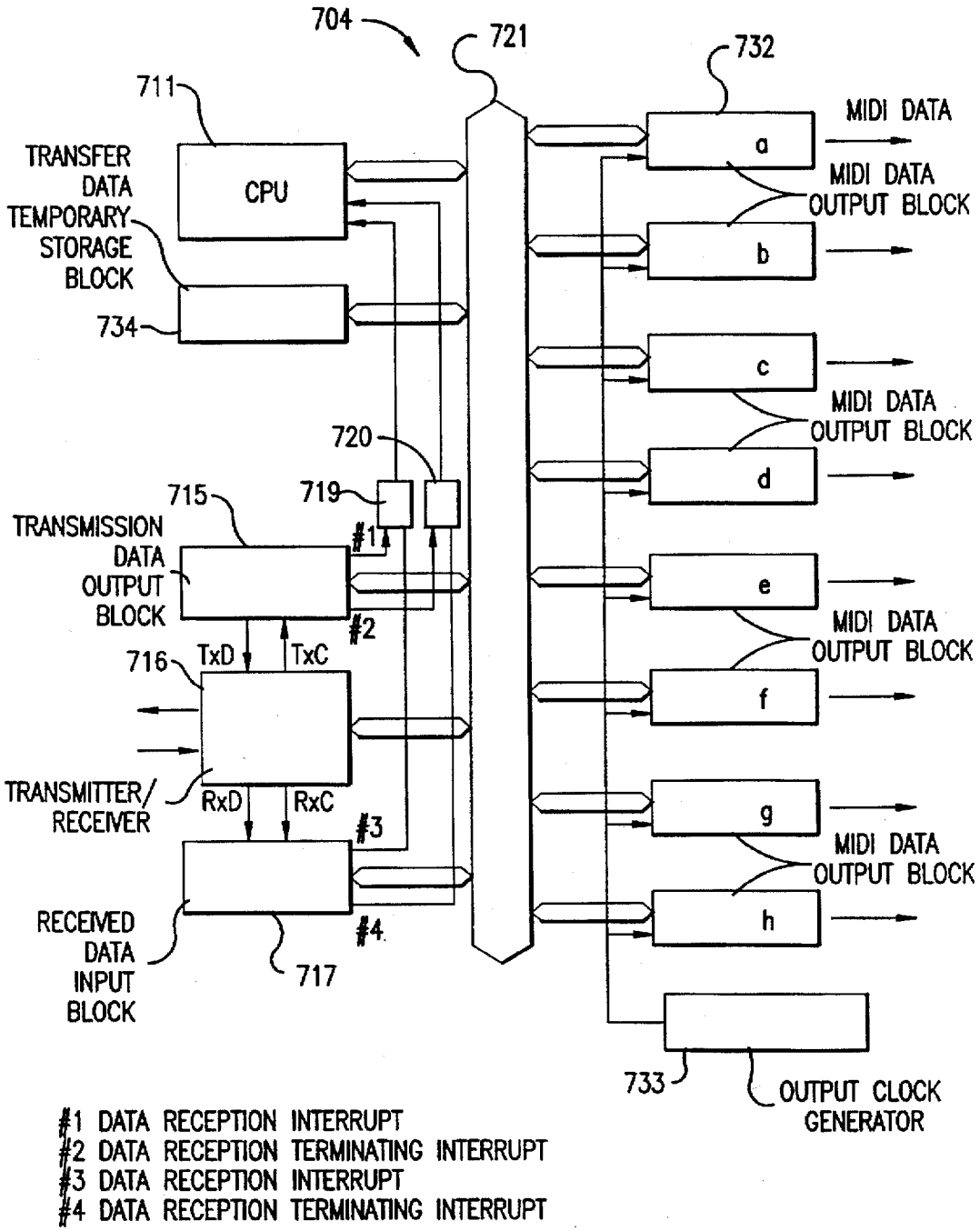
FIG. 35 is a block diagram showing the whole arrangement of the receiver appearing in FIG. 33.

Next, the arrangement of the receiver 704 will be described with reference to FIG. 35.

As shown in the figure, the receiver 704 is comprised of a CPU 711, MIDI data output blocks **732*a* to 732*h* (hereinafter each referred to as "the MIDI data output block 732" when one is not discriminated from another), and an output clock generator 733, a transfer data temporary storage block 734, a transmission data output block 715, a transmitter/receiver block 716, and a received data input block 717, all of which are connected to each other via a bus line 721. Further, the CPU 711 is connected to the transmission data output block 715 and the received data output block 717 via interrupt signal output blocks 719, 720 by dedicated lines, for receiving interrupt signals therefrom. Component elements of the receiver 704** which are identical in construction and operate similarly to those of the transmitter described above are designated by identical reference numerals, and detailed description thereof is omitted.

The MIDI data output blocks 732*a* to 732*h* can be connected to the tone generator 705, and in the present embodiment, the MIDI data output blocks 732*a* and 732*b* are connected to the tone generators 705*a* and 705*b*, respectively. The MIDI data output block 732 is an interface for delivering MIDI data asynchronously, which converts MIDI data in a parallel form stored in the transfer data temporary storage block 734 into data in a serial form, and delivers the resulting MIDI data in the serial form to the tone generators in synchronism with a synchronizing clock generated by the output clock generator 733.

The output clock generator 733 generates a synchronizing clock of 31.25 KHz, and delivers the same to the MIDI data output blocks 732.

The transfer data temporary storage block 734 is comprised of a reception data buffer, a reception data preparation buffer, a transmission data buffer, a NAK data buffer, and an ACK data buffer, none of which are shown. The reception data buffer stores received data received by the transmitter/receiver block 716, and the reception data preparation buffer stores the received data transferred by the CPU 711 from the reception data buffer for delivery to the MIDI data output block 732. In this case, the received data is formed of data of a unit number of the keyboard 702, i.e. a unit number (e.g. "a") of the tone generator 765 which forms a pair with the keyboard 702 having the unit number, and MIDI data to be transmitted to the tone generator having the unit number. Further, the CPU 711 writes "DATA number", if required, for answering the transmitter 703. Further, the NAK data buffer stores data of "NAK" which indicates that transmission data could not be received properly, and the ACK data buffer stores data of "ACK" which indicates that the transmission data was received properly.

Next, the processing carried out by the transmitter 703 will be described. The operations described below are executed by the CPU 711, unless otherwise specified.

Figure 36:
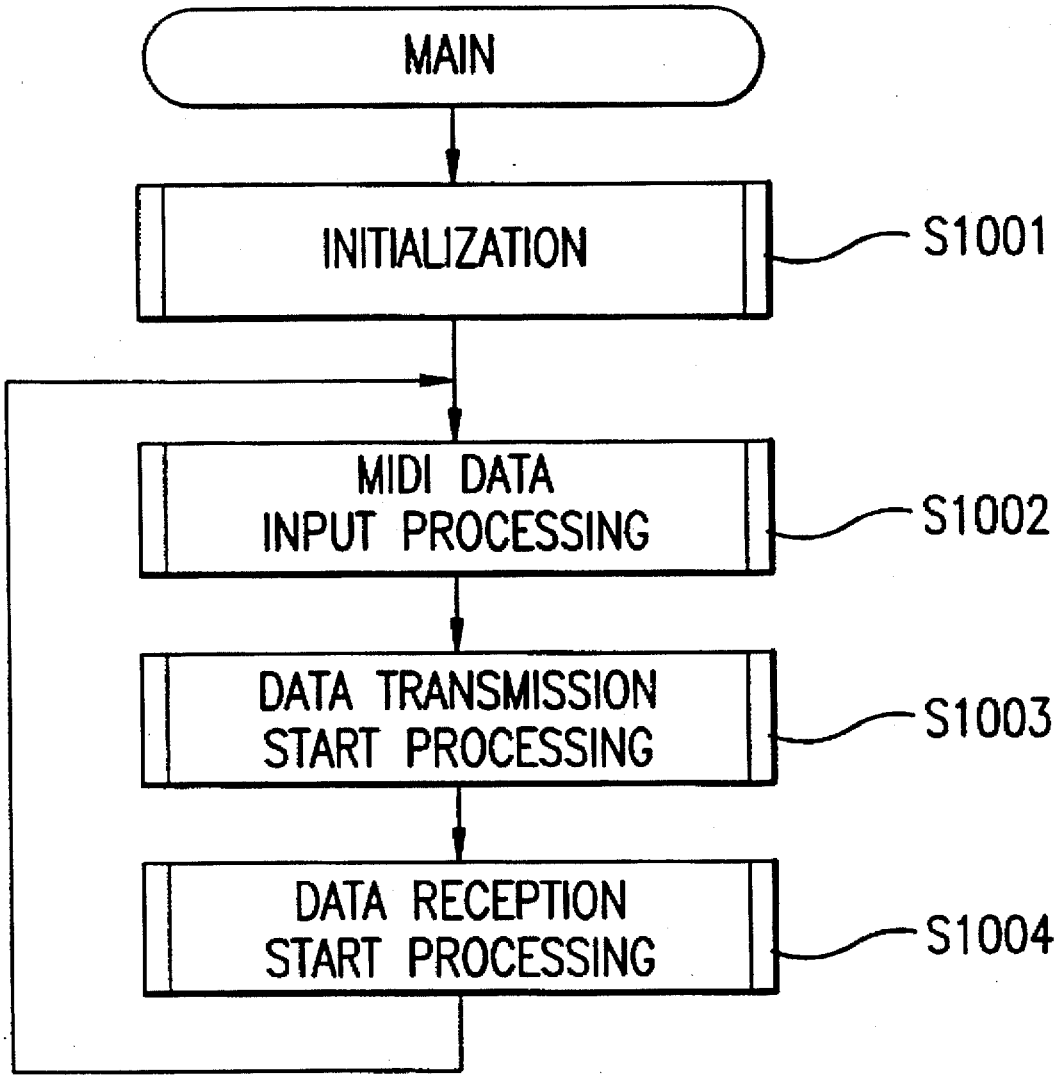
FIG. 36 is a flowchart of a main routine executed by the FIG. 34 transmitter.

First, a main processing of the transmitter will be described with reference to FIG. 36 to FIG. 40. As shown in FIG. 36, in this main processing, initialization is carried out at a step S1001 when the power is turned on. Then, MIDI data input processing, data transmission start processing, and data reception start processing are carried out at steps S1002, S1003, and S1004, respectively.

Figure 37:
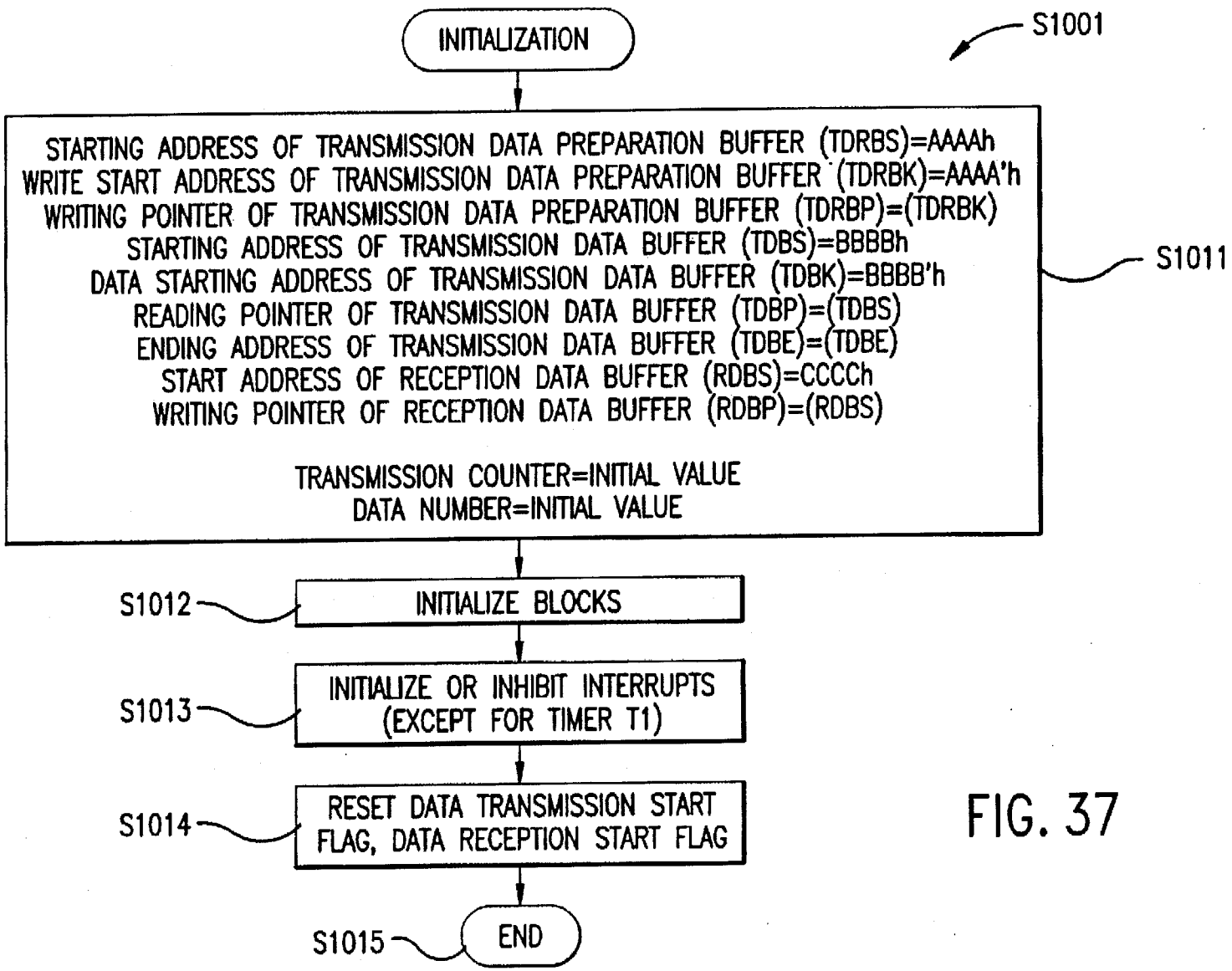
FIG. 37 is a flowchart of initialization processing executed by the FIG. 34 transmitter

At initialization (step S1001), as shown in FIG. 37, there are carried out at a step S1011 settings of starting addresses, write start addresses, writing pointers, etc. for the transmission preparation data buffer, the transmission data buffer, and the reception data buffer, of the transfer data temporary storage block 714. Then, blocks other than the transfer data temporary storage block 714 are initialized at a step S1012, and initialization and inhibition of various interrupts, referred to hereinafter, are carried out at a step S1013. In this connection, the timer T1 interrupt, described in detail hereinafter, is not inhibited. Next, a data transmission start flag and a data reception start flag are reset, followed by terminating the present program at a step S1015.

Figure 38:
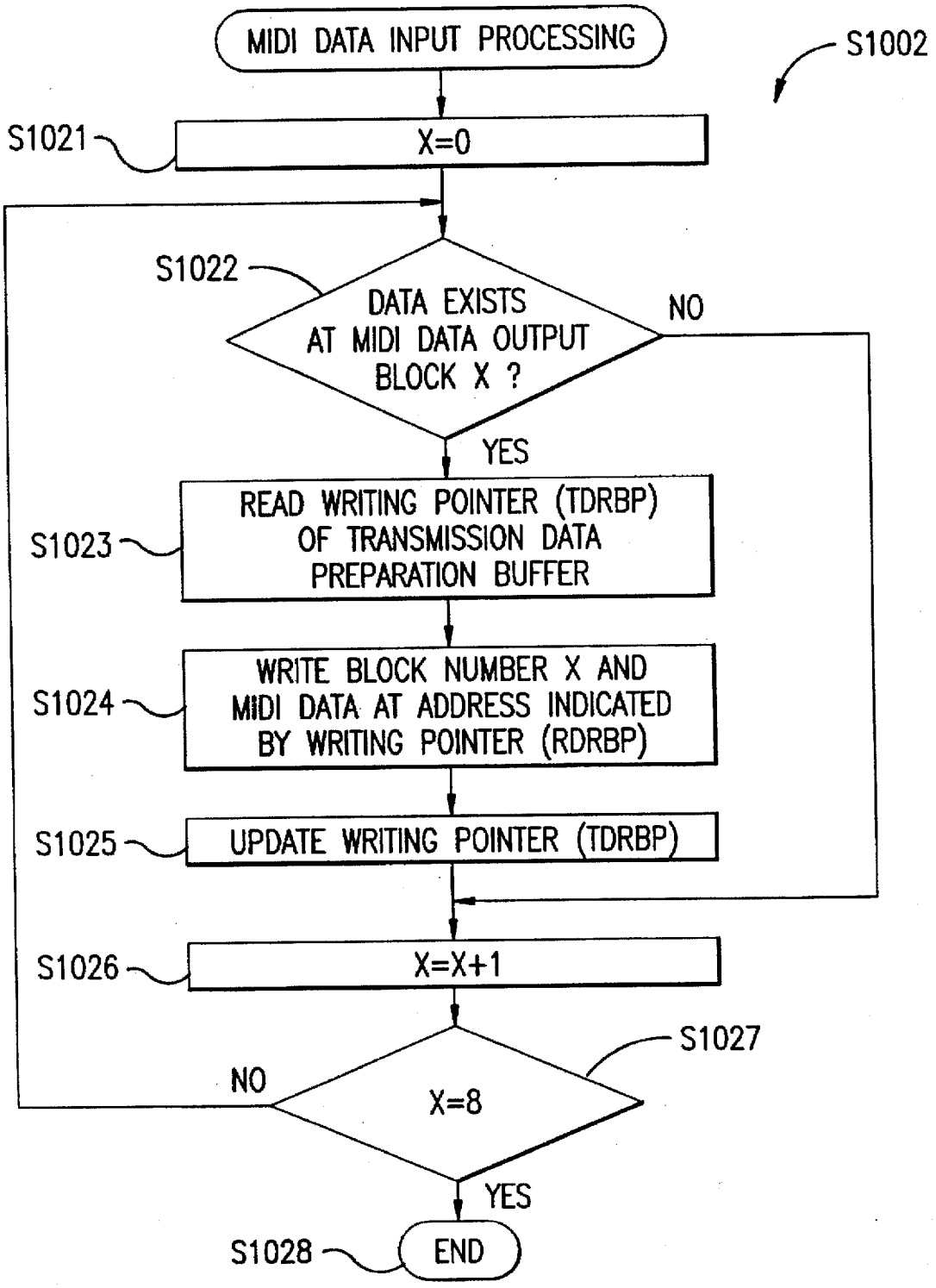
FIG. 38 is a flowchart of MIDI data input processing executed by the FIG. 34 transmitter.

According to the MIDI data input processing, MIDI data is input from the MIDI data input block 712. As shown in FIG. 38, a check is sequentially made for the MIDI data input blocks 712*a* to 712*h* as to whether or not MIDI data is received therefrom. First, the pointer is set to X=0 (a value of 0 to a value of 7 correspond to the MIDI data input blocks 712*a* to 712*h*, respectively) at a step S1021. Then, it is determined at a step S1022 whether or not MIDI data has been received from the MIDI data input block 712*a*. If the answer to the question is affirmative (YES), a value of the writing pointer of the transmission data preparation buffer of the transfer data temporary storage block 714 (address of the transmission data buffer at which MIDI data should be written) is read out at a step S1023.

Next, the unit number x (in the present case, "a") is written into the address indicated by the writing pointer and MIDI data is written into a subsequent address at a step S1024. Then, the writing pointer is updated at a step S1025. After incrementing the pointer X by one at a step S1026, it is determined at a step S1026 whether or not the pointer X is equal to 8. If the answer to the question is negative (NO), the program returns to the step S1022, whereas if the answer is affirmative (YES), the program is terminated at a step S1028. In addition, if the answer the question of the step S1022 is negative (NO), the program jumps over to the step S1026.

Figure 39:
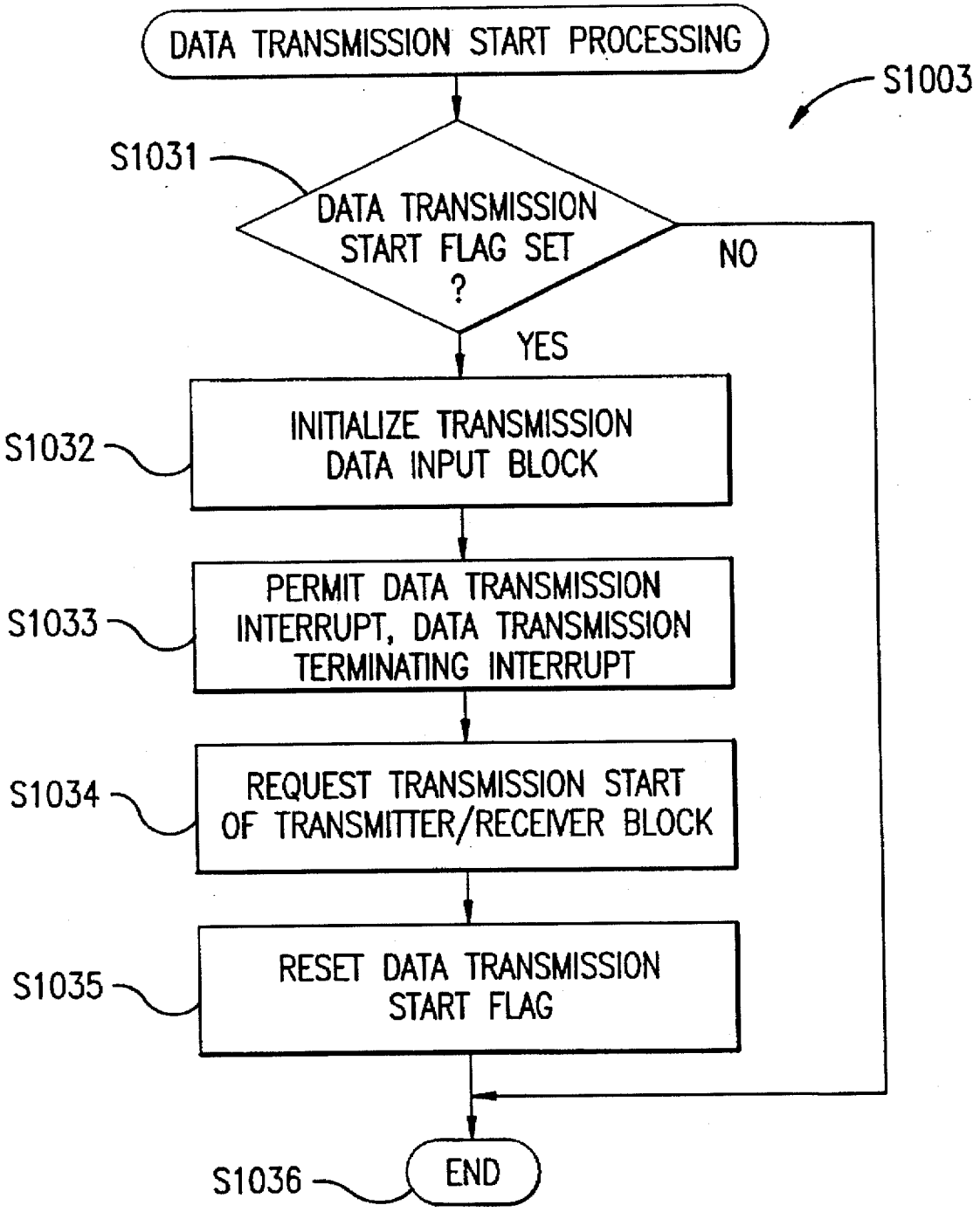
FIG. 39 is a flowchart of data transmission-starting processing executed by the FIG. 34 transmitter.

According to the data transmission start processing (the step S1003 in FIG. 36), the transmitter/receiver 716 starts transmission. As shown in FIG. 39, first at a step S1031, it is determined whether or not the data transmission start flag is set. If the answer to this question is affirmative (YES), it is judged that transmission is permitted to be started, and initialization of the transmission data output block 715 is carried out at a step S1032. Then, after data transmission interrupt and data transmission terminating interrupt are permitted at a step S1033, start of transmission is requested of the transmitter/receiver block 716 at a step S1034. Then, the data transmission start flag is reset at a step S1035, and then the program is terminated at a step S1036. In addition, if the answer to the question of the step S1031 is negative (NO), it is judged that transmission is inhibited, and the program is immediately terminated.

Figure 40:
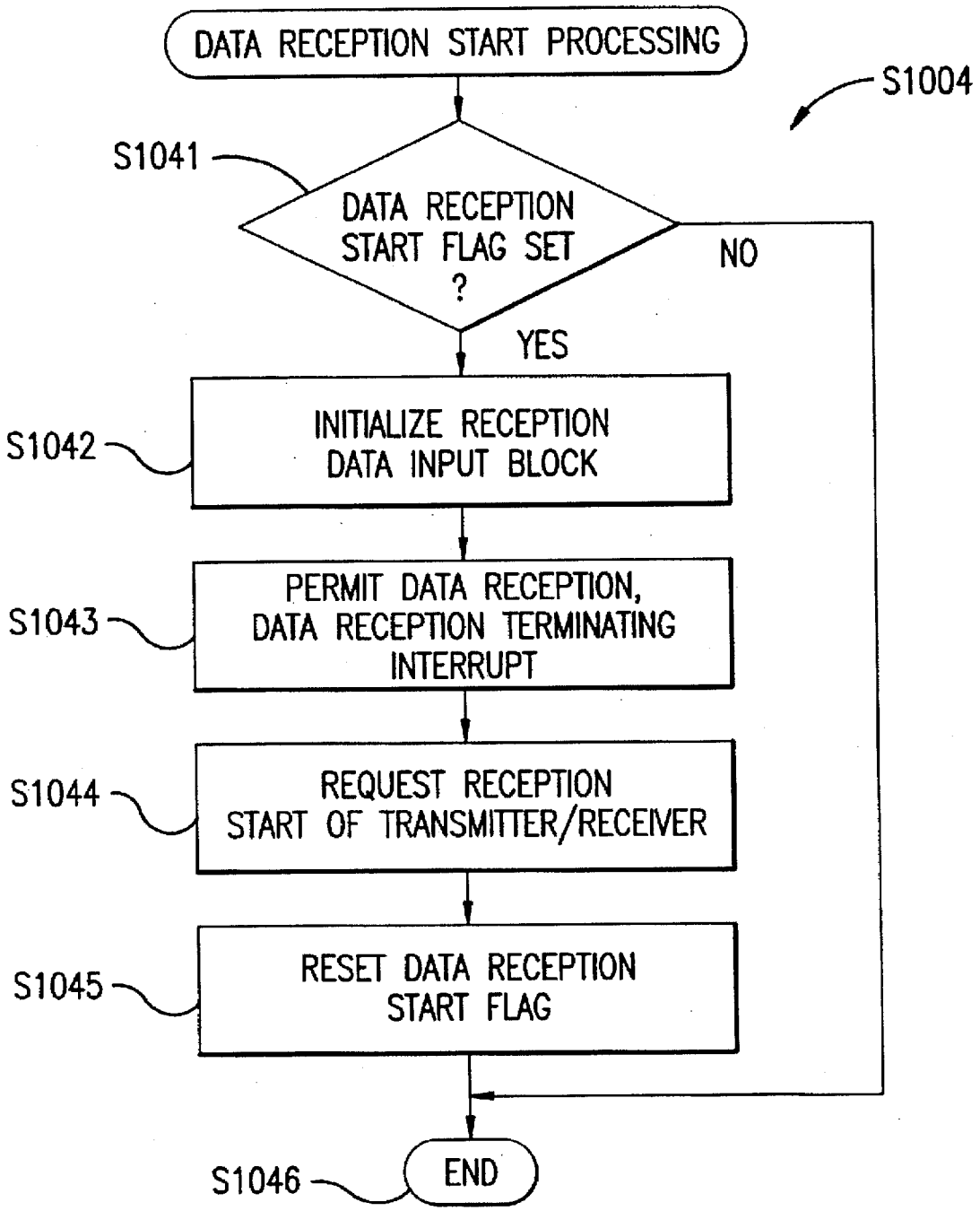
FIG. 40 is a flowchart of data reception-starting processing executed by the FIG. 34 transmitter.

According to the data reception start processing (the step S1004 in FIG. 36), the transmitter/receiver 716 starts reception. As shown in FIG. 40, first at a step S1041, it is determined whether or not the data reception start flag is set. If the answer to this question is affirmative (YES), it is judged that reception is permitted to be started, and initialization of the reception data output block 715 is carried out at a step S1042. Then, after data reception interrupt and data reception terminating interrupt are permitted at a step S1043, start of reception is requested of the transmitter/receiver block 716 at a step S1044. Then, the data reception start flag is reset at a step S1045, and then the program is terminated at a step S1046. In addition, if the answer to the question of the step S1041 is negative (NO), it is judged that reception is inhibited, and the program is immediately terminated.

Next, there will be described processing carried out separately from the main processing; the aforementioned timer T1 interrupt processing, timer interrupt T2 processing, data transmission interrupt processing, data transmission terminating interrupt processing, data reception interrupt processing, and data reception terminating processing, with reference to FIG. 41 to FIG. 46.

Figure 41:
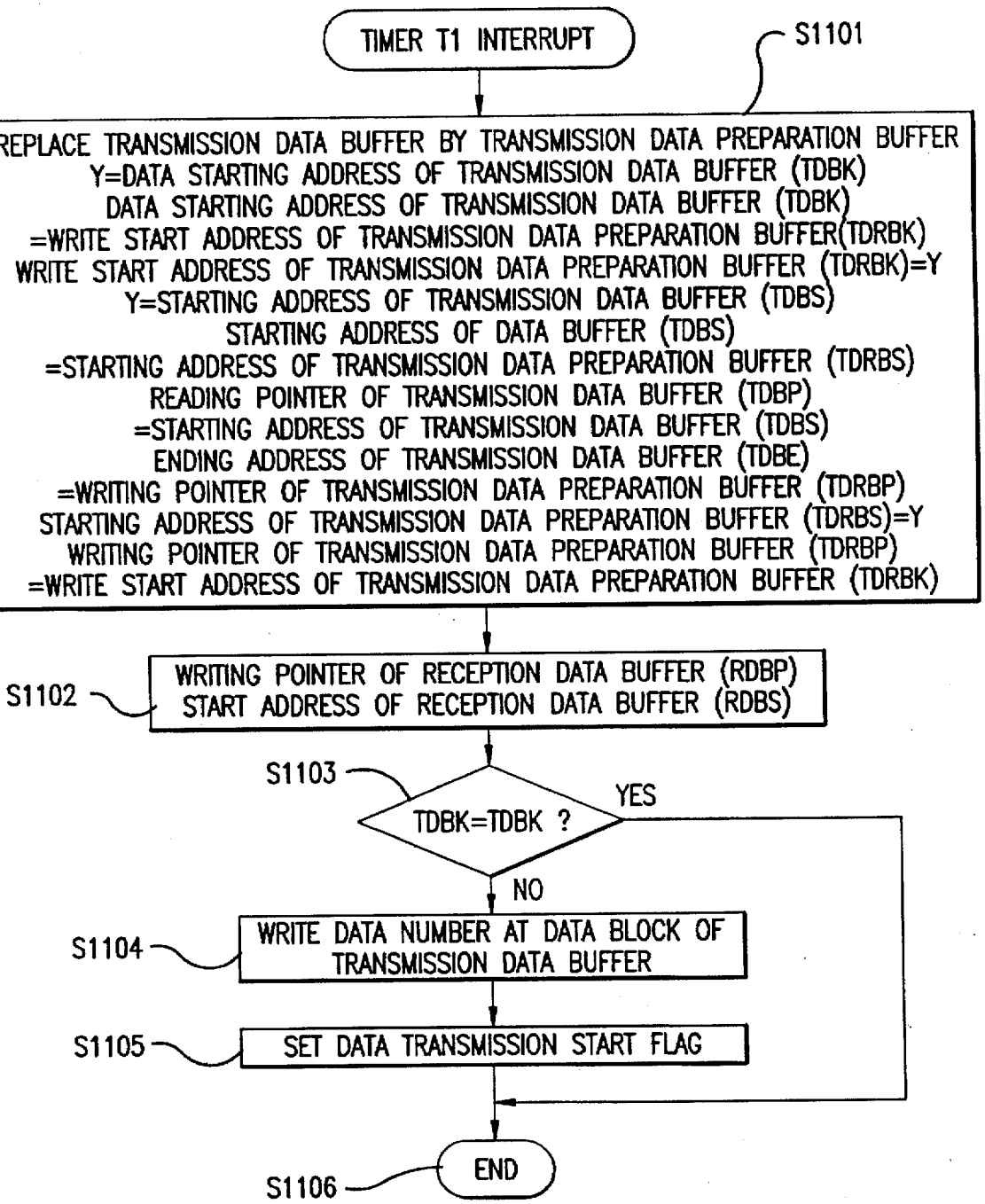
FIG. 41 is a flowchart of timer T1 interrupt processing executed by the FIG. 34 transmitter.

According to the timer T1 interrupt processing, when a predetermined time period T1 elapses, as shown in FIG. 41, it is regarded that transmission data already written in the transmission data buffer has been transmitted, and the transmission data buffer is replaced by the transmission data preparation buffer at a step S1101. In this connection, instead of this, data written in the transmission data preparation buffer may be transferred to the transmission data buffer. Next, the writing pointer of the reception data buffer of the transfer data temporary storage block 714 is set to a starting address of the reception data buffer at a step S1102. Then, it is determined at a step S1103 whether or not data start address of the transmission data buffer is equal to the end address of the same. If the answer to this question is negative (NO), it is determined that there remains transmission data, and "DATA number" is written into the starting address of the transmission data buffer at a step S1104, and the transmission start flag is set at a step S1104. Then, the program is terminated at a step S1106. If the answer to the question of the step S1103 is affirmative (YES), it is judged there is no transmission data, and the program is immediately terminated.

Figure 42:
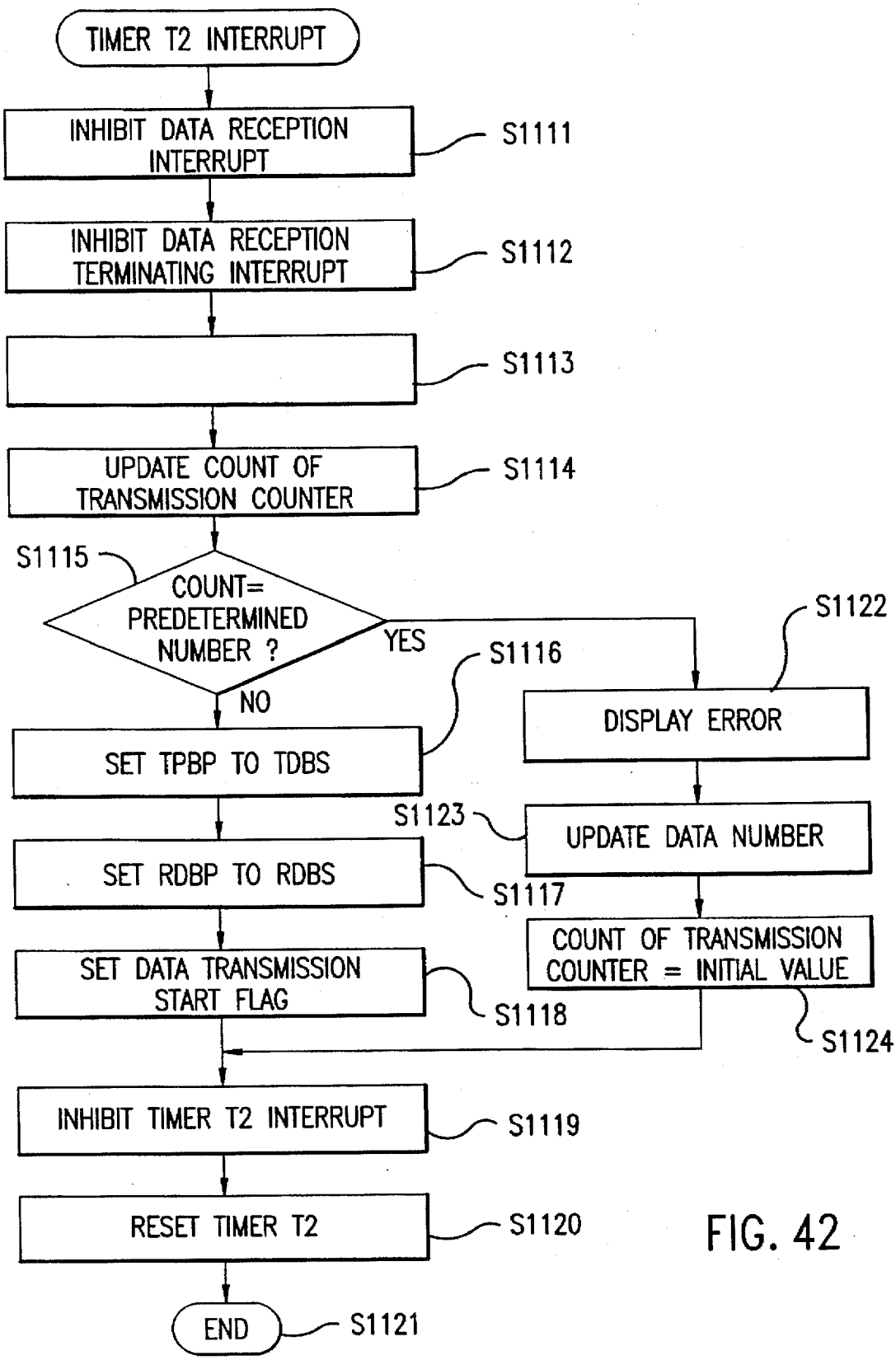
FIG. 42 is a flowchart of timer T2 interrupt processing executed by the FIG. 34 transmitter.

According to the timer T2 interrupt processing, as shown in FIG. 42, the data reception interrupt is inhibited at a step S1111, and the data reception terminating interrupt is inhibited at a step S1112. Then, after requesting the termination of transmission of the transmitter/receiver block 716 at a step S1113, the count of a transmission counter for counting times of transmission is updated at a step S1114. Then, it is determined at a step S1115 whether or not the count becomes equal to a predetermined number. If the answer to this question is negative (NO), the reading pointer of the transmission data buffer is set to the starting address of the transmission data buffer at a step S1116, and then the writing pointer of the transmission data buffer is set to the starting address of the reception data buffer S1117. Then, the data transmission start flag is set at a step S1118, the timer T2 interrupt is inhibited at a step S1119, and a timer T2 is reset at a step S1120, followed by terminating the program at a step S1121. If the answer to the question of the step S1115 is affirmative (YES), it is judged that data was not received properly, and an error message is displayed on the display at a step S1122. Then, "DATA number" is updated at a step S1123, thereby preparing for transmission of the following data, and the count of the transmission counter is reset to an initial value at step S1124, followed by the program proceeding to the step S1119.

Figure 43:
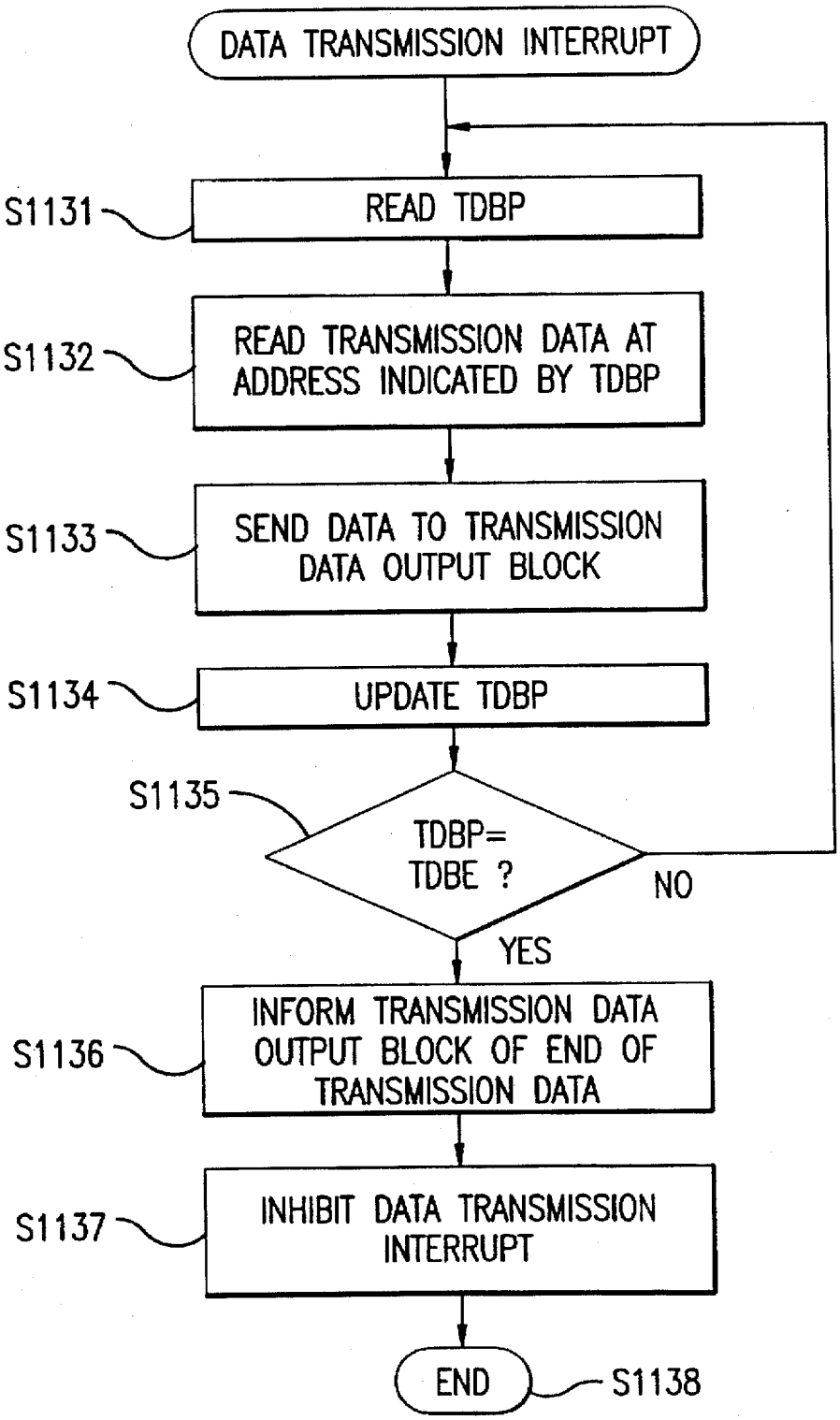
FIG. 43 is a flowchart of data transmission interrupt processing executed by the FIG. 34 transmitter.

According to the data transmission interrupt processing, as shown in FIG. 43, the pointer (TDBP) of the reading pointer of the transmission data buffer of the transfer data temporary storage block 714 is read at a step S1131, and transmission data at an address indicated by the reading pointer is read at a step S1132. Then, after the transmission data read is stored into the internal buffer of the transmission data output block 715 at a step S1133, the pointer value of the reading pointer is updated at a step S1134. Then, it is determined at a step S1135 whether or not the updated reading pointer agrees with the end address of the transmission data buffer. If the answer to this question is affirmative (YES), it is judged that all transmission data has been transmitted, a transmission data terminating signal indicative of end of transmission data is delivered to the transmission data output block 715 at a step S1136. Then, the data transmission interrupt is inhibited at a step S1137, and the program is terminated at a step S1138.

If the answer to the question of the step S1135 is negative (NO), the program returns to the step S1131, and the steps S1131 to S1135 are repeatedly carried out until the answer to the question of the step S1135 becomes affirmative (YES). In addition, in the above processing, when a data transmission interrupt signal indicative of existence of a free area in the internal buffer of the transmission data output block 715 is delivered from the transmission data output block 715, transmission data is sequentially transferred from the transmission data buffer of the transfer data temporary storage block 714 to the transmission data output block 715 for storage therein. When all transmission data has been transferred, the transmission data terminating signal is delivered to the transmission data output block 715, to thereby inhibit data transmission interrupt at the step S1138.

Figure 44:
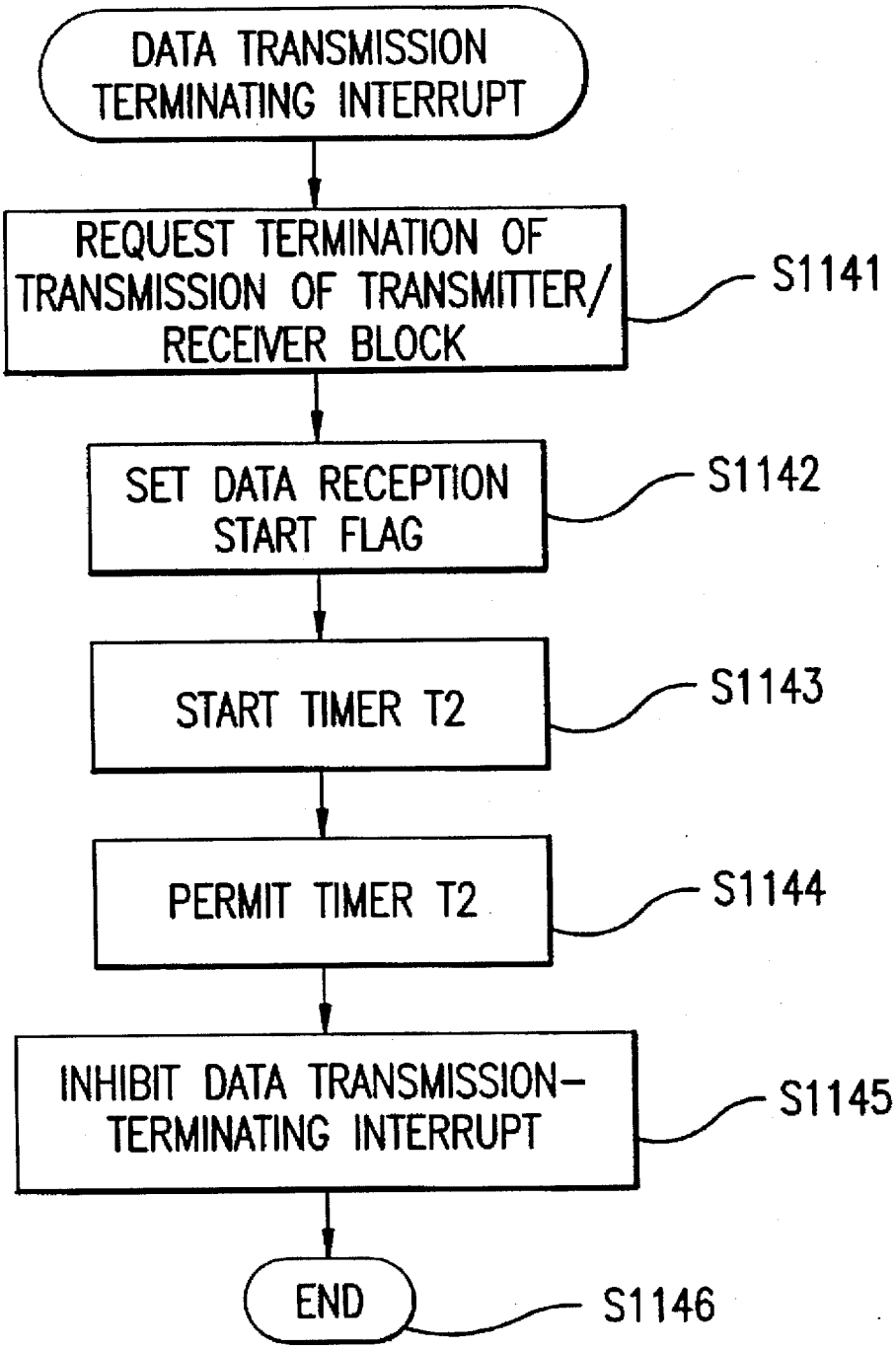
FIG. 44 is a flowchart of data transmission-terminating interrupt processing executed by the FIG. 34 transmitter.

The data transmission terminating interrupt processing is carried out when the transmission data output block 715 delivers the data transmission terminating signal indicative of transmission of all the transmission data. As shown in FIG. 44, the transmission terminating signal is delivered to the transmitter/receiver block 716 to request termination of transmission at a step S1141, and the data reception start flag is set. Then, the timer T2 is started at step S1143, and the timer T2 interrupt is permitted for answering a response from the receiver 704 associated with the transmitter 703, at a step S1144. Then, the data transmission terminating interrupt is inhibited at a step S1145, and the present program is terminated at a step S1146. Thereafter, the data reception start processing (the step S1004 in FIG. 36) is carried out.

Figure 45:
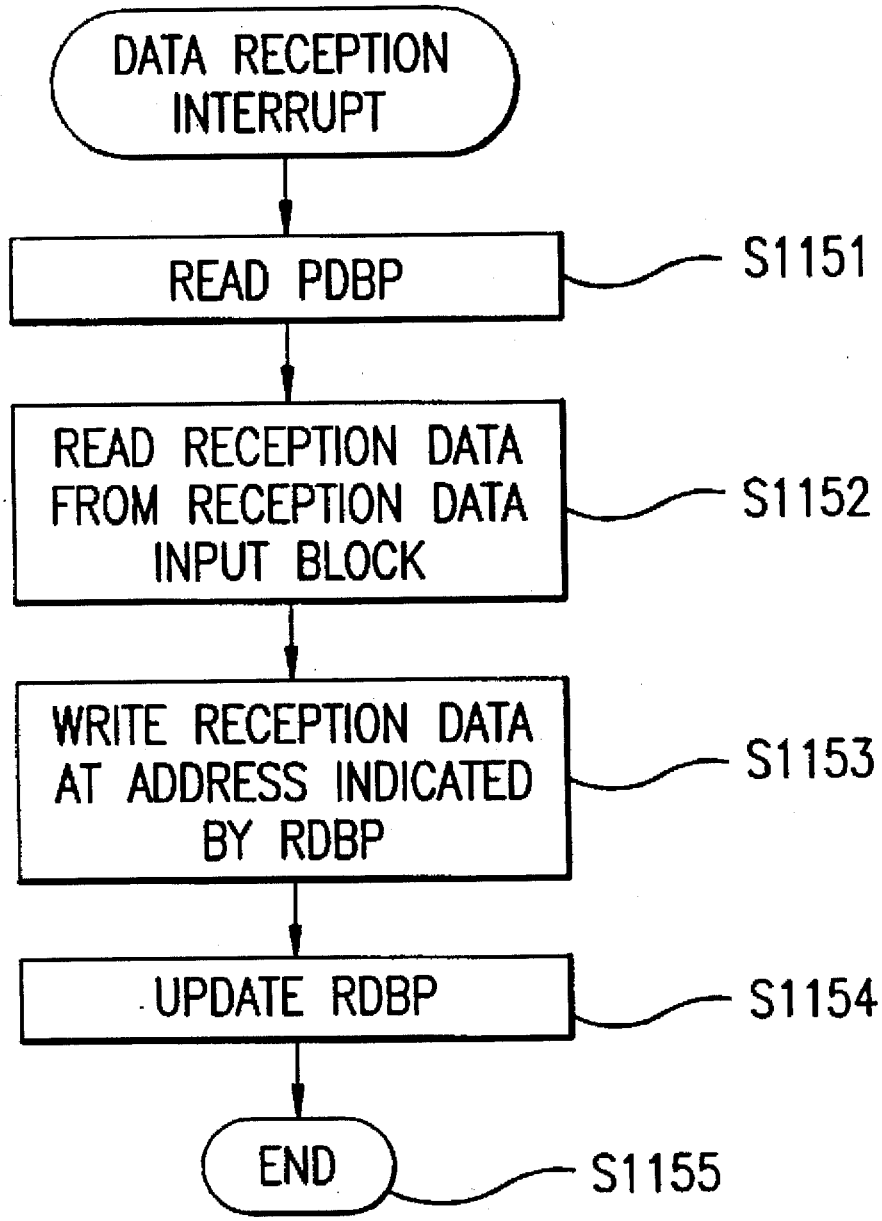
FIG. 45 is a flowchart of data reception interrupt processing executed by the FIG. 34 transmitter.

In the data reception interrupt processing, as shown in FIG. 45, a value of the writing pointer of the reception data buffer is read at a step S1151, and the received data is read from the received data input block 717 at a step S1152. Then, the received data read out is written into an address indicated by the writing pointer at a step S1153, and the writing pointer is updated at a step S1154, followed by terminating the present program at a step S1156. In this processing, when the data reception interrupt signal indicative of all areas of the internal buffer being filled with received data is delivered from the received data input block 717, the received data written in the areas is transferred to the reception data buffer of the transfer data temporary storage block 714.

Figure 46:
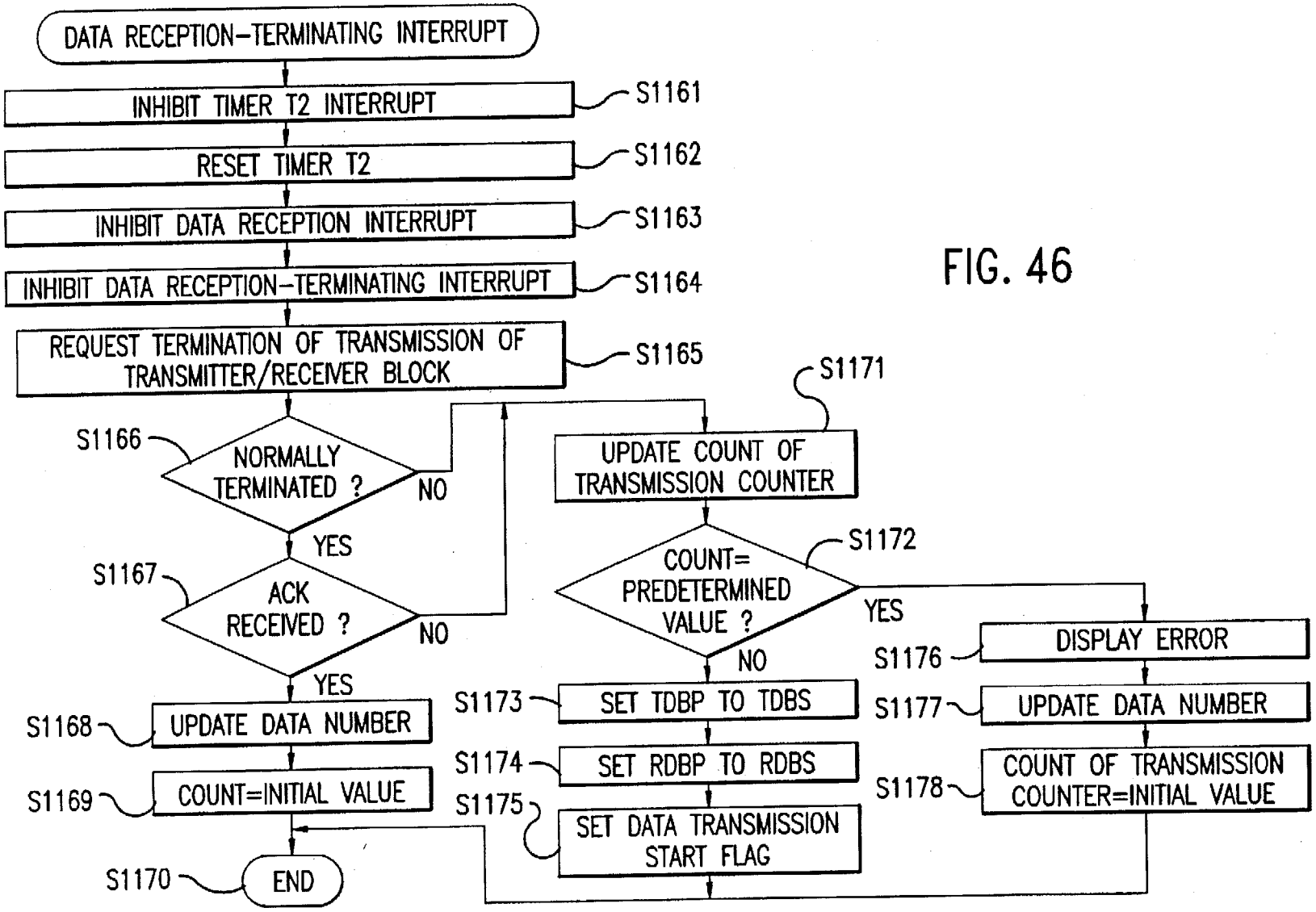
FIG. 46 is a flowchart of data reception-terminating processing executed by the FIG. 34 transmitter.

In the data reception terminating interrupt processing, a check is made as to whether the transmitter/receiver block 716 has received data properly, and when "ACK" is received, the transmitter enters the standby state for a subsequent transmission, whereas when "NAK" is received, re-transmission of data or display of an error is carried out. More specifically, as shown in FIG. 46, when the data reception terminating interrupt signal indicative of completion of reception of all reception data, or detection of an error by the error correction code is delivered from the received data input block 717, the timer T2 interrupt is inhibited at a step S1161, and the timer T2 is reset at a step S1162. Then, the data reception interrupt is inhibited at a step S1163, and the data reception terminating interrupt is inhibited at a step S1164. Then, termination of data reception is requested of the transmitter/receiver block 716 at a step S1165, and it is determined at a step S1166 whether or not an error is detected by checking for the error correction code, i.e. whether the data reception is terminated properly. If the answer to this question is affirmative (YES), it is determined at a step S1167 whether or not the receiver 704 has sent back "ACK" as a reply. If the answer to this question is affirmative (YES), the "DATA number" updated at a step S1168, and the count of the transmission counter is updated at a step S1169, entering the standby state for a subsequent transmission, followed by terminating the program at a step S1170.

If the answer to the question of the step S1166 or the answer to the question of the step S1167 is negative (NO), the count of the transmission counter is updated at a step S1171, and then it is determined at a step S1172 whether or not the count of the transmission counter is equal to a predetermined value. If the answer to this question is negative (NO), a value of the reading pointer is set to the starting address of the transmission data buffer at a step S1173 then, the writing pointer of the reception data buffer is set to the starting address of the reception data buffer at a step S1174, and the data transmission start flag is set at a step S1175 to re-transmit the transmission data to the receiver 704, followed by terminating the present program at a step S1176. If the answer to the question of the step S1172 is affirmative (YES), i.e. the transmission has been carried the predetermined number of times, it is judged that the receiver could not receive the transmission data properly, so that an error message is displayed on the display 718 at a step S1176. Then, the "DATA number" is updated at a step S1177, and the count of the transmission counter is reset to an initial value at a step S1178, followed by terminating the program at a step S1179.

Next, the processing carried out by the receiver 704 will be described. The operations described below are carried out by the CPU 711, unless otherwise specified.

Figure 47:
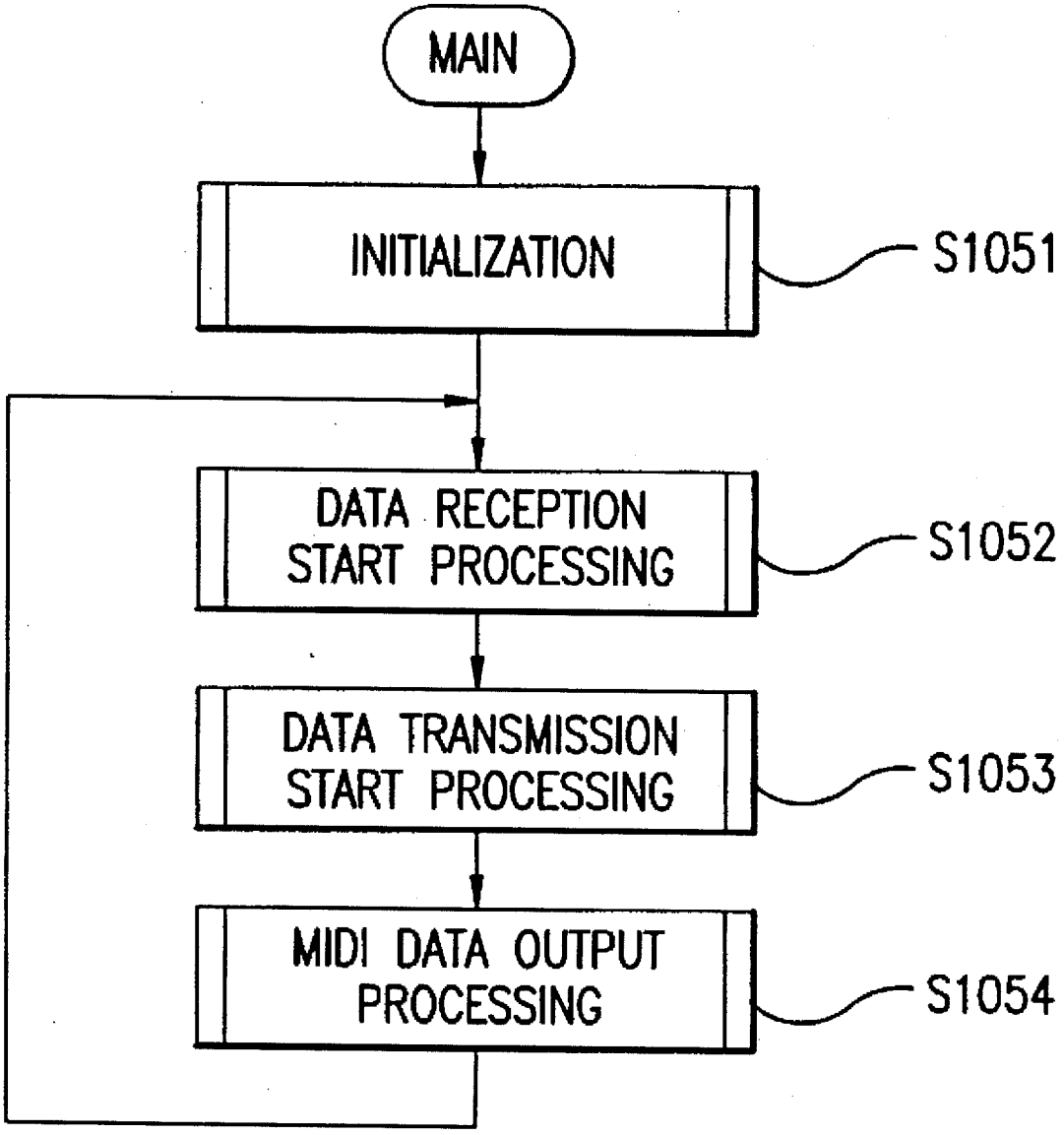
FIG. 47 is a flowchart of a main routine executed by the FIG. 35 receiver.

First, a main processing of the receiver will be described with reference to FIG. 47 to FIG. 51. As shown in FIG. 47, in this main processing, initialization is carried out at a step S1051 when the power is turned on. Then, DATA reception start processing, data transmission start processing, and MIDI data output processing are carried out at steps S1052, S1053, and S1054, respectively.

Figure 48:
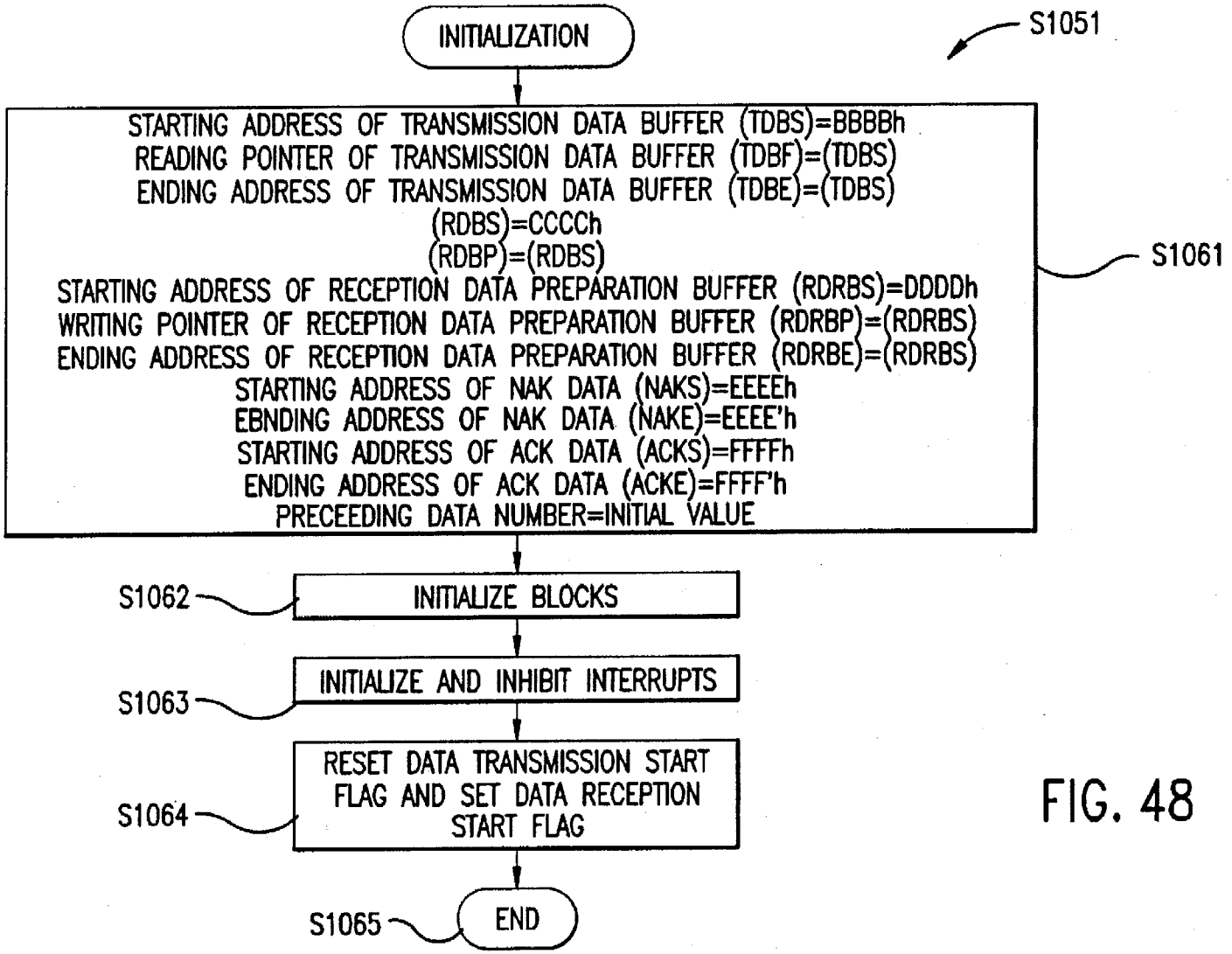
FIG. 48 is a flowchart of initialization processing executed by the FIG. 35 receiver.

At initialization (step S1051), as shown in FIG. 48, there are carried out at a step S1061 settings of starting addresses, reading pointers, writing pointers. etc. for the transmission data buffer, the reception data buffer, and the reception data preparation buffer, of the transfer data temporary storage block 734. Then, blocks other than the transfer data temporary storage block 734 are initialized at a step S1062, and initialization and inhibition of various interrupts, referred to hereinafter, are carried out at a step S1063. Next, a data transmission start flag is reset and at the same time a data reception start flag is set at a step S1064, followed by terminating the present program at a step S1065.

Figure 49:
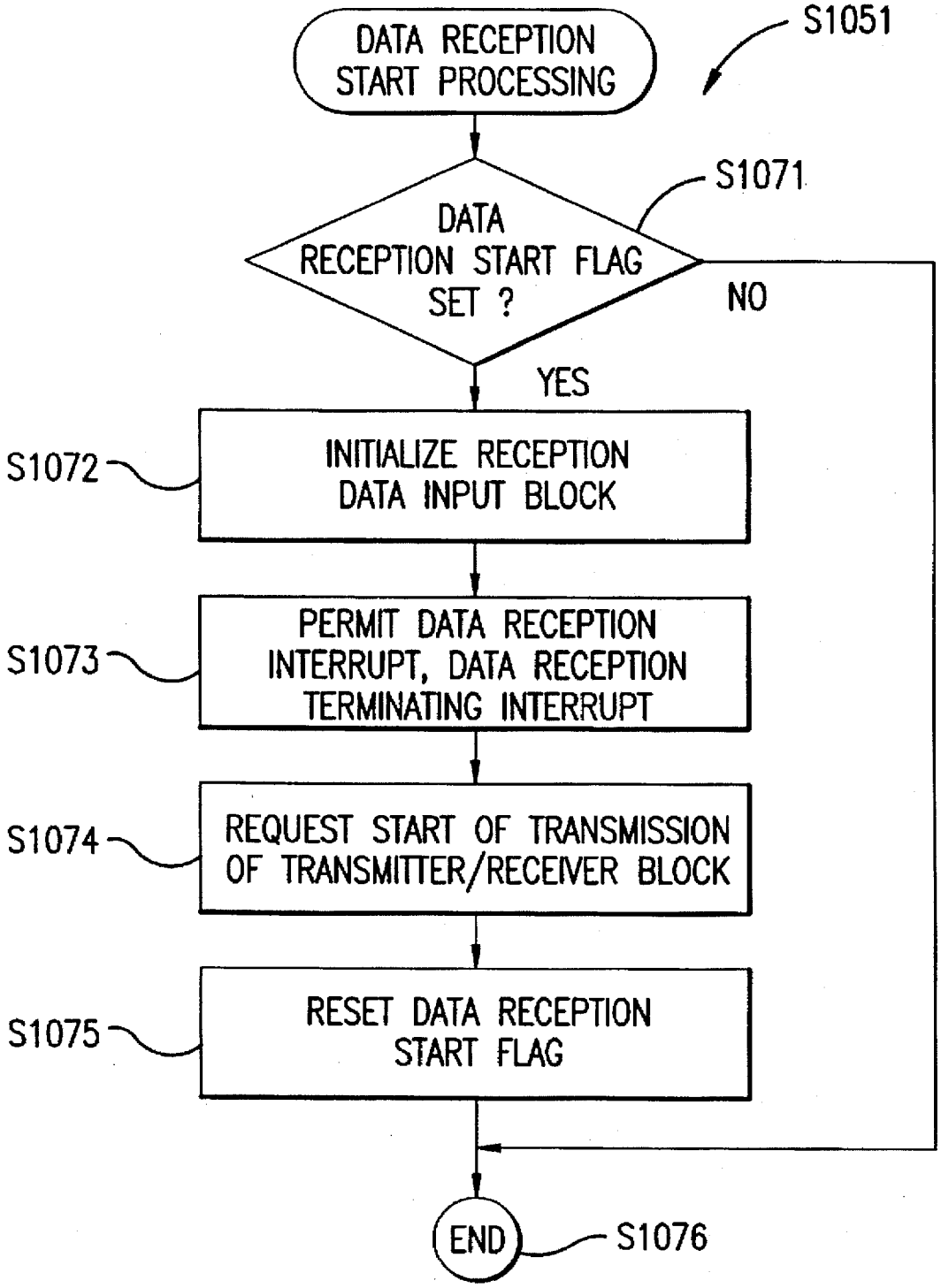
FIG. 49 is a flowchart of data reception-starting processing executed by the FIG. 35 receiver.

According to the data reception start processing (the step S1062 in FIG. 47), the transmitter/receiver 716 starts reception of data. As shown in FIG. 49, first at a step S1071, it is determined whether or not the data reception start flag is set. If the answer to this question is affirmative (YES), it is judged that data reception is permitted to be started, and initialization of the internal buffer of the received data input block 717 is carried out at a step S1072. Then, after data reception interrupt (#3 in FIG. 35) and data reception terminating interrupt (#4 in FIG. 35) are permitted at a step S1073, start of reception is requested of the transmitter/receiver block 716 at a step S1074. Then, the data reception start flag is reset at a step S1075, and then the program is terminated at a step S1076. In addition, if the answer to the question of the step S1071 is negative (NO), it is judged that data reception is inhibited, and the program is immediately terminated.

Figure 50:
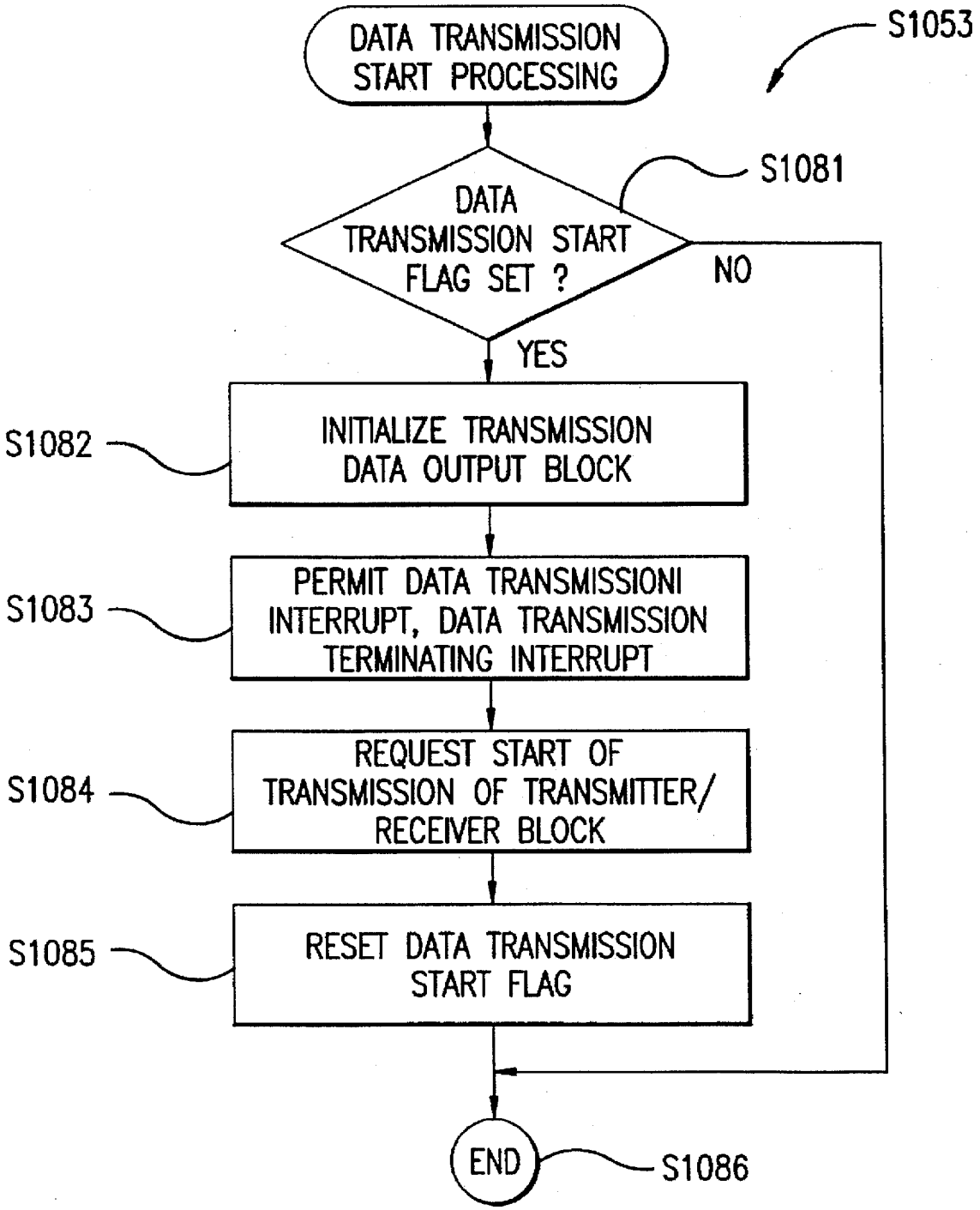
FIG. 50 is a flowchart of data transmission-starting processing executed by the FIG. 35 receiver.

According to the data transmission start processing (the step S1063 in FIG. 47), the transmitter/receiver 716 starts transmission of data. As shown in FIG. 50, first at a step S1081, it is determined whether or not the data transmission start flag is set. If the answer to this question is affirmative (YES), it is judged that transmission is permitted to be started, and initialization of the internal buffer of the transmission data output block 715 is carried out at a step S1082. Then, after data transmission interrupt (#1 shown in FIG. 35) and data transmission terminating interrupt (#2 shown in FIG. 35) are permitted at a step S1083, start of transmission is requested of the transmitter/receiver block 716 at a step S1084. Then, the data transmission start flag is reset at a step S1085, and then the program is terminated at a step S1086. In addition, if the answer to the question of the step S1081 is negative (NO), it is judged that transmission is inhibited, and the program is immediately terminated.

Figure 51:
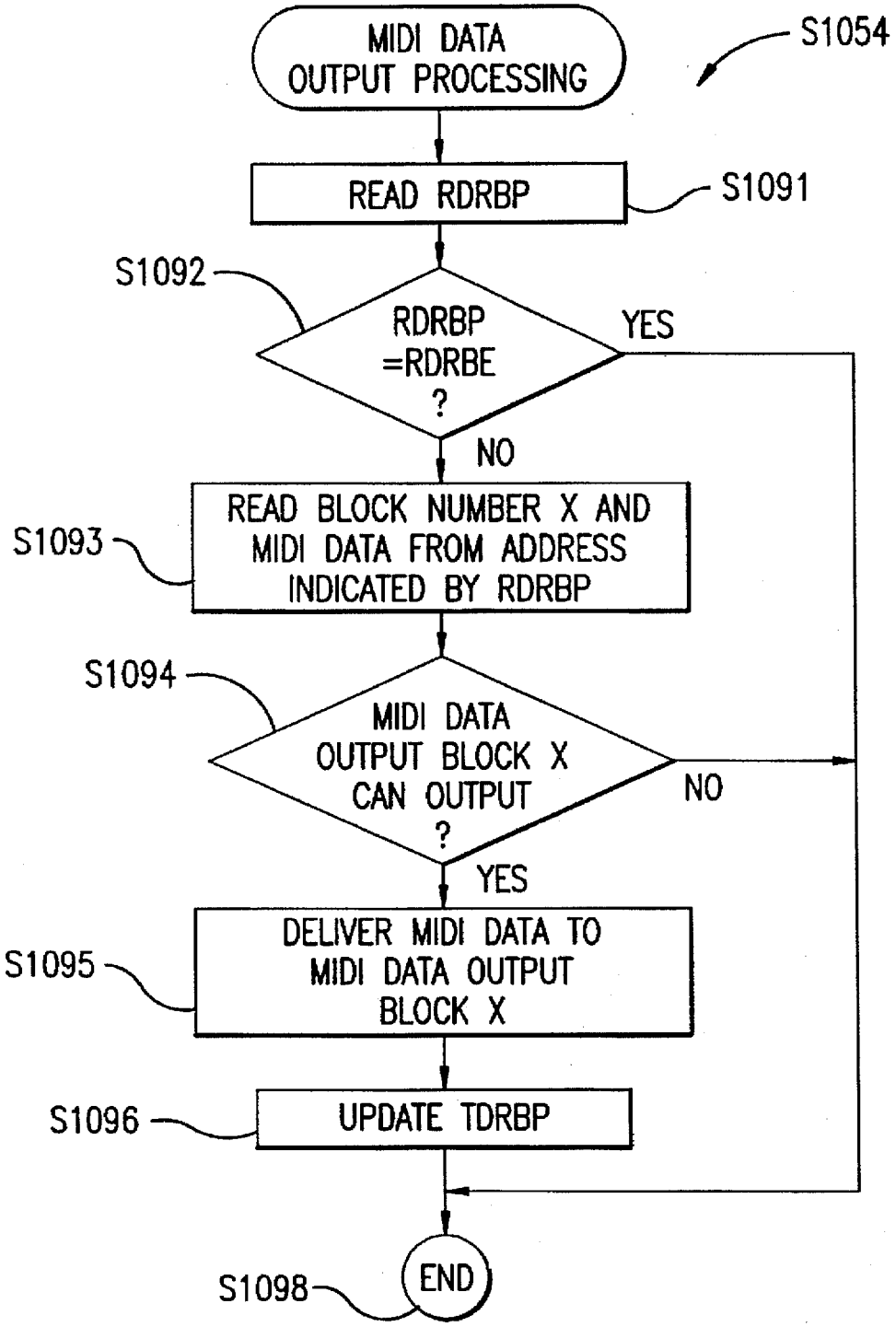
FIG. 51 is a flowchart of MIDI data output processing executed by the FIG. 35 receiver.

According to the MIDI data output processing (the step S1053 in FIG. 47), MIDI data is output from the MIDI data output block 732. As shown in FIG. 51, a value of the reading pointer of the reception data preparation buffer is read at a step S1091. Then, it is determined at a step S1092 whether or not the value of the reading pointer agrees with the ending address of the reception data preparation buffer. If the answer to this question is negative (NO), a unit number X and MIDI data are read out from an address indicated by the reading pointer, at a step S1093. Then, it is determined at a step S1094 whether or not a MIDI data output block 732X corresponding to the unit number is capable of delivering data. If the answer to this question is affirmative (YES), MIDI data is delivered to the MIDI data output block 732X at a step S1095, and the reading pointer is updated at a step S1096, followed by terminating the program at a step S1097.

If the answer to the question of the step S1092 is affirmative (YES), or if the answer to the question of the step S1094 is negative (NO), the program is immediately terminated.

Next, there will be described processings carried out separately from the main processing; data reception interrupt processing, data reception terminating interrupt processing, data transmission interrupt processing, and data transmission terminating interrupt processing. The data reception interrupt processing and the data transmission interrupt processing are identical to the data reception interrupt processing and the data transmission terminating interrupt processing carried out by the transmitter 703, respectively, and hence description thereof is omitted.

Figure 52:
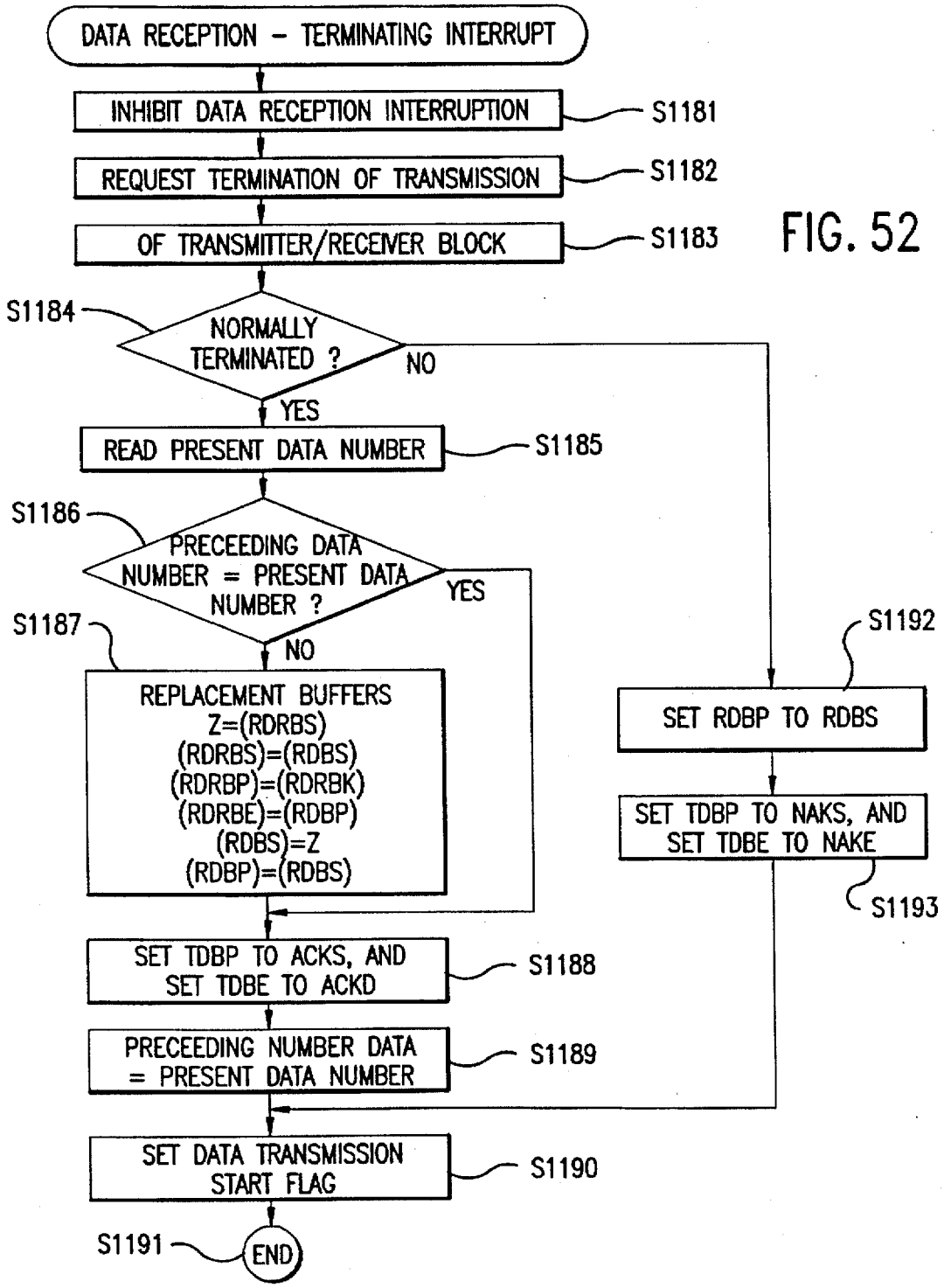
FIG. 52 is a flowchart of data reception-terminating interrupt processing executed by the FIG. 34 transmitter.

In the data reception terminating interrupt, a check is made as to whether the transmitter/receiver block 716 has received data properly. If the data has been properly received, "ACK" is delivered, whereas if the data has not been received properly, "NAK" is delivered. More specifically, when the data reception terminating interrupt signal indicative of completion of reception of all reception data, or detection of an error by the error correction code, is delivered from the received data input block 717, this processing is carried out. As shown in FIG. 52, the data reception interrupt and the data reception terminating interrupt are inhibited at steps S1181 and S1182, respectively, and the termination of data reception is requested of the transmitter/receiver block 716 at a step S1183. Then, it is determined at a step S1184 whether or not data is received properly. If the answer to this question is affirmative (YES), "DATA number" received this time is read out at a step S1185, and it is determined at a step S1186 whether or not the "DATA number" received last time is equal to the "DATA number" received this time. If the answer to this question is negative (NO), it is judged that the received data is a new item of reception data, and the reception data buffer is replaced by the reception data preparation buffer at a step S1187.

Then, the reading pointer of the transmission data buffer is set to the starting address of the "ACK" data, and the ending address of the transmission data buffer is set to the ending address "ACKE" of the "ACK" data at a step S1188. That is, the preparation for transmission of "ACK" data is carried out. Next, the "DATA number" received last time is updated to "DATA number" received this time at a step S1189, and the data transmission start flag is set at a step S1190, followed by terminating the program at a step S1191. The MIDI data output processing is carried out next. If the answer to the question of the step S1186 is affirmative (YES), it is judged that the same data is transmitted again, and the reception data is canceled.

If the answer to the question of the step S1184 is negative (NO), the program proceeds to a step S1192 where a value of the writing pointer of the reception data buffer is set to the starting address of the reception data buffer. Then, a value of the transmission data buffer pointer is set to a starting address of the "NAK" data, and the ending address of the transmission data buffer is set to an ending address "NAKE" of the "NAK" data, at a step S1193. In short, preparation for transmission of the "NAK" data is carried out. Then, the program jumps over to the step S1190, followed by terminating the program at the step S1191.

Figure 53:
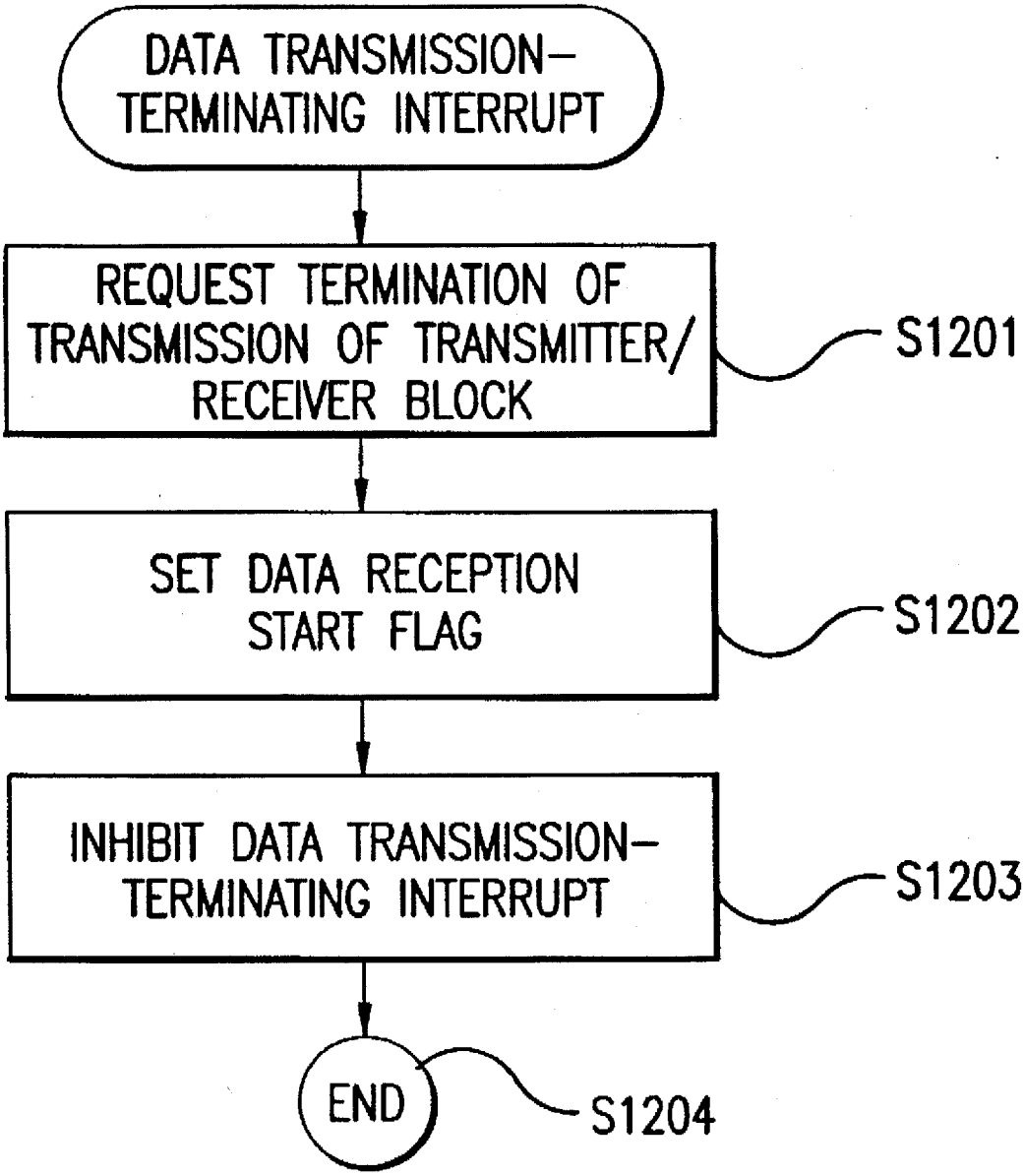
FIG. 53 is a flowchart of data transmission-terminating interrupt processing executed by the FIG. 35 receiver.

The data transmission terminating interrupt processing is carried out when the data transmission terminating signal indicative of delivery all of the transmission data, "ACK" or "NAK", the error correction coed, and the stop code is delivered from the transmission data output block 715. As shown in FIG. 53, termination of transmission is requested of the transmitter/receiver block 716 at a step S1201, and at the same time, the data reception start flag is set at a step S1202. Then, the data transmission terminating interrupt is inhibited at a step S1203, followed by terminating the program at a step S1204.

As described above, according to the present embodiment, the transmitter 703 is capable of receiving MIDI data simultaneously from a plurality of keyboards 702, and transmitting the MIDI data to tone generators 705 forming counterparts to the keyboards, respectively, in real time. As a result, only one transmitter 703 and one receiver 704 are required in the above performance. Therefore, compared with the prior art system in which transmitters 703 are each provided for a pair of keyboards, and receivers 704 are each provided for a pair of tone generators 705, the MIDI instrument system 701 to which the present invention is applied can be realized at reduced cost. This holds true with cases in which three or more keyboards 702 and a corresponding number of tone generators 705 are used, and in such cases, the degree of reduction of cost is even more marked. Further, one transmitter 703 transmits transmission data by one transmitting frequency, and hence no interference occurs on the receiver side 704, so that MIDI can be reliably transmitted to the tone generators 705.

Further, the frequency of data transmission employed in the transmitter 703 and the receiver 704 is not limited, but another frequency may be used. Further, although in the present embodiment, modulation of a radio signal is carried out by the spread spectrum method, this is not limitative, but any suitable modulation method, such as the ON/OFF modulation method, the FM modulation method, the PM modulation method, the PCM modulation method and an ADPCM modulation method can be employed. Further, the transmitter and the receiver may be constructed such that transmission by infrared rays is possible. Further, the transmitter 703 and the receiver 704 may be integrated into one unit or transmitter/receiver, such that duplex communication can be carried. In this case, performance may be given at one place and reproduced at the other place remote therefrom, and inversely given at the other place and reproduced at the one place, simultaneously.

Further, transmission/reception of data by the present invention is not limited to transmission/reception between instruments and devices described in the above first to seventh embodiments, but it is possible to carry out transmission and reception of data between all kinds of MIDI instrument devices, including performance devices, such as keyboards and MIDI guitars, tone generators, and sequencers. Further, when the transmitter/receiver is connected to a performance information-recording device, such as a sequencer, the performance information-recording device can receive a radio signal transmitted from the other MIDI instrument device, and record a MIDI data recovered by demodulating the radio signal.

Further, although in the first and second embodiment, description is made on a case where a dip switch is used as a setting switch, this is not limitative, but any suitable small-sized lock-type switch can be used.

Further, the transmitter/receiver block in the above embodiments may be constructed such that it can transmit and receive signals of infrared rays.

Further, although in the above embodiments the transmitter/receiver block is constructed such that it is capable of transmitting and receiving a radio signal prepared by FM (Frequency Modulation), this is not limitative, but it goes without saying that there may be employed other modulation methods, such as on/off modulation of the high-frequency carrier, the AM modulation, the PM modulation, and the pulse modulation.

Further, although in the above embodiments, the transmitter/receiver block is constructed such that it is possible to effect transmission and reception of data by a simplex method, this is not limitative, but it may be constructed such that it is possible to effect transmission and reception of data by a duplex method by the use of a transmitter and a receiver which are separately provided and operate independently of each other.

What is claimed is:

1. In a MIDI data transmitter/receiver for a MIDI instrument which delivers MIDI data for transmitting performance information, including:

radio means connected to the MIDI instrument for transmitting and/or receiving a radio signal modulated by the MIDI data, an unlock-type switch for setting operating conditions of said radio means, operating conditions-setting means for setting said operating conditions based on a switch signal of said unlock-type switch, and a control block for controlling said radio means according to said set operating conditions, the improvement comprising a lock-type setting switch for setting initial operating conditions of said radio means, wherein said control block controls said radio means based on said initial operating conditions set by said lock-type setting switch, when the power is turned on.

2. A MIDI data transmitter/receiver according to claim 1, wherein said lock-type setting switch is a dip switch.

3. In a MIDI data transmitter/receiver for a MIDI instrument which delivers MIDI data for transmitting performance information, including:

radio means connected to said MIDI instrument for transmitting and/or receiving a radio signal modulated by said MIDI data, an unlock-type switch for setting operating conditions of said radio means, operating conditions-setting means for setting said operating conditions based on a switch signal of said unlock-type switch, and a control block for controlling said radio means according to said set operating conditions, the improvement comprising memory means which is electrically rewritable and stores data of operating conditions set by said control block, wherein said control block controls said radio means based on newest ones of said operating conditions stored in said memory means, when the power is turned on.

4. A MIDI data transmitter/receiver according to claim 3, wherein said memory means is equipped with back-up means for holding contents of storage when the power of said MIDI data transmitter/receiver is turned off.

5. A MIDI data transmitter/receiver according to claim 3, wherein said memory means is formed by non-volatile memory means.

6. A MIDI data transmitter/receiver according to claim 5, including other non-volatile memory means storing data of initial operating conditions of said radio means, and a lock-type switch, wherein said control block controls said radio means based on one of said data of initial operating conditions stored in said other non-volatile memory means and settings set by said lock-type switch, when said memory means stores no data of said operating conditions, when the power is turned on.

7. A MIDI data processor for processing MIDI data delivered from a MIDI data output device and delivering processed MIDI data to a MIDI instrument, comprising:

a determination block for determining whether or not said MIDI data delivered from said MIDI data output device is note-on data;

a counter starting to operate when said determination block has determined that said MIDI data is said note-on data; and a control block for generating note-off data having a note number identical to a note number of said note-on data when the count of said counter has reached a predetermined value.

8. A MIDI data processor according to claim 7, wherein said counter is formed of a plurality of counters corresponding to all note numbers, respectively.

9. A MIDI data processor according to claim 7, wherein said counter is formed of a plurality of counters, and said determination block including memory means for storing a counter number of one of said counters having started to operate when said determination block has determined that said MIDI data is said note-on data, and a note number of said note-on data, said control block generating note-off data having a note number identical to said note number corresponding to said counter number of said one of said counters stored in said memory means when the count of said one of said counters has reached said predetermined value, and delivering said note-off data to said MIDI instrument.

10. In a MIDI data transmitter for a MIDI instrument which delivers MIDI data for transmission of performance information, said MIDI data transmitter being connected to said MIDI instrument and including modulation means for modulating a high-frequency signal by said MIDI data delivered from said MIDI instrument, and data other than said MIDI data, a transmitter block for transmitting a radio signal prepared by modulation of said high-frequency signal to a receiver, and a transmission control block for controlling start of transmission by said transmitter block, the improvement comprising:

a transmission data output block for transmitting said MIDI data and said other data to said transmitter block;

transmission time-measuring block for measuring a transmission time having elapsed from a start of transmission by said transmitter block; and control means for performing control such that said transmission data output block delivers said other data to said transmitter block until said transmission time reaches a predetermined time period, and delivers said MIDI data to said transmitter block after said transmission time period has reached said predetermined time period.

11. A MIDI data transmitter according to claim 10, wherein said other data is formed of reception control data for controlling said receiver and/or dummy data.

12. In a MIDI data receiver for a MIDI instrument which delivers MIDI data for transmission of performance information, said MIDI data receiver being connected to said MIDI instrument and including a receiver block for receiving a radio signal modulated by said MIDI data and other data, demodulation means for demodulating said received radio signal, and a received data output block for delivering received data based on said demodulated radio signal to said MIDI instrument, the improvement comprising:

reception-detecting block for detecting reception of data, based on said received radio signal and/or said demodulated radio signal;

reception time-measuring means for measuring a reception time having elapsed after said reception-detecting block has detected said reception of said data: and output control means for performing control such that said received data output block delivers said received data to said MIDI instrument after said reception time has reached a predetermined time period.

13. A MIDI data transmitter including a MIDI data storage block for storing MIDI data delivered from a MIDI data output device for transmitting performance information, and a transmitter block for transmitting said MIDI data stored in said MIDI data storage block by a radio signal, said MIDI data transmitter comprising:

a free area-checking block for checking an amount of free area of said MIDI data storage block; and all note-off data output block for transmitting all note-off data for turning all notes off via said transmitter block, when said amount of said free area of said MIDI data storage block checked by said free area-checking block becomes smaller than a predetermined value.

14. A MIDI data receiver for receiving MIDI data transmitted by a radio signal for transmitting performance information, and delivering said received MIDI data to a MIDI data processor which carries out signal processing based on MIDI data, said MIDI data receiver comprising:

a note number storage block for storing note numbers of notes which are turned on out of said received MIDI data; and a note-off control block for delivering note-off data corresponding to all note numbers stored in said note number storage block to said MIDI data processor, when all note-off data is received by way of said radio signal.

15. A MIDI data transmitter/receiver connected to a MIDI instrument for transmitting MIDI data delivered from said MIDI instrument by a radio signal to another MIDI instrument, comprising:

a transmitter block having a plurality of transmitting channels which can be changed over, including a control channel for transmitting data of a free channel;

a receiver block having a plurality of receiving channels which can be changed over;

a free channel-detecting block for changing over one receiving channel of said receiver block to another, and for detecting a free channel out of said plurality of receiving channels, based on reception output from said receiver block at a channel to which said receiver block is changed; and a transmission control for transmitting data of said free channel detected by said free channel-detecting block and said MIDI data delivered from said MIDI instrument to said transmitter block;

wherein said transmission control block changes over said transmitting channel of said transmitter block to said control channel, and after delivering said data of said free channel detected by said free channel-detecting block to said transmitter block, changes over said transmitting channel of said transmitter block to a transmitting channel corresponding to said data of said free channel.

16. A MIDI data transmitter/receiver connected to a MIDI instrument for receiving a radio signal transmitted, and delivering MIDI data based on said received radio signal to said MIDI instrument connected thereto, comprising:

a receiver block having a plurality of receiving channels which can be changed over, including a control channel for receiving data of a free channel;

a free channel data-detecting block for detecting said data of said free channel from a signal received by said receiver block; and a reception control block for changing over said receiving channel of said receiver block;

wherein said reception control block changes over said receiving channel of said receiver block to said control channel, while said reception control block is on standby, and changes over said receiving channel of said receiver block to a receiving channel corresponding to said data of said free channel when said free channel data-detecting block has detected said data of said free channel.

17. A MIDI data transmitter/receiver connected to a MIDI instrument for transmitting MIDI data to and receiving MIDI data from another MIDI instrument, comprising:

a transmitter block having a plurality of transmitting channels which can be changed over, including a control channel for transmitting data of a free channel;

a receiver block having a plurality of receiving channels which can be changed over, including a control channel for transmitting data of said free channel;

a transmission/reception changeover block for making operative one of said transmitter block and said receiver block;

a reception control block for controlling changeover of one of said receiving channels of said receiver block to another of said receiving channels when said receiver block is made operative by said transmission/reception changeover block;

a free channel-detecting block for changing over said one receiving channel of said receiver block to said another, and detecting a free channel out of said plurality of receiving channels, based on reception output from said receiver block at said another channel to which said receiver block is changed;

a free channel data-detecting block for detecting said data of said free channel from a signal received by said receiver block; and a transmission control block for transmitting said data of said free channel detected by said free channel-detecting block and said MIDI data delivered from said MIDI instrument to said transmitter block;

wherein when said transmission/reception changeover block has made said transmitter block operative, said transmission control block changes over said transmitting channel of said transmitter block to said control channel, and after delivering said data of said free channel detected by said free channel-detecting block to said transmitter block, changes over said transmitting channel of said transmitter to a transmitting channel corresponding to said data of said free channel, as well as delivers said MIDI data to said transmitter block; and wherein when said transmission/reception changeover block has made said receiver block operative, said reception control block changes over said receiving channel of said receiver block to said control channel, and when said free channel data-detecting block has detected said data of said free channel, changes over said receiving channel of said receiver to a receiving channel corresponding to said data of said free channel.

18. A MIDI data transmitter for transmitting MIDI data, which is capable of being connected to a plurality of MIDI data output devices for delivering MIDI data for transmission of performance information, comprising:

a MIDI data input block for inputting MIDI data received from two or more of said plurality of MIDI data devices;

memory means for storing said MIDI data input by said MIDI data input block together with data of each unit number indicative of each of said MIDI data output block having delivered said MIDI data; and a transmitter block for transmitting a radio signal modulated by said data of each unit number indicative of each of said MIDI data output block, and said MIDI data stored together with said data of said each unit number.

19. A MIDI data receiver for receiving MIDI data, which is capable of being connected to a plurality of MIDI data processors each provided for carrying out signal processing based on MIDI data for transmission of performance information, comprising:

a receiver block for receiving a radio signal modulated by data of unit numbers indicative of two or more of said plurality of MIDI data processors, respectively, and MIDI data to be transmitted to said two or more of said plurality of MIDI data processors having said unit numbers, respectively, and demodulating said received radio signal into said data of said unit numbers, and said MIDI data; and a MIDI data output block for delivering said demodulated MIDI data to said MIDI data processors corresponding to said demodulated data of said unit numbers, respectively.

* * * * *